US011287756B2

(12) United States Patent
Nagao

(10) Patent No.: US 11,287,756 B2
(45) Date of Patent: Mar. 29, 2022

(54) POSITIVE CHARGING ELECTROPHOTOGRAPHIC PHOTORECEPTOR, ELECTROPHOTOGRAPHIC CARTRIDGE AND IMAGE FORMING APPARATUS

(71) Applicant: Mitsubishi Chemical Corporation, Chiyoda-ku (JP)

(72) Inventor: Yuka Nagao, Tokyo (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 16/554,741

(22) Filed: Aug. 29, 2019

(65) Prior Publication Data

US 2019/0384189 A1 Dec. 19, 2019

Related U.S. Application Data

(63) Continuation of application No. PCT/JP2018/007367, filed on Feb. 27, 2018.

(30) Foreign Application Priority Data

Mar. 1, 2017 (JP) ..... JP2017-038367

(51) Int. Cl.
*G03G 5/05* (2006.01)
*G03G 5/047* (2006.01)
(Continued)

(52) U.S. Cl.
CPC ..... *G03G 5/047* (2013.01); *G03G 5/0571* (2013.01); *G03G 5/06147* (2020.05);
(Continued)

(58) Field of Classification Search
CPC ..... G03G 5/14704; G03G 5/14765; G03G 5/0614; G03G 5/0609; G03G 5/0659; G03G 5/06144; G03G 5/061446; G03G 5/06145
See application file for complete search history.

(56) References Cited

U.S. PATENT DOCUMENTS 5,153,088 A 10/1992 Muto et al.
7,217,482 B2 * 5/2007 Kim ..... G03G 5/14708 430/66
(Continued)

FOREIGN PATENT DOCUMENTS

JP 61-077054 A 4/1986
JP 61-188543 A 8/1986
(Continued)

OTHER PUBLICATIONS

English language machine translation of JP 2014-163984. (Year: 2014).*
(Continued)

*Primary Examiner* — Peter L Vajda
(74) *Attorney, Agent, or Firm* — Oblon, McClelland, Maier & Neustadt, L.L.P.

(57) ABSTRACT

The object of the present invention is to provide a positive charging electrophotographic photoreceptor having high sensitivity, low residual potential, and excellent chargeability, and relates to a positive charging electrophotographic photoreceptor including a conductive support, a photosensitive layer, and a protective layer in this order, the photosensitive layer containing a charge generation substance, a positive hole transport substance, and an electron transport substance in the same layer, in which the positive hole transport substance includes at least one of the compounds
(Continued)

represented by any one of the following formulas (1) to (5), and a binder resin of the protective layer is an alcohol-soluble thermoplastic resin, providing that the symbols in the formula are defined in the specification.

(1)

(2)

(3)

(4)

(5)

10 Claims, 1 Drawing Sheet

(51) Int. Cl.
*G03G 5/147* (2006.01)
*G03G 5/06* (2006.01)

(52) U.S. Cl.
CPC ... *G03G 5/06149* (2020.05); *G03G 5/061443* (2020.05); *G03G 5/061446* (2020.05); *G03G 5/061473* (2020.05); *G03G 5/14704* (2013.01); *G03G 5/14747* (2013.01); *G03G 5/14765* (2013.01)

(56) References Cited

U.S. PATENT DOCUMENTS

| | | | | |
|---|---|---|---|---|
| 2003/0211413 | A1* | 11/2003 | Lin | G03G 5/04 430/78 |
| 2005/0112486 | A1 | 5/2005 | Kim et al. | |
| 2006/0183044 | A1* | 8/2006 | Kim | G03G 5/0651 430/78 |
| 2006/0188803 | A1* | 8/2006 | Yabuki | G03G 5/08 430/118.7 |
| 2007/0009819 | A1 | 1/2007 | Sekine et al. | |
| 2008/0305418 | A1* | 12/2008 | Hamasaki | G03G 5/0677 430/78 |
| 2012/0052424 | A1* | 3/2012 | Asano | G03G 5/0525 430/56 |
| 2013/0052574 | A1 | 2/2013 | Fujii | |
| 2013/0288169 | A1 | 10/2013 | Yamano et al. | |
| 2014/0212803 | A1 | 7/2014 | Iwashita et al. | |
| 2015/0050589 | A1 | 2/2015 | Fujii et al. | |
| 2018/0004101 | A1 | 1/2018 | Wada et al. | |

FOREIGN PATENT DOCUMENTS

| | | | | |
|---|---|---|---|---|
| JP | 63-271463 | A | | 11/1988 |
| JP | 02-228670 | A | | 9/1990 |
| JP | 2002-221809 | A | | 8/2002 |
| JP | 2002-287397 | A | | 10/2002 |
| JP | 2005-157371 | A | | 6/2005 |
| JP | 2010-286707 | A | | 12/2010 |
| JP | 2011-242574 | A | | 12/2011 |
| JP | 2013-064992 | A | | 4/2013 |
| JP | 2013-231867 | A | | 11/2013 |
| JP | 2013246364 | A | * | 12/2013 |
| JP | 2014-146005 | A | | 8/2014 |
| JP | 2014-163984 | A | | 9/2014 |
| JP | 2014163984 | A | * | 9/2014 |
| JP | 2015-062056 | A | | 4/2015 |
| JP | 2015-143776 | A | | 8/2015 |
| JP | 6256055 | B2 | * | 1/2018 |
| WO | WO 2005/003093 | A1 | | 1/2005 |
| WO | WO 2016/148035 | A1 | | 9/2016 |

OTHER PUBLICATIONS

English language machine translation of JP 2013-246364. (Year: 2013).*

English language machine translation of JP 2015-143776. (Year: 2015).*

International Search Report dated May 1, 2018 in PCT/JP2018/007367 filed Feb. 27, 2018 (with English Translation).

Written Opinion dated May 1, 2018 in PCT/JP2018/007367 filed Feb. 27, 2018.

Office Action dated Jan. 25, 2022 in the corresponding Japanese patent application No. 2019-503038 (with English translation).

* cited by examiner

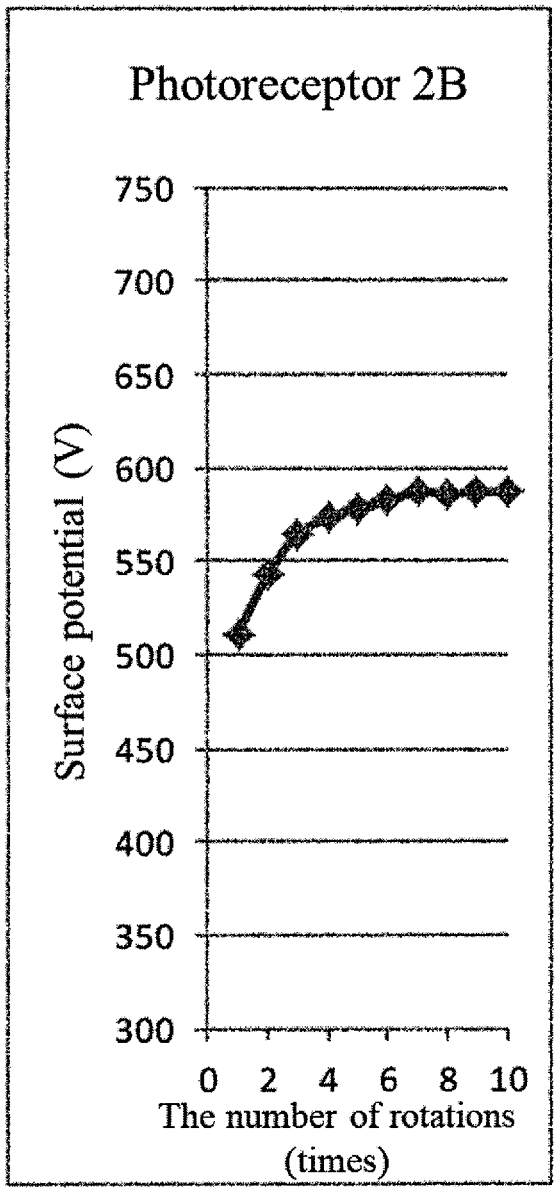
Photoreceptor 2B
750
700
650
600
550
500
450
400
350
300
Surface potential (V)
0 2 4 6 8 10
The number of rotations
(times)
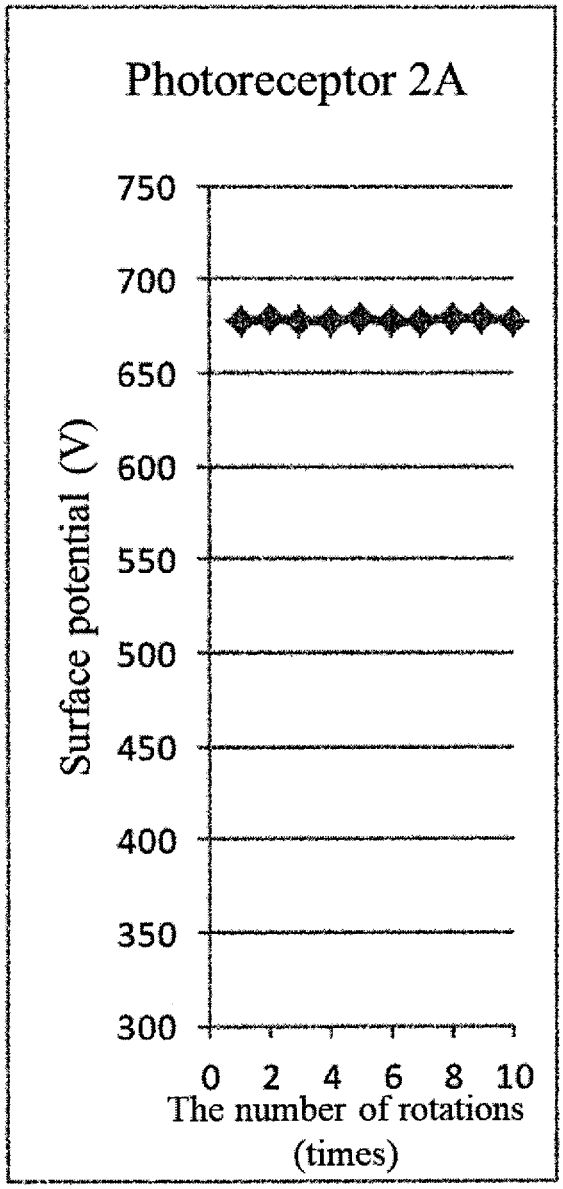
Photoreceptor 2A
750
700
650
600
550
500
450
400
350
300
Surface potential (V)
0 2 4 6 8 10
The number of rotations
(times)

POSITIVE CHARGING ELECTROPHOTOGRAPHIC PHOTORECEPTOR, ELECTROPHOTOGRAPHIC CARTRIDGE AND IMAGE FORMING APPARATUS

TECHNICAL FIELD

The present invention relates to a positive charging electrophotographic photoreceptor, an electrophotographic cartridge and an image forming apparatus, which are used for a copying machine or a printer. In detail, the present invention relates to a positive charging electrophotographic photoreceptor having good electrical properties and excellent durability, an electrophotographic cartridge and an image forming apparatus which include the electrophotographic photoreceptor.

BACKGROUND ART

Electrophotographic technology is widely used in the field of a copying machine and various printers since high-quality images with immediacy can be obtained. Regarding electrophotographic photoreceptors (hereinafter, simply referred to as "photoreceptor"), which are the core of the electrophotographic technology, photoreceptors employing an organic photoconductive substance having advantages such as non-pollution, ease of film formation, and ease of production has been used.

In the electrophotographic photoreceptors, a function separation type photoreceptor, in which functions of generation and transfer of charges are shared by different compounds, have become the mainstream of development because of a large choice of materials and easy control of properties of the photoreceptors. From the viewpoint of configurations of a photosensitive layer, an electrophotographic photoreceptor (hereinafter, referred to as a single-layer type photoreceptor) in which a photosensitive layer includes a layer containing a charge generation substance and a charge transport substance in the same layer, and an electrophotographic photoreceptor (hereinafter, referred to as a lamination-type photoreceptor) obtained by separating a charge generation substance and a charge transport substance into different layers (charge generation layer and charge transport layer) and laminating the charge generation layer and the charge transport layer have been known.

Among them, most of the current photoreceptors belong to the type of the lamination-type photoreceptor since the function for each layer is easily optimized and the properties are easily controlled in terms of photoreceptor design. Most of the lamination-type photoreceptors include at least a charge generation layer and a charge transport layer on a substrate in this order, and a negative charging manner is adopted for charging. The charge transport substance according to the present invention may also be used for a lamination-type negative charging photoreceptor (Patent Literatures 1 and 2). In a case where the photoreceptor is charged by negative corona discharge in the negative charging manner, ozone generation may adversely affect environment and the photoreceptor properties.

In contrast, either negative or positive charging manner can be used in the single-layer type photoreceptor. Accordingly, by using the positive charging manner, the generation of ozone, which is a problem in the above-mentioned lamination-type photoreceptor, can be inhibited to a low level, and the single-layer type photoreceptor is partially put into practical use. Another advantage is that the number of coating steps is small and interference fringes caused by semiconductor laser light are less likely to occur. Further, in addition to the advantages described above, there can be mentioned another advantage that diffusion of the incident light in the photosensitive layer can be almost ignored and the charge transfer distance when the surface charges after charging are neutralized is shorter than that of the lamination-type photoreceptor since the single-layer type photoreceptor absorbs most of incident light in the vicinity of the surface of the photosensitive layer and generates charges. Therefore, image blurring due to light diffusion and charge diffusion hardly occurs, high resolution can be expected, and the degree of charge diffusion and incident light diffusion does not change much even in a case where the film thickness of the photosensitive layer is increased. The resolution does not decrease too much (see, for example, Patent Literatures 3 to 6).

On the other hand, since substances having various functions are collectively contained in a layer in the single-layer type photoreceptor, the single-layer type photoreceptor is inferior to the negative charging lamination-type photoreceptor in many aspects, from the viewpoint of the photosensitivity of the photoreceptor and the charge (residual potential) left on the photoreceptor causing the image defect. The electrical properties shown by the sensitivity and the residual potential are characterized in that the kind of materials, of course, greatly changes depending on the combination of materials in the layer because of a single layer, and the influence of the charge transport substance is also large. Among them, it is known that an aryl amine charge transport substance having a specific structure, which is also used in a lamination-type photoreceptor, exhibits high sensitivity and low residual potential even in a single layer type (see, for example, Patent Literatures 7 and 8).

It is known that an electrophotographic photoreceptor which has high sensitivity and prevents point defects in an image (see, for example, Patent Literature 9) can be obtained by adopting a specific charge generation material, a positive hole transport material, and an electron transport material as a positive charging organic photoreceptor (single-layer type photoreceptor), and an electrophotographic photoreceptor having improved adhesion of a protective layer to a photosensitive layer and improved electrostatic properties and productivity (see, for example, Patent Literature 10) can be obtained by dropwise adding a chelating compound to the protective layer in which a polyamide resin is used as a binder.

CITATION LIST

Patent Literature

Patent Literature 1: JP-A-2013-64992
Patent Literature 2: JP-A-2015-62056
Patent Literature 3: JP-A-S61-77054
Patent Literature 4: JP-A-S61-188543
Patent Literature 5: JP-A-H2-228670
Patent Literature 6: JP-A-S63-271463
Patent Literature 7: JP-A-2014-146005
Patent Literature 8: JP-A-2010-286707
Patent Literature 9: JP-A-2013-231867
Patent Literature 10: JP-A-2005-157371

SUMMARY OF INVENTION

Technical Problem

The inventors of the present invention have found that sensitivity of a positive charging electrophotographic photoreceptor can be improved and residual potential thereof can be reduced when an aryl amine compound having a specific structure (compound group represented by any one of formulas (1) to (5) described below) is introduced as a positive hole transport substance. On the other hand, it has been found that, due to the influence of the ionization potential of these compounds, positive charges are likely to be injected into the photoreceptor, and the charging properties of placing the charge on the photoreceptor surface are deteriorated. Therefore, the charging is insufficient and the image is thin or not obtained in the initial stage of the process of charging-exposure-development-charge elimination.

That is, the inventor of the present invention has newly found that when a compound represented by any one of the formulas (1) to (5) is used as a positive hole transport substance in a positive charging electrophotographic photoreceptor, positive charges are likely to be injected into the photoreceptor after charging and the chargeability at the first rotation of the process is inferior.

The present invention has been made in view of the above problems. That is, an object of the present invention is to provide a positive charging electrophotographic photoreceptor having high sensitivity, low residual potential, and excellent chargeability, and to provide an electrophotographic cartridge (process cartridge) using the electrophotographic photoreceptor, and an image forming apparatus using the electrophotographic photoreceptor.

Among these, regarding the charging properties, the object of the present invention is to provide a positive charging electrophotographic photoreceptor excellent in charging properties in which the difference between the potential at the first rotation of the process and the potential at the tenth rotation of the process is small.

Solution to Problem

The inventors of the present invention has conducted intensive studies for satisfying the above objects, and as a result, it is found that by providing a protective layer containing a specific resin on a photosensitive layer containing a specific positive hole transport substance, a high-speed and high-resolution photoreceptor can be obtained, which cannot cause image deterioration when the photoreceptor is used repeatedly, and has excellent chargeability from the first rotation (first time) of the process. The present invention has been completed.

The gist of the present invention lies in the following [1] to [9].

[1] A positive charging electrophotographic photoreceptor, comprising: a conductive support; a photosensitive layer; and a protective layer in this order, the photosensitive layer containing a charge generation substance, a positive hole transport substance, and an electron transport substance in the same layer, wherein the positive hole transport substance includes at least one of the compounds represented by any one of the following formulas (1) to (5), and a binder resin of the protective layer is an alcohol-soluble thermoplastic resin, (1)

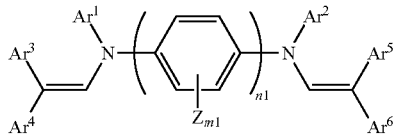

(in the formula (1), $Ar^1$ to $Ar^6$ each independently represent an aryl group which may have a substituent; n1 represents an integer of 2 or greater; Z represents a monovalent organic residue; and m1 represents an integer of 0 to 4, here, at least one of $Ar^1$ and $Ar^2$ represents an aryl group having a substituent)

(2)

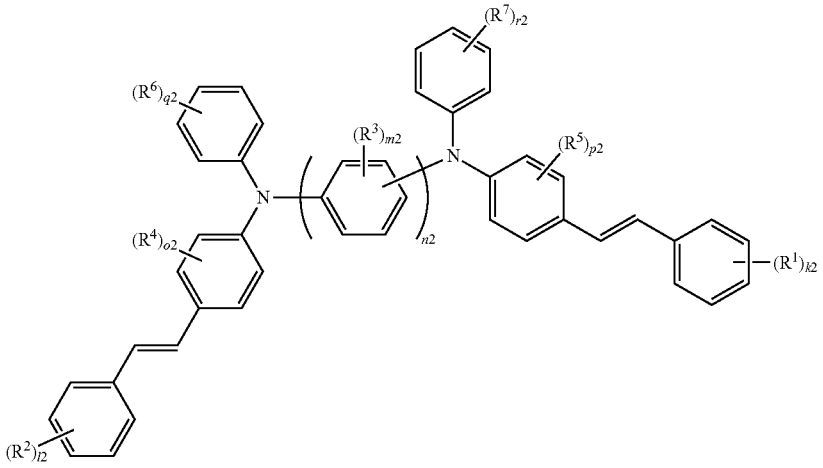

(in the formula (2), $R^1$ to $R^7$ each independently represent a hydrogen atom, an alkyl group, an aryl group; and an alkoxy group; n2 represents an integer of 1 to 5; k2, l2, q2, and r2 each independently represent an integer of 1 to 5; and m2, o2 and p2 each independently represent an integer of 1 to 4)

(3)

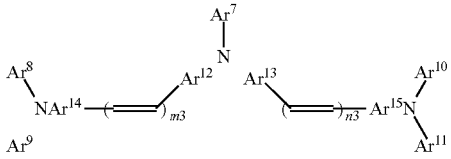

(in the formula (3), $Ar^7$ to $Ar^{11}$ each independently represent an aryl group which may have a substituent; and $Ar^{12}$ to $Ar^{15}$ each independently represent an arylene group which may have a substituent; m3 and n3 each independently represent an integer of 1 to 3)

(4)

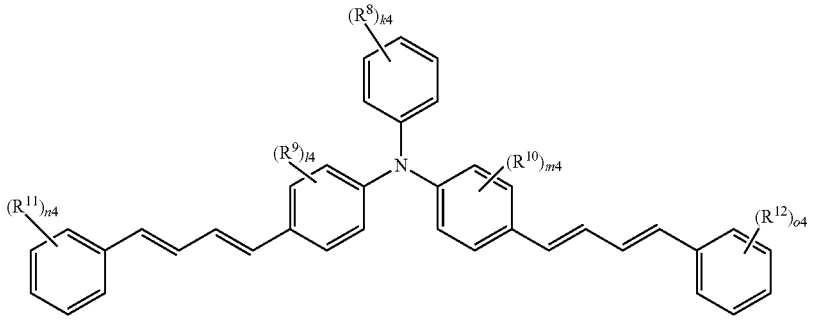

(in the formula (4), $R^8$ to $R^{12}$ each independently represent a hydrogen atom, an alkyl group, an aryl group, and an alkoxy group; k4, n4, and o4 each independently represent an integer of 1 to 5; and l4 and m4 each independently represent an integer of 1 to 4)

(5)

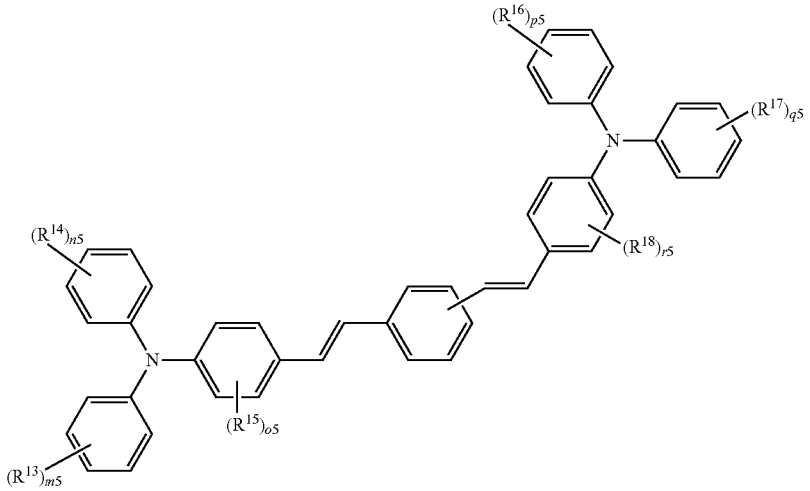

(in the formula (5), $R^{13}$ to $R^{18}$ each independently represent an alkyl group and an alkoxy group; m5, n5, p5 and q5 each independently represent an integer of 0 to 5; and o5 and r5 each independently represent an integer of 0 to 4; in a case where m5, n5, o5, p5, q5 and r5 are integers of 2 or greater respectively, each of a plurality of $R^{13}$ to $R^{18}$ is bonded to the adjacent one of the plurality of $R^{13}$ to $R^{18}$ to form a ring structure).

[2] The positive charging electrophotographic photoreceptor according to item [1], wherein with respect to a ratio of a total content of the compounds represented by any one of the above formulas (1) to (5) to a content of the electron transport substances, the total content is 40 parts by weight or less relative to 1 part by weight of the electron transport substance.

[3] The positive charging electrophotographic photoreceptor according to item [1] or [2], wherein with respect to a ratio of a total content of the compounds represented by any one of the above formulas (1) to (5) to a content of the electron transport substances, the total content is 0.5 part by weight or more relative to 1 part by weight of the electron transport l0 substance.

[4] The positive charging electrophotographic photoreceptor according to any one of items [1] to [3], wherein the protective layer contains particles of metal oxide.

[5] The positive charging electrophotographic photoreceptor according to item [4], wherein the particles of metal oxide are surface-treated with an organometallic compound.

[6] The positive charging electrophotographic photoreceptor according to any one of items [1] to [5], wherein the binder resin of the protective layer contains a polyamide resin.

[7] The positive charging electrophotographic photoreceptor according to item [6], wherein the polyamide resin contains a structure represented by the following formula (7),

FORMULA (7)

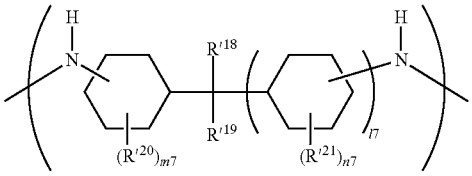

(in the formula (7), $R'^{18}$ to $R'^{21}$ each independently represent a hydrogen atom and an organic substituent; 17 represents an integer of 0 to 2; m7 and n7 each independently represent an integer of 0 to 4; and in a case where m7 and n7 are integers of 2 or greater, a plurality of $R'^{20}$ and $R'^{21}$ may be different from each other).

[8] An electrophotographic cartridge comprising the positive charging electrophotographic photoreceptor according to any one of items [1] to [7].

[9] An image forming apparatus comprising the positive charging electrophotographic photoreceptor according to any one of items [1] to [7].

Advantageous Effects of Invention

The present invention can provide a positive charging electrophotographic photoreceptor having high sensitivity, low residual potential, and excellent chargeability, by which high-quality image formation can be performed at high speed, and an electrophotographic cartridge and an image forming apparatus which include the positive charging electrophotographic photoreceptor.

BRIEF DESCRIPTION OF DRAWINGS

FIG. 1 is a graph showing a relationship between number of processes (number of rotations) and a charge amount of surfaces (surface potential) of a photoreceptor 2A in Example 2 and a photoreceptor 2B in Comparative Example 2.

DESCRIPTION OF EMBODIMENTS

Hereinafter, embodiments for implementing the present invention (hereinafter, embodiments of the invention) will be described in details. The present invention is not limited to the following embodiments, and various modifications can be made within the scope of the gist thereof. Further, definitions of "% by mass" and "% by weight" are the same, and definitions of "part by mass" and "part by weight" are the same.

<Positive Charging Electrophotographic Photoreceptor>

A positive charging electrophotographic photoreceptor according to the present invention (hereinafter, may be referred to as electrophotographic photoreceptor or photoreceptor) includes a conductive support, a photosensitive layer and a protective layer in this order, in which the photosensitive layer is a single-layer type photosensitive layer which contains a charge generation substance and a charge transport substance in the same layer, and a binder resin of the protective layer provided on the photosensitive layer is an alcohol-soluble thermoplastic resin. In addition, the charge transport substance contains a positive hole transport substance and an electron transport substance, and the positive hole transport substance contains at least one of the compounds represented by any one of formulas (1) to (5).

According to the present invention, by providing a predetermined protective layer on a specific photosensitive layer, a photoreceptor having excellent chargeability can be obtained, by which high-performance image formation with fast printing can be performed.

The compound represented by any one of the formulas (1) to (5) has low ionization potential and high-mobility charge transport ability, so that a high-performance photoreceptor which has low residual potential and can correspond to high-speed machines can be obtained. On the other hand, the ionization potential is low, and thus positive charges placed on the surface are injected into a layer and tends to be attenuated due to dark current, sufficient charging cannot be obtained at the beginning of the process in many cases, and the charged potential at the first rotation of the process tends to be inferior to the charged potential at the tenth rotation of the process.

The present inventor has found that injection or dark attenuation of the positive charges can be prevented when a specific protective layer is provided on the photosensitive layer. It can be estimated that a good interface is formed by interaction between the photosensitive layer and the protective layer when the protective layer is a specific thermoplastic resin, and thus the injection of the positive charges into the photosensitive layer can be prevented without impairing charge generation and negative charge transfer.

Hereinafter, parts constituting the electrophotographic photoreceptor (conductive support, undercoat layer, photosensitive layer, protective layer) according to the present invention will be described.

<Conductive Support>

First, a conductive support used for the photoreceptor according to the present invention will be described.

The conductive support is not particularly limited as long as the conductive support supports the photosensitive layer and the protective layer described below and shows conductivity.

As the conductive support, a metallic material such as aluminum, an aluminum alloy, stainless steel, copper, and nickel, a resinous material to which conductivity is imparted by coexistence of a conductive powder, such as a metal, carbon and tin oxide, or a resin, glass, paper, or the like having a surface on which a conductive material, e.g., aluminum, nickel, or ITO (alloy of indium oxide and tin oxide) has been vapor deposited or coated are mainly used.

Examples of the shape of the conductive support include a drum-shape, sheet-shape, belt-shape, or the like. A metallic conductive support having a surface coated with a conductive material having a suitable resistance may be used in order to control the conductivity and surface properties thereof, and to coat defects.

In a case where a metallic material such as an aluminum alloy is used as a conductive support, this material may be used after an anodized coating film is applied to the metallic material.

For example, the metallic material is anodized in an acidic bath of chromic acid, sulfuric acid, oxalic acid, boric acid, sulfamic acid, or the like, whereby forming an anodized film on the surface of the metallic material. Particularly, anodizing in sulfuric acid gives better results. In the case of anodizing in sulfuric acid, it is preferable that the concentration of sulfuric acid is generally set in a range of 100 g/l to 300 g/l, the concentration of dissolved aluminum is generally set in a range of 2 g/l to 15 g/l, liquid temperature is generally set in a range of 15° C. to 30° C., electrolytic voltage is generally set in a range of 10 V to 20 V, and current density is generally 0.5 A/dm2 to 2 A/dm2. However, the anodizing conditions are not limited to the above conditions.

In a case where the anodized coating film is applied to the metallic material, the material is preferably subjected to a pore-sealing treatment. The pore-sealing treatment can be performed by a known method. For example, it is preferable to perform a low-temperature pore-sealing treatment in which the metallic material is immersed in an aqueous solution containing nickel fluoride as a main component, or a high-temperature pore-sealing treatment in which the metallic material is immersed in an aqueous solution containing nickel acetate as a main component.

The concentration of the nickel fluoride aqueous solution used in the case of the above low-temperature pore-sealing treatment can be appropriately selected. Alternatively, more preferable results are obtained in the case where the concentration of the aqueous solution is in a range of 3 g/l to 6 g/1. In addition, the treatment temperature for smoothly advancing the sealing treatment is generally 25° C. or higher, and preferably 30° C. or higher. In addition, the treatment temperature is generally 40° C. or lower, and preferably 35° C. or lower. In addition, the pH of the nickel fluoride aqueous solution is generally 4.5 or greater, and preferably 5.5 or greater, and the pH is generally 6.5 or less, and preferably 6.0 or less.

As a pH adjuster, oxalic acid, boric acid, formic acid, acetic acid, sodium hydroxide, sodium acetate, ammonia water, or the like can be used.

It is preferable that the coating film is treated for generally one minute to three minutes per 1 μm which is the film thickness of the coating film. In order to further improve the physical properties of the coating film, cobalt fluoride, cobalt acetate, nickel sulfate, a surfactant or the like may be allowed to coexist in the nickel fluoride aqueous solution. Next, the anodized coating film is washed and dried, and the low-temperature pore-sealing treatment is finished.

In addition, as a sealant in the case of the above high-temperature pore-sealing treatment, an aqueous solution of a metal salt such as nickel acetate, cobalt acetate, lead acetate, nickel acetate-cobalt, barium nitrate or the like can be used. Alternatively, nickel acetate is preferably used as the sealant. The concentration of a nickel acetate aqueous solution in use is preferably 5 g/l to 20 g/l. The treatment temperature at this time is generally 80° C. or higher, and preferably 90° C. or higher. In addition, the treatment temperature is generally 100° C. or lower, and preferably 98° C. or lower. Further, it is preferable that treatment is performed under a condition that pH of the nickel acetate aqueous solution is 5.0 to 6.0.

As a pH adjuster, ammonia water, sodium acetate, or the like can be used. The treatment time is generally 10 minutes or more, preferably 15 minutes or more. In order to improve the physical properties of the coating film, sodium acetate, organic carboxylic acid, anionic or nonionic surfactant, or the like may also be contained in the nickel acetate aqueous solution in this case. Further, the coating film may be treated with high temperature water or high temperature steam substantially free of salts. Next, the anodized coating film is washed and dried, and the high-temperature pore-sealing treatment is finished.

In a case where the average film thickness of the anodized coating film is large, it is preferable to set strong pore-sealing conditions by increasing the concentration of the sealing solution and performing the treatment at high temperature for long time. However, in the case of the strong pore-sealing conditions, productivity may decrease, and surface defects such as stains, dirt, and dusting may be generated on the surface of the coating film. Therefore, the average film thickness of the anodized film is generally 20 μm or less, and particularly preferably 7 μm or less.

The surface of the conductive support may be smooth, or may be roughened by applying a special cutting method or a polishing treatment. The surface may also be roughened by mixing particles having an appropriate particle diameter with a material constituting the conductive support.

In order to improve the adhesiveness, the blocking property, or the like, an undercoat layer described below may be provided between the conductive support and the photosensitive layer.

<Photosensitive Layer>

Next, the photosensitive layer used for the electrophotographic photoreceptor according to the present invention will be described.

[Materials]

First, materials used for the photosensitive layer will be described. The photosensitive layer used in the present invention is preferably formed by a single layer containing a charge transport substance and a charge generation substance, and may be obtained by stacking a plurality of layers having different components or composition ratios. Even in the latter case, the photosensitive layer is referred to as a single-layer type photosensitive layer because of a function of the material in the photosensitive layer. At this time, the charge transport substance and the charge generation substance may be contained in the same layer in one or more of the layers constituting the photosensitive layer. In addition, the charge transport substance contains a positive hole transport substance and an electron transport substance, and is used as a generic term of these substances.

Hereinafter, the materials used for the photosensitive layer (charge generation substance, charge transport substance, binder resin, and the like) will be described.

<Charge Generation Substance>

As the charge generation substance used for the photosensitive layer, selenium and alloys thereof, cadmium sulfide, and other inorganic photoconductive materials; organic pigments such as phthalocyanine pigments, azo pigments, quinacridone pigments, indigo pigments, perylene pigments, polycyclic quinone pigments, anthanthrone pigments, and benzimidazole pigments; and various photoconductive materials can be used. Among them, organic pigments are particularly preferred, and further, phthalocyanine pigments and azo pigments are more preferred.

In a case where a phthalocyanine pigment is used as the charge generation substance, specific examples thereof include metal-free phthalocyanine, and phthalocyanines which are coordinated with metal such as copper, indium, gallium, tin, titanium, zinc, vanadium, silicon, germanium, or oxides and halides of metal. Examples of the ligand to the trivalent or higher metal atom include a hydroxyl group and an alkoxy group in addition to an oxygen atom and a chlorine atom shown above.

Among them, particularly preferred are X-form and r-form metal-free phthalocyanines having high sensitivity, A-form, B-form and D-form of titanyl phthalocyanines, vanadyl phthalocyanine, chloroindium phthalocyanine, chlorogallium phthalocyanine and hydroxygallium phthalocyanine.

Among the crystal forms of titanyl phthalocyanines mentioned here, the A-form and B-form are respectively shown as I phase and II phase according to W. Heller (Zeit. Kristallogr. 159 (1982) 173), and A-form is known as a stable form. D-form is a crystal form characterized in that the crystal shows a clear peak when the diffraction angle 2θ±0.2° is 27.3° in powder X-ray diffraction using CuKα rays.
In addition, in a case where an azo pigment is used, various known bisazo pigments and trisazo pigments are appropriately used. Examples of preferred azo pigments are shown below.
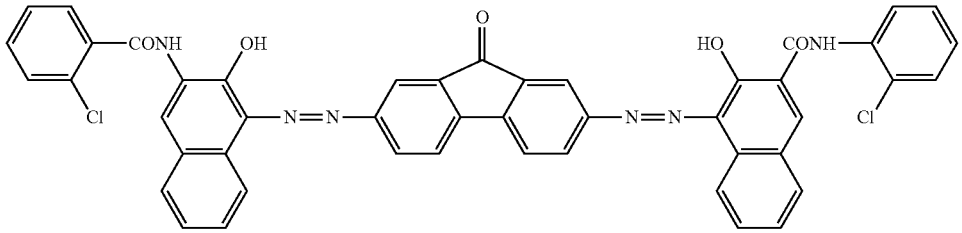
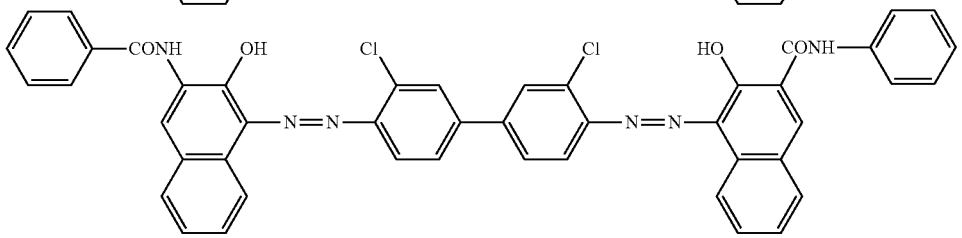
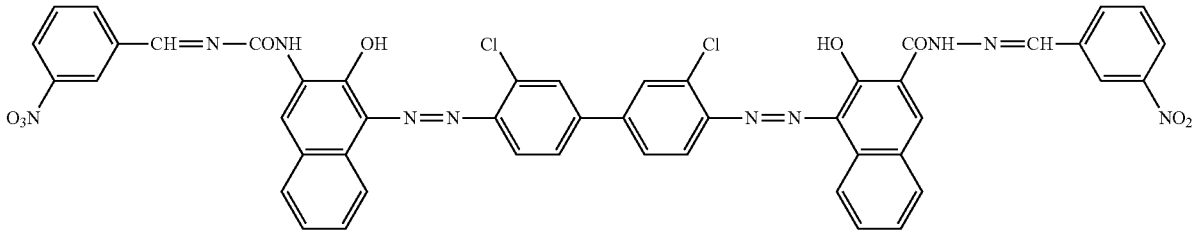
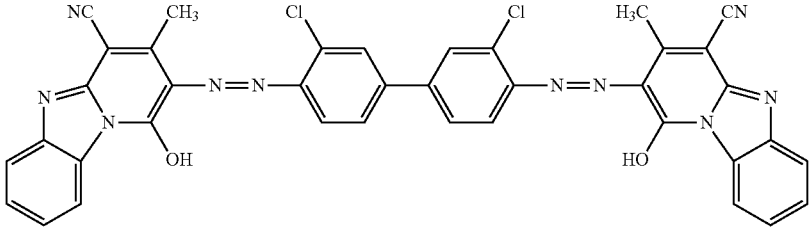
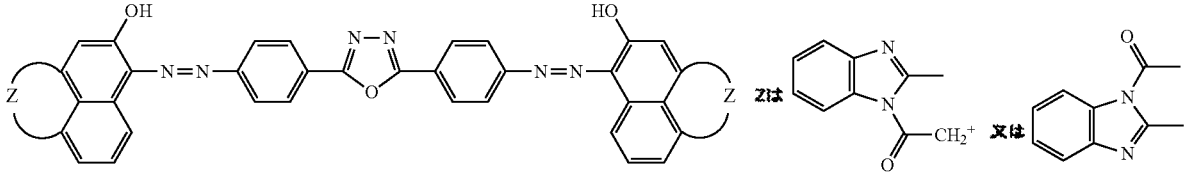
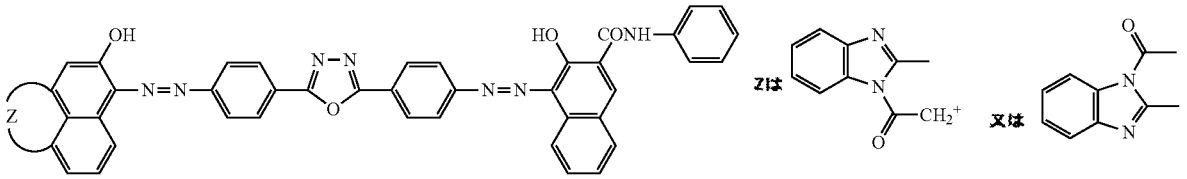
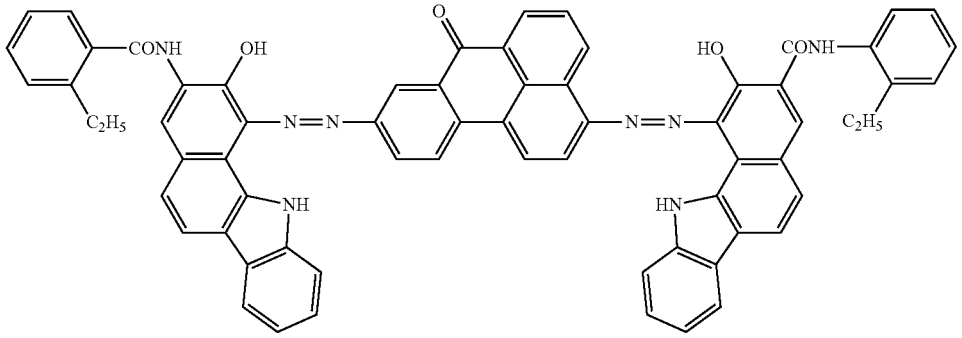

-continued
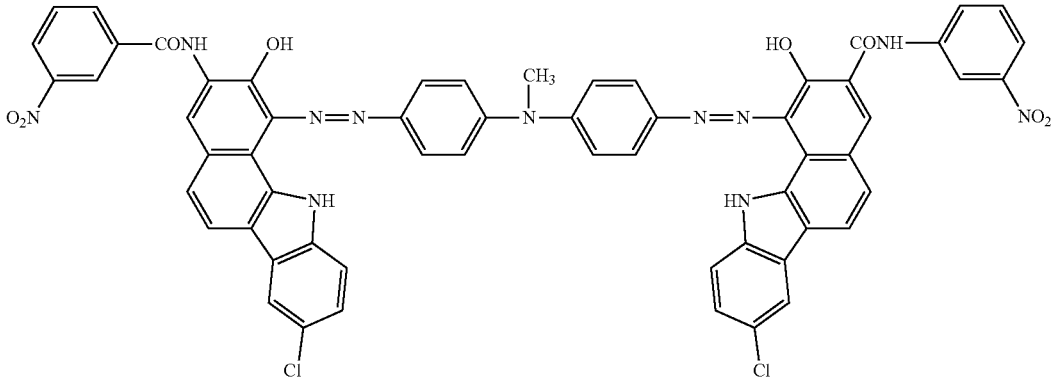
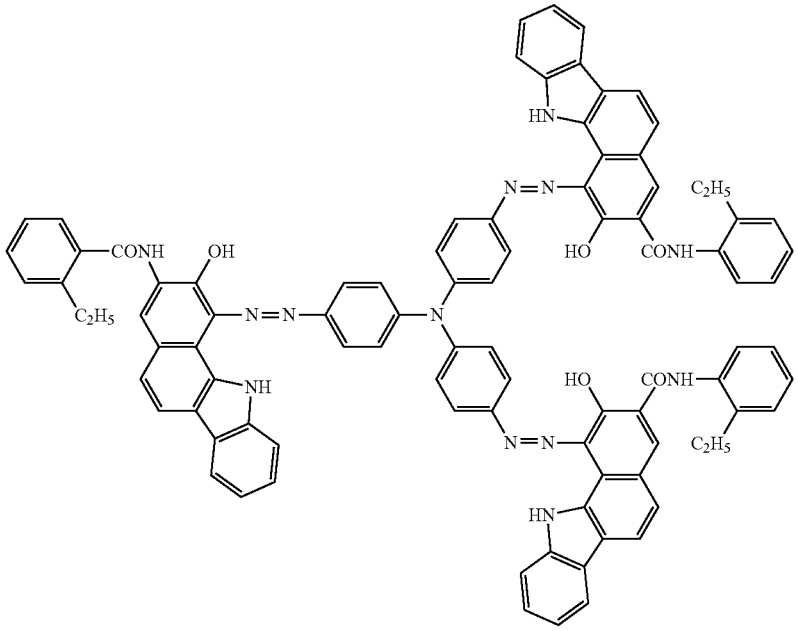
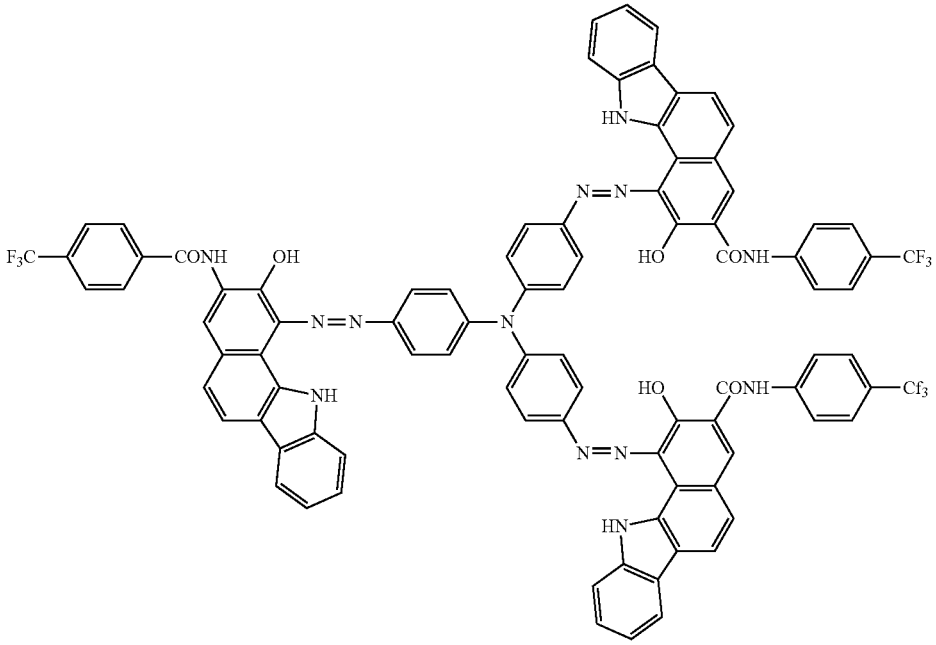

-continued

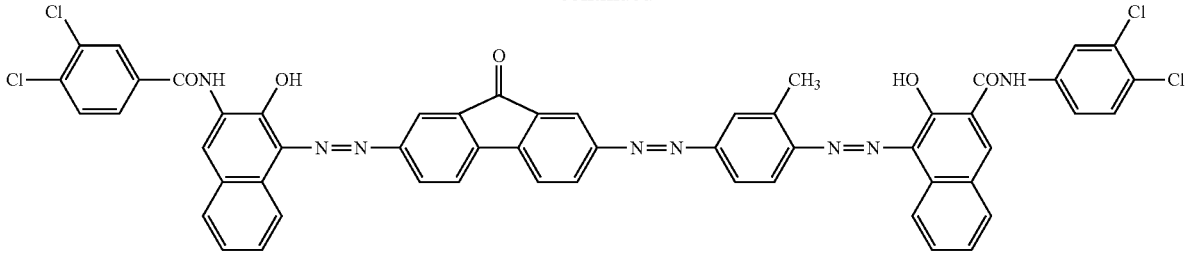

One selected from the charge generation substances may be used alone, or two or more selected from the charge generation substances may be used in any desired combination and in any desired proportion. Further, in a case where two or more charge generation substances are used in combination, a mixed state of the charge generation substances used in combination or a mixed state of crystal states of the charge generation substances may be obtained by mixing the components prepared beforehand, or may be generated during production/treatment steps of the charge generation substances such as synthesis, pigment formation, and crystallization. Such treatments as known include an acid paste treatment, a grinding treatment, a solvent treatment, and the like.

It is desired that the particle diameter of the charge generation substance in this case is sufficiently small. Specifically, the particle diameter is preferably 1 μm or less, and more preferably 0.5 μm or less.

Further, when the amount of the charge generation substance dispersed in the photosensitive layer is too small, sufficient sensitivity may not be obtained, and when the amount is too large, the chargeability and the sensitivity may be reduced. Therefore, the amount of the charge generation substance in the photosensitive layer is preferably 0.1% by weight or more, and more preferably 0.5% by weight or more. In addition, the amount of the charge generation substance is preferably 50% by weight or less, and more preferably 20% by weight or less.

<Charge Transport Substance>

The photoreceptor according to the present invention contains a positive hole transport substance and an electron transport substance, and the positive hole transport substance contains at least one compound represented by any one of the formulas (1) to (5). The single-layer type photosensitive layer is obtained by dispersing the charge generation substance into a layer containing the charge transport substance and the binder resin, and the compound represented by any one of the formulas (1) to (5) is contained as a charge transport substance (positive hole transport substance) in the photosensitive layer.

First, the compound represented by the following formula (1) will be described.

FORMULA (1)

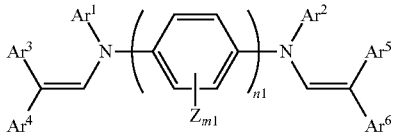

In the formula (1), $Ar^1$ to $Ar^6$ each independently represent an aryl group which may have a substituent. n1 represents an integer of 2 or greater. Z represents a monovalent organic residue, and m1 represents an integer of 0 to 4. Here, at least one of $Ar^1$ and $Ar^2$ represents an aryl group having a substituent.

In the formula (1), $Ar^1$ to $Ar^6$ represent aryl groups which may have a substituent, and the aryl groups may be identical or may be different. Among the aryl groups, an aryl group having 6 to 20 carbon atoms is preferred, and an aryl group having 6 to 12 carbon atoms is more preferred.

Specific examples of the aryl groups include a phenyl group, a naphthyl group, a fluorenyl group, an anthryl group, a phenanthryl group, a pyrenyl group, or the like, and preferably include a phenyl group, a naphthyl group, a fluorenyl group, or the like. From the viewpoint of production cost, aryl groups having 6 to 10 carbon atoms, such as the phenyl group and the naphthyl group, are particularly preferred.

Further, in the case of having a substituent, the substituent is preferably a substituent having 1 to 10 carbon atoms and having a substituent constant σp of 0.20 or less in Hammett rule. Here, Hammett rule is an empirical rule used to explain the effect of a substituent in an aromatic compound on the electronic state of an aromatic ring, and a substituent constant σp of substituted benzene refers to a value obtained by quantifying the degree of electron donating/withdrawing of a substituent. When the σp value is positive, the substituted compound is more acidic than the unsubstituted one, that is, the substituent becomes an electron withdrawing substituent. Conversely, when the σp value is negative, the substituent becomes an electron donating substituent. The σp value of a typical substituent is described in "Chemical Handbook Basic Edition II Revised 4 Edition" edited by the Chemical Society of Japan (Maruzen Co., Ltd., published on Sep. 30, 1993, p. 364 to 365).

Examples of a substituent having a substituent constant up of 0.20 or less in Hammett rule include an alkyl group having 1 to 10 carbon atoms, an alkoxy group having 1 to 10 carbon atoms, an alkylamino group having 2 to 10 carbon atoms, and an aryl group having 6 to 10 carbon atoms. Specific examples thereof include a methyl group, an ethyl group, a n-propyl group, an isopropyl group, a n-butyl group, an isobutyl group, a tert-butyl group, a methoxy group, an ethoxy group, a propoxy group, a butoxy group, a N, N-dimethyl amino group, a N, N-diethylamino group, a phenyl group, a 4-tolyl group, a 4-ethylphenyl group, a 4-propylphenyl group, a 4-butylphenyl group, a naphthyl group, or the like. Among the examples of the substituent, an alkyl group having 1 to 4 carbon atoms is preferred, and a methyl group and an ethyl group are particularly preferred, from the viewpoint of electrical properties.

In the above formula (1), n1 is generally an integer of 2 or greater form the viewpoint of improving the electrical properties of the electrophotographic photoreceptor according to the present invention, and there is no particular upper limit to n1 as long as the electrical properties are not adversely affected. Alternatively, n1 is preferably an integer of 5 or less, and more preferably an integer of 3 or less. Considering comprehensively from the viewpoint of the compatibility with the photosensitive layer and the production cost, n1 is preferably 2 or 3, and the case of n=2 is particularly preferred.

Examples of the monovalent organic residue Z in the above formula (1) include an alkyl group having 1 to 4 carbon atoms, an alkoxy group having 1 to 4 carbon atoms, an alkylamino group having 2 to 4 carbon atoms, and an aryl group having 6 to 10 carbon atoms. Specific examples thereof include a methyl group, an ethyl group, a n-propyl group, an isopropyl group, a n-butyl group, an isobutyl group, a tert-butyl group, a methoxy group, an ethoxy group, a propoxy group, a butoxy group, a N, N-dimethylamino group, a N, N-diethylamino group, a phenyl group, a 4-tolyl group, a 4-ethylphenyl group, a 4-propylphenyl group, a 4-butylphenyl group, a naphthyl group, or the like. Among the examples of the monovalent organic residue Z, an alkyl group having 1 to 4 carbon atoms is particularly preferred, from the viewpoint of the electrical properties.

In the above formula (1), m1 represents an integer of 0 to 4, and is preferably 0 or 1, and the case of m1=0 is particularly preferred in view of production cost.

The following exemplified compounds can be mentioned as a representative example of the compound represented by the above formula (1). Here, the compounds represented by the formula (1) in the present invention are not limited to these compounds. In addition, the charge transport substance may contain one kind of compound represented by the formula (1) as a single component, or may contain a mixture of a plurality of compounds represented by the formula (1), or may contain a mixture of compound(s) represented by the formula (1) and other positive hole transport substances (for example, compounds represented by any one of the formulas (2) to (5)).

(1)-1

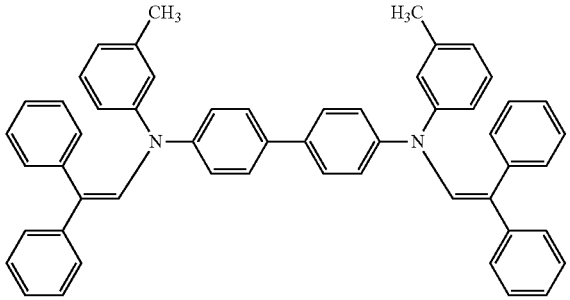

(1)-2

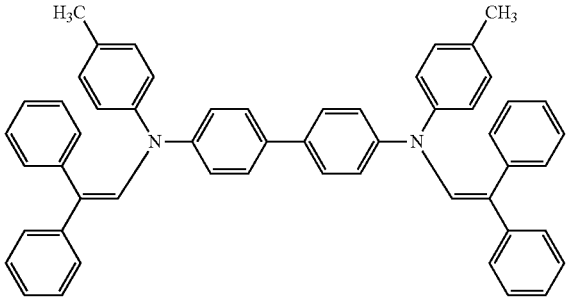

(1)-3

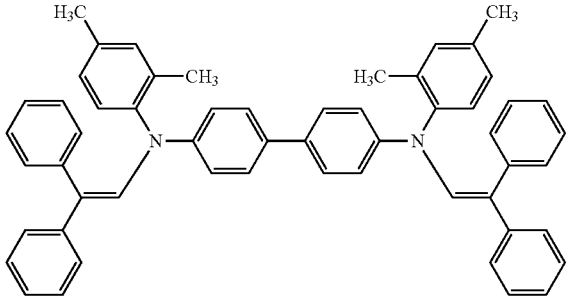

(1)-4

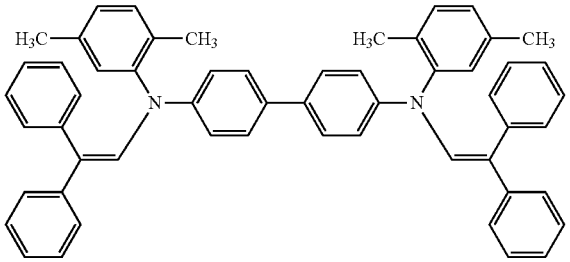

(1)-5

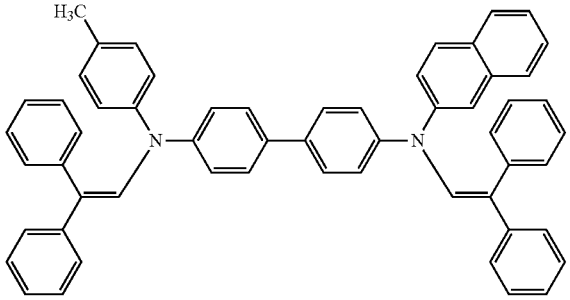

(1)-6

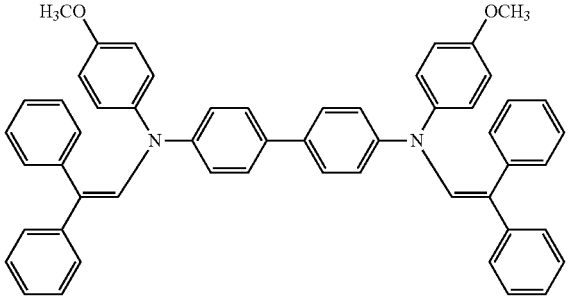

-continued
(1)-7
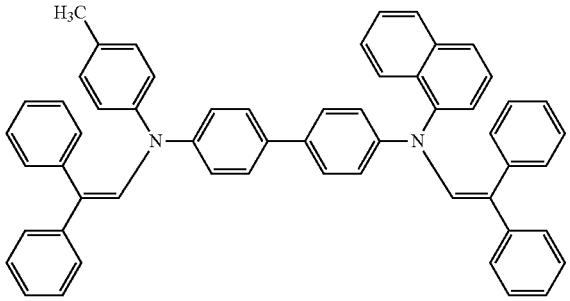
(1)-8
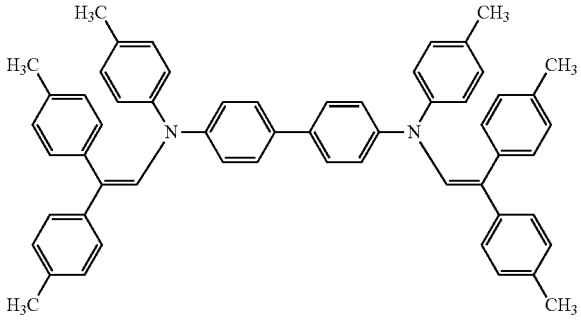
(1)-9
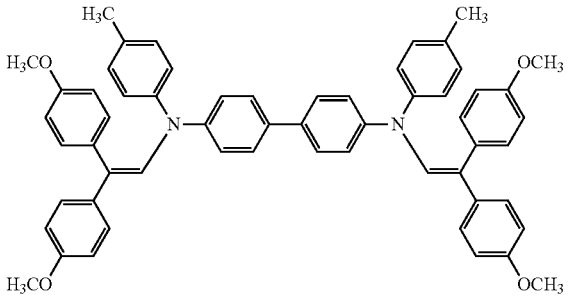
(1)-10
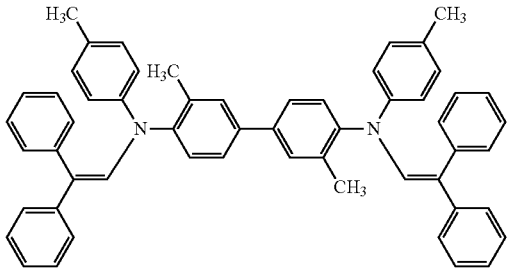
(1)-11
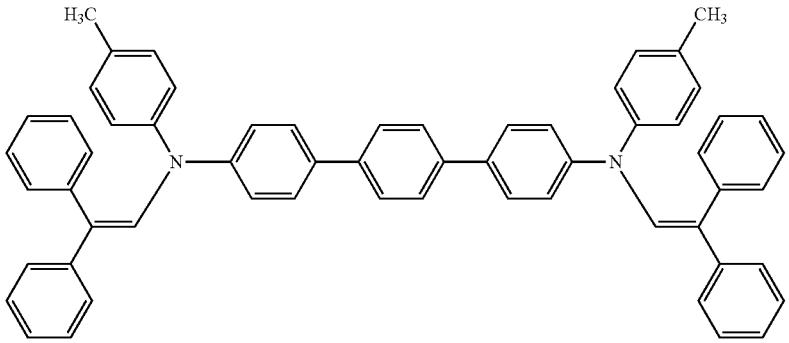
(1)-12
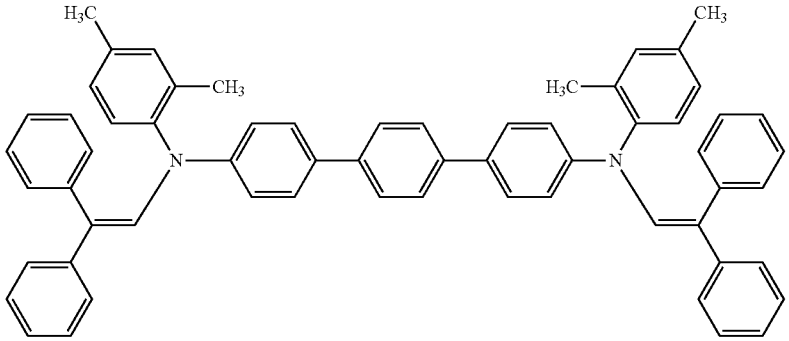

-continued (1)-13

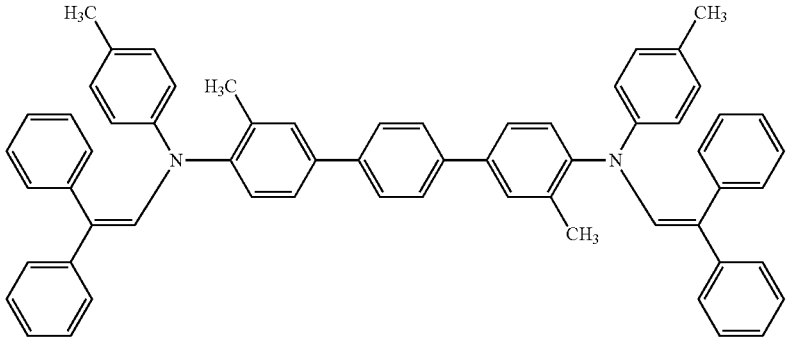

In the above exemplified compounds, (1)-2, (1)-3, (1)-11, and (1)-12 are preferred, (1)-2, (1)-3, and (1)-12 are more preferred, and (1)-2 and (1)-3 are still more preferred.

Next, the compound represented by the following formula (2) will be described.

FORMULA (2)

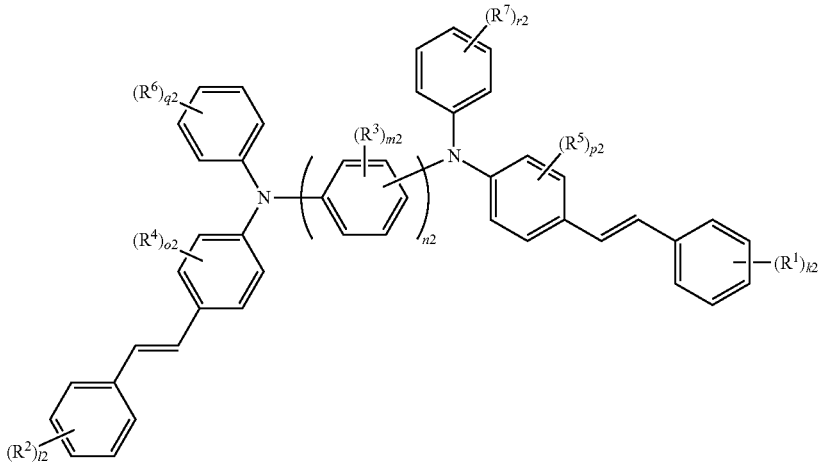

In the formula (2), $R^1$ to $R^7$ each independently represent a hydrogen atom, an alkyl group, an aryl group, and an alkoxy group. n2 represents an integer of 1 to 5, k2, l2, q2, and r2 each independently represent an integer of 1 to 5, and m2, o2 and p2 each independently represent an integer of 1 to 4.

In the above formula (2), $R^1$ and $R^2$ each independently represent a hydrogen atom, an alkyl group, an aryl group, and an alkoxy group. Alternatively, specific examples of the alkyl group include a linear alkyl group such as a methyl group, an ethyl group, a n-propyl group, and a n-butyl group, a branched alkyl group such as an isopropyl group and an ethylhexyl group, and a cyclic alkyl group such as a cyclohexyl group. Examples of the aryl group include a phenyl group and a naphthyl group which may have a substituent. Examples of the alkoxy group include a linear alkoxy group such as a methoxy group, an ethoxy group, a n-propoxy group and a n-butoxy group, a branched alkoxy group such as an isopropoxy group and an ethylhexyloxy group, and a cyclohexyloxy group.

Among these, a hydrogen atom, a methyl group, an ethyl group, a methoxy group, and an ethoxy group are preferred, from the viewpoint of the versatility of the production raw material and the charge transport ability of a charge transport substance. The bonding position of each substituent to the benzene ring may be generally any position of an ortho position, a meta position, and a para position relative to the styryl group. Alternatively, any one of the ortho position and the para position is preferred, from the viewpoint of ease of production.

In the above formula (2), $R^3$ to $R^5$ each independently represent a hydrogen atom, an alkyl group, an aryl group, and an alkoxy group. Alternatively, specific examples of the alkyl group include a linear alkyl group such as a methyl group, an ethyl group, a n-propyl group, and a n-butyl group, a branched alkyl group such as an isopropyl group and an ethylhexyl group, and a cyclic alkyl group such as a cyclohexyl group. Examples of the aryl group include a phenyl group and a naphthyl group which may have a substituent. Examples of the alkoxy group include a linear alkoxy group such as a methoxy group, an ethoxy group, a n-propoxy group and a n-butoxy group, a branched alkoxy group such as an isopropoxy group and an ethylhexyloxy group, and a cyclohexyloxy group.

Among these, a hydrogen atom, an alkyl group having 1 to 8 carbon atoms, and an alkoxy group having 1 to 8 carbon atoms are preferred, from the versatility of the production raw materials; a hydrogen atom, an alkyl group having 1 to 6 carbon atoms, and an alkoxy group having 1 to 6 carbon atoms are more preferred, from the viewpoint of handling during production; a hydrogen atom and an alkyl group having 1 to 2 carbon atoms are still more preferred, from the viewpoint of light attenuation properties of an electrophotographic photoreceptor; and a hydrogen atom is particularly preferred, from the view point of charge transport ability of a charge transport substance.

In the above formula (2), $R^6$ and $R^7$ each independently represent any one of a hydrogen atom, an alkyl group, an aryl group, and an alkoxy group. Specific examples of the alkyl group include a linear alkyl group such as a methyl group, an ethyl group, a n-propyl group, and a n-butyl group, a branched alkyl group such as an isopropyl group and an ethylhexyl group, and a cyclic alkyl group such as a cyclohexyl group. Examples of the aryl group include a phenyl group and a naphthyl group which may have a substituent. Examples of the alkoxy group include a linear alkoxy group such as a methoxy group, an ethoxy group, a n-propoxy group and a n-butoxy group, a branched alkoxy group such as an ethyl hexyloxy group, and a cyclohexyloxy group.

Among these, a hydrogen atom, an alkyl group having 1 to 8 carbon atoms, and an alkoxy group having 1 to 8 carbon atoms are preferred, from the viewpoint of versatility of the production raw materials; a hydrogen atom, an alkyl group having 1 to 6 carbon atoms, and an alkoxy group having 1 to 6 carbon atoms are more preferred, from the viewpoint of handling during production; an alkyl group having 1 to 4 carbon atoms and an alkoxy group having 1 to 4 carbon atoms are still more preferred, from the viewpoint of light attenuation properties of an electrophotographic photoreceptor; an alkyl group having 1 to 4 carbon atoms is particularly preferred, from the viewpoint of resistance to ozone of the electrophotographic photoreceptor; and a methyl group or an ethyl group is most preferred, from the viewpoint of charge transport ability of a charge transport substance.

In a case where $R^6$ and $R^7$ represent an alkyl group or an alkoxy group, the bonding position of each substituent to the benzene ring may be generally any position of an ortho position, a meta position, and a para position, relative to bonding of a nitrogen atom. Alternatively, any one of the ortho position and the para position is preferred, from the viewpoint of ease of production.

In a case where the total number of the alkyl group and the alkoxy group relative to one benzene ring is two or greater, it is preferable that the substituent is substituted at either the ortho position or the para position. From the viewpoint of electrophotographic photoreceptor properties, more preferred is a case where a total of two alkyl groups are substituted on one benzene ring, and the two substituents are still more preferably substituted at the para position and the ortho position respectively, or both the two substituents are still more preferably substituted at the ortho position.

k2, l2, q2, r2 each independently represent an integer of 1 to 5, and m2, o2 and p2 each independently represent an integer of 1 to 4. In a case where k2, l2, m2, o2, p2, q2, and/or r2 represent an integer of 2 or greater, and a plurality of $R^1$ to $R^7$ bonded to the benzene ring may be the same or different.

n2 represents an integer of 1 to 5, preferably an integer of 1 to 3, and more preferably 2 or 3. From the viewpoint of solubility in a coating solvent, n2 is more preferably 1 or 2. From the viewpoint of the charge transport ability of a charge transport substance, n2 is more preferably 2.

The arylene group moiety to which a diphenylamino group is bonded represents a phenylene group in the case of n2=1, a biphenylene group in the case of n2=2, and a terphenylene group in the case of n2=3.

Positions at which two diphenylamino groups bond to an arylene group are not limited as long as the effects of the present invention are not significantly impaired. Alternatively, in the case of n=1, it is preferable that the two diphenylamino groups exhibit a meta position relationship at the bonding positions of the phenylene group, from the viewpoint of chargeability of the electrophotographic photoreceptor. In the case of n2=2, it is preferable that the positions at which the diphenylamino groups bond to the biphenylene group are respectively 4-position and 4' position of the biphenylene group, from the viewpoint of charge transport ability of a charge transport substance. In the case of n2=3, a p-terphenylene group is preferred among the terphenylene groups, from the versatility of the production raw materials, and it is preferable that positions at which the diphenylamino groups bond to the p-terphenylene group are 4-position and 4" position of the p-terphenylene group, from the viewpoint of the charge transport ability of a charge transport substance.

The electrophotographic photoreceptor according to the present invention may generally contain the compound represented by the formula (2) as a single component in the photosensitive layer, or may contain a mixture of compounds having different structures represented by the formula (2). Further, the electrophotographic photoreceptor may contain a mixture of the compound represented by the formula (2) and other positive hole transport substances (for example, a compound represented by any one of formulas (1), (3) to (5)).

It is preferable that a plurality of so-called positional isomers, which differ only in the substitution position of $R^1$ to $R^7$ among the structures represented by the formula (2), are mixed as the mixture of compounds having different structures represented by the formula (2), from the viewpoint of being able to prevent crystal formation in the coating solution or film in addition to the fact that the electronic states are close to each other and a charge transport trap is difficult to form. It is more preferable to mix and use compounds, in which the substitution positions of $R^1$ and $R^2$ are different, as the positional isomers, from the viewpoint of the ease of compound synthesis. It is most preferable to use a mixture in which the substitution positions of $R^1$ and $R^2$ are at the ortho position or the para-position.

The following exemplified compounds can be mentioned as a representative example of the compound represented by the above formula (2). Here, the compounds represented by the formula (2) in the present invention are not limited to these compounds.

In the present specification, Me represents a methyl group, Et represents an ethyl group, nBu represents a n-butyl group, and nHex represents an n-hexyl group.

(2)-1
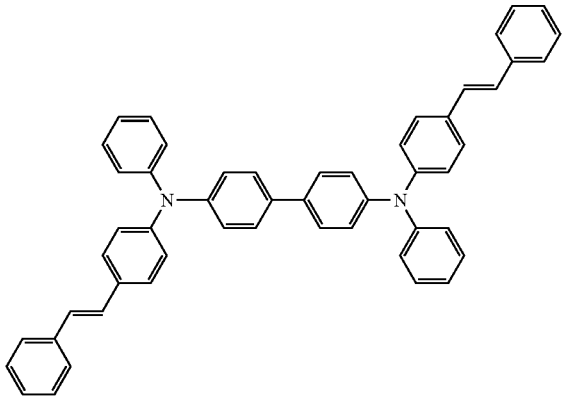
(2)-2
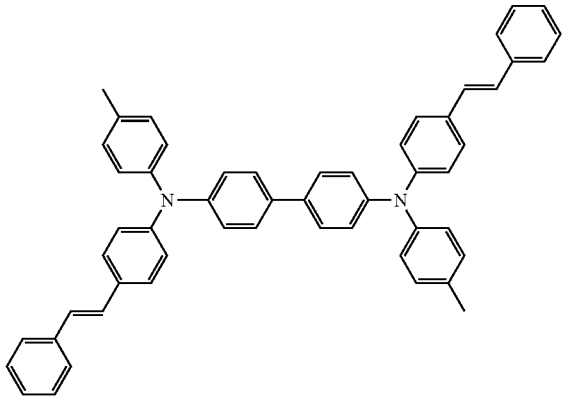
(2)-3
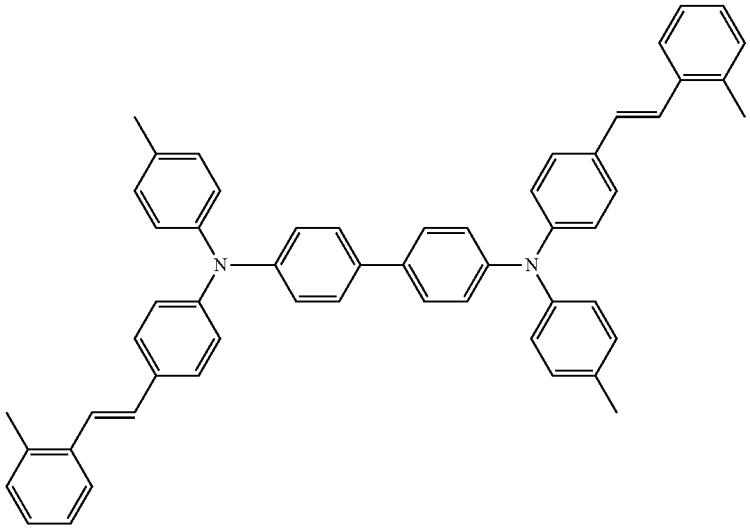
(2)-4
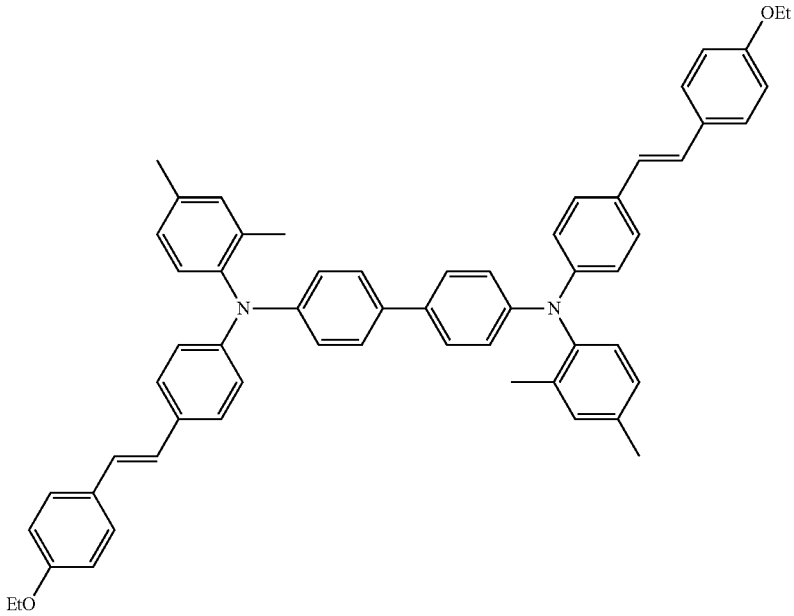

-continued
(2)-5
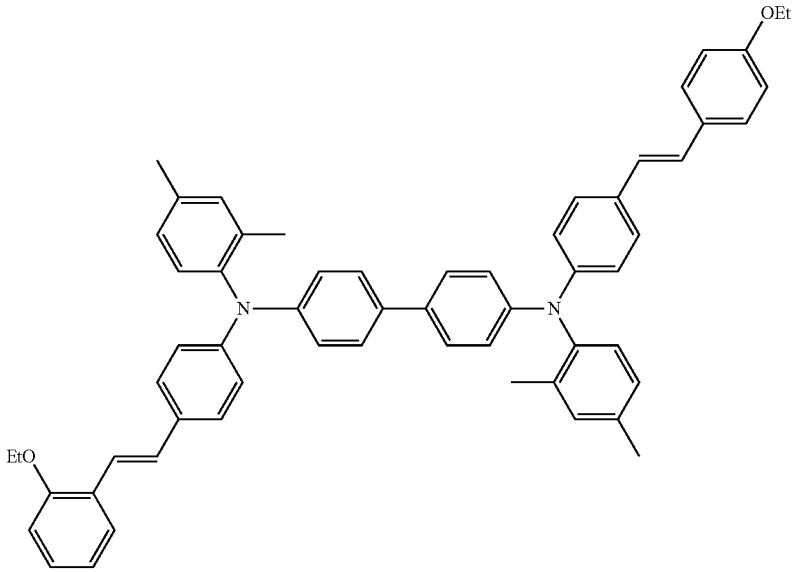
(2)-6
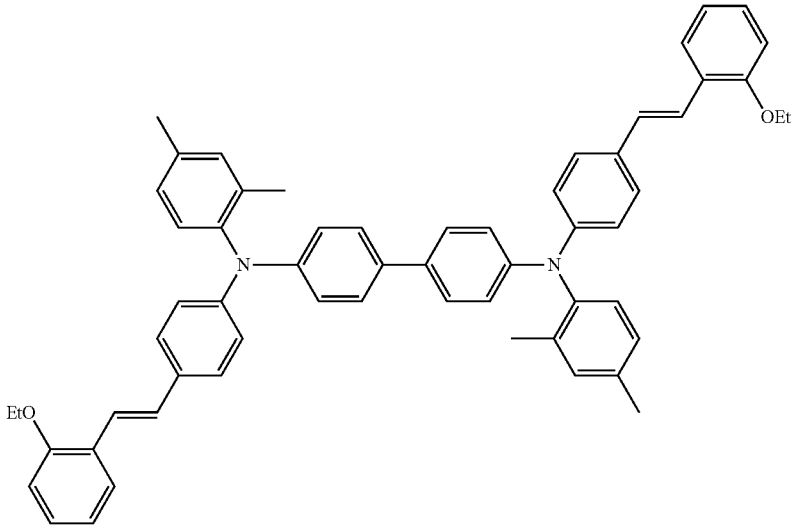
(2)-7
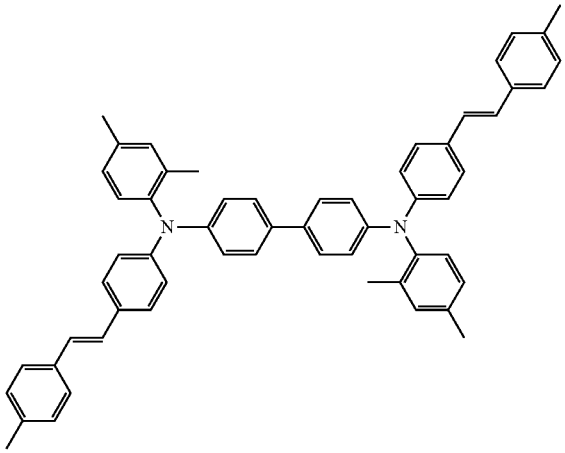
(2)-8
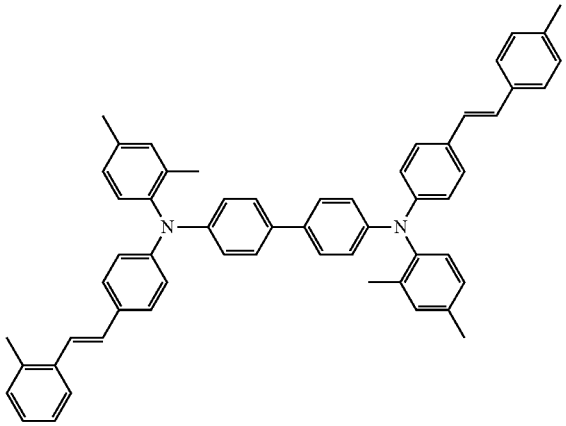

-continued
(2)-9
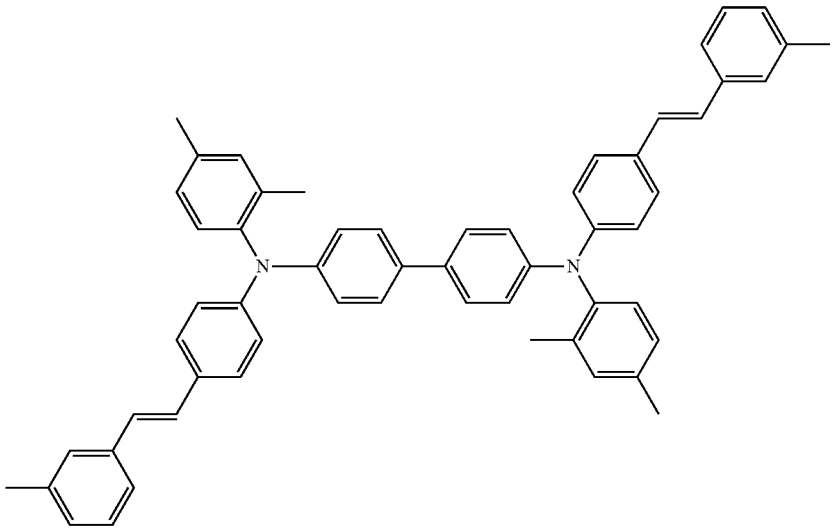
(2)-10
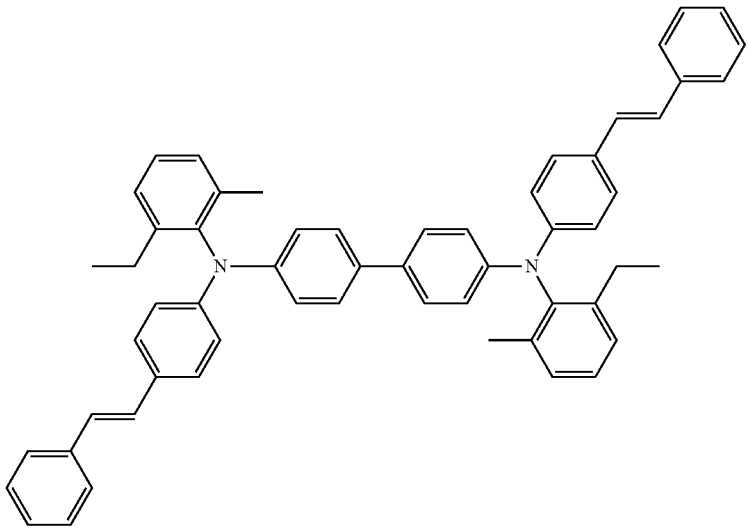

-continued
(2)-11
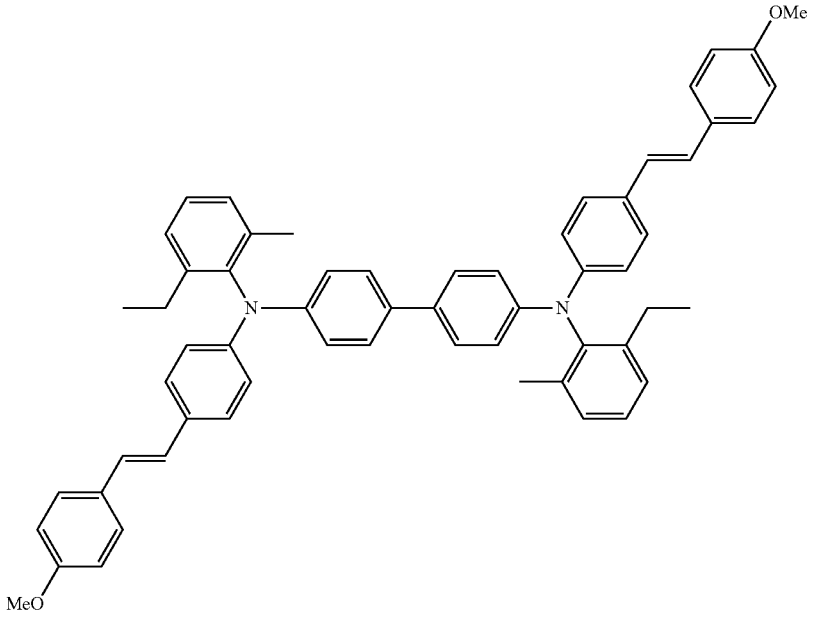
(2)-12
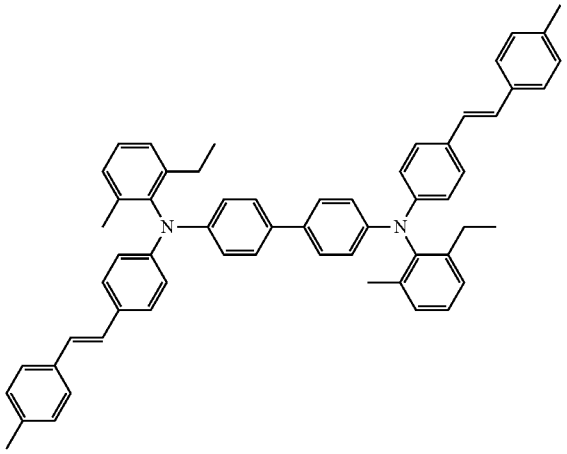
(2)-13
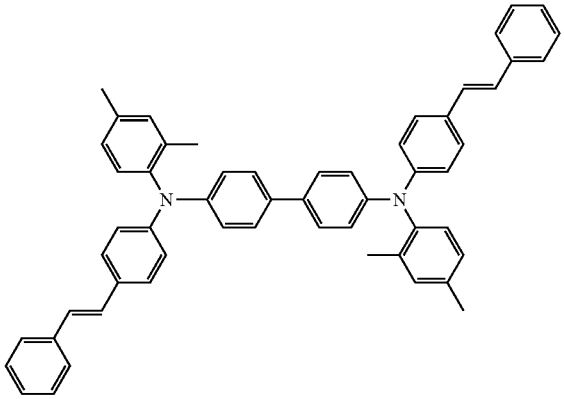
(2)-14
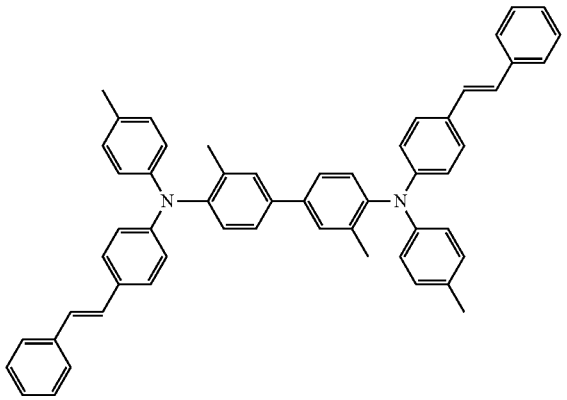
(2)-15
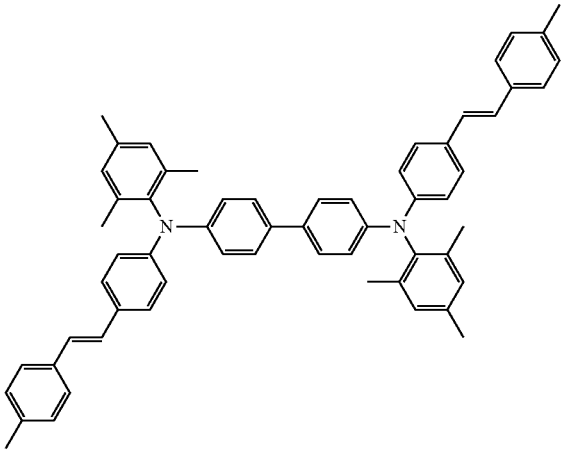

-continued
(2)-16
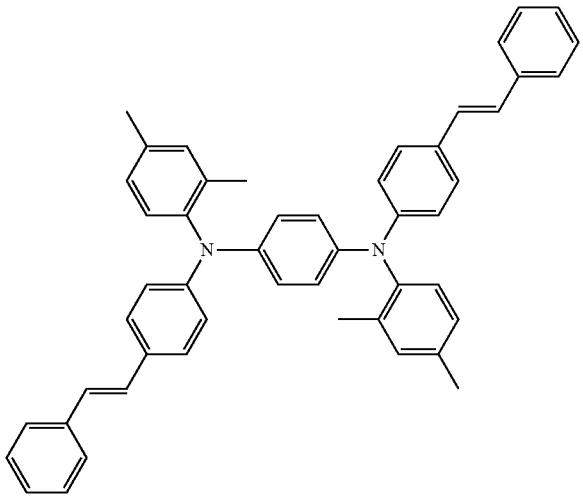
(2)-17
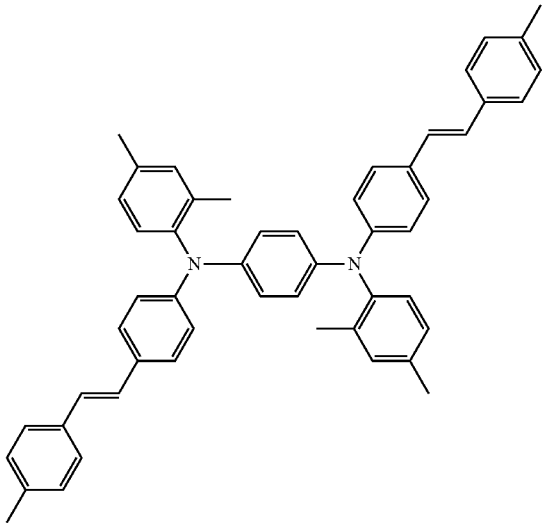
(2)-18
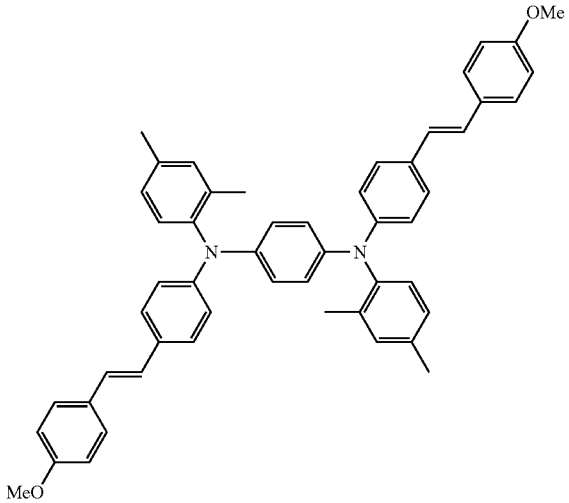
(2)-19
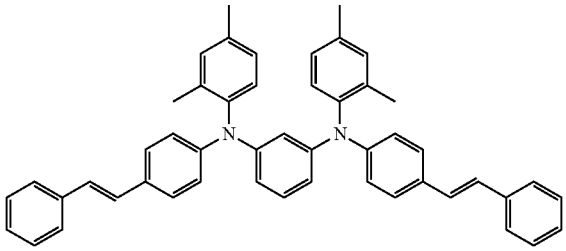
(2)-20
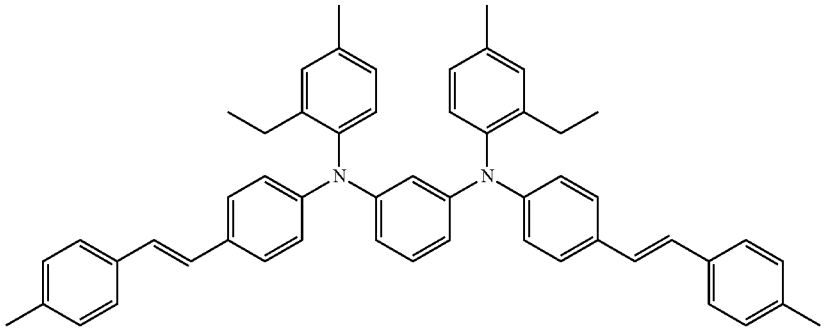

-continued
(2)-21
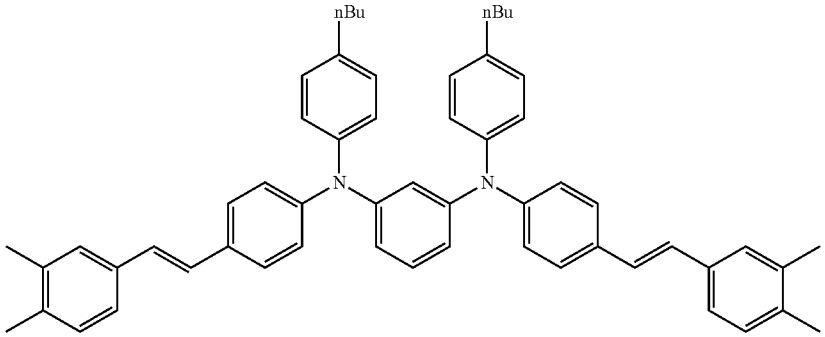
(2)-22
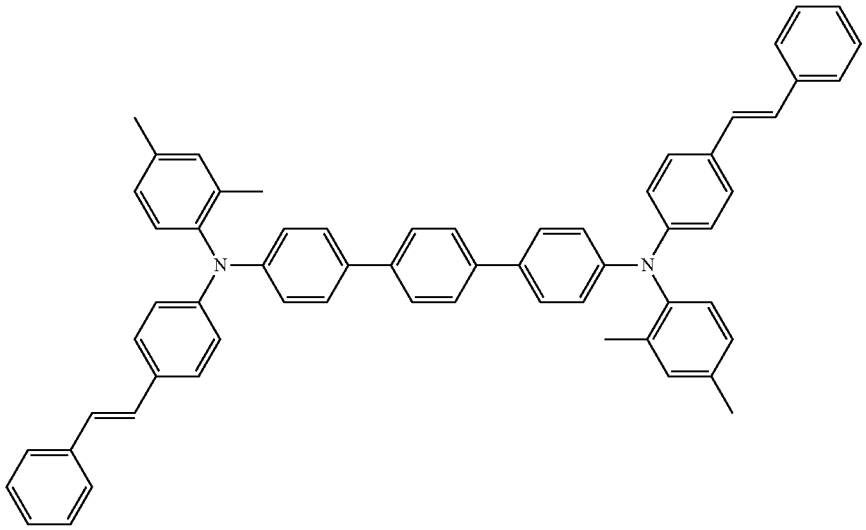
(2)-23
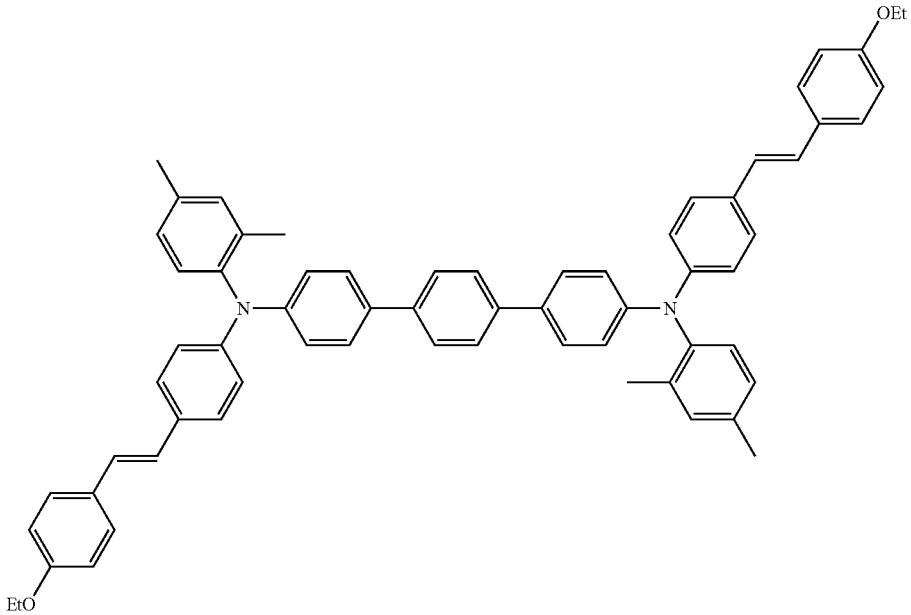

-continued
(2)-24
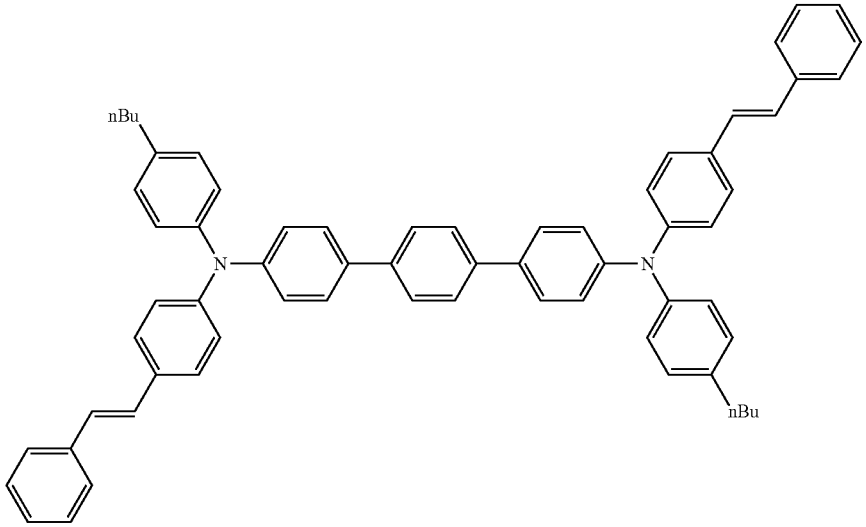
(2)-25
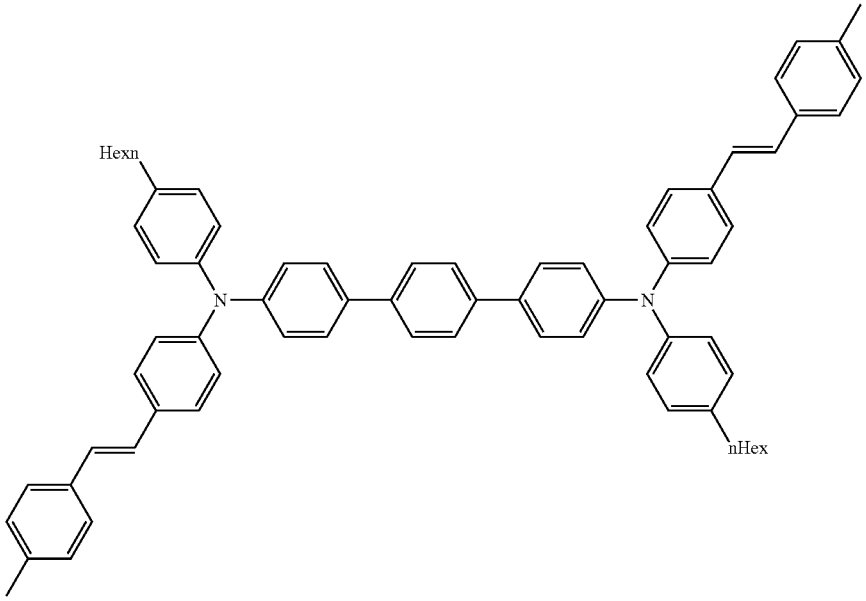
(2)-26
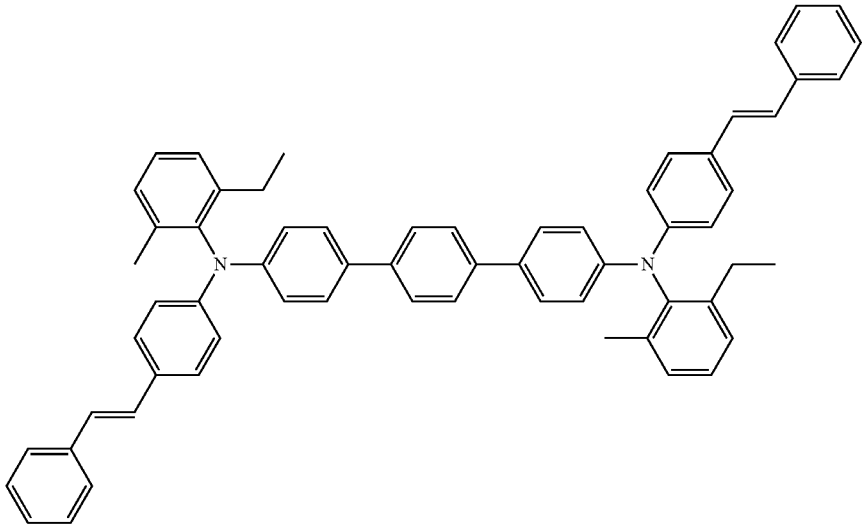

-continued (2)-27

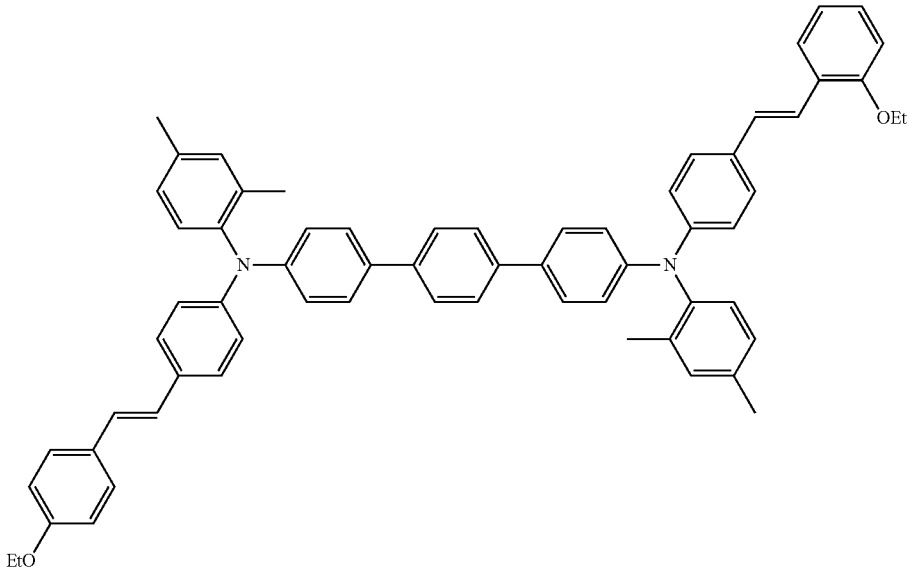

In the above exemplified compounds, (2)-3, (2)-4, (2)-7, (2)-10, (2)-12 and (2)-22 are preferred, (2)-3, (2)-4, (2)-7 and (2)-10 are more preferred, and (2)-7 and (2)-10 are still more preferred.

Next, the compound represented by the following formula (3) will be described.

FORMULA (3)

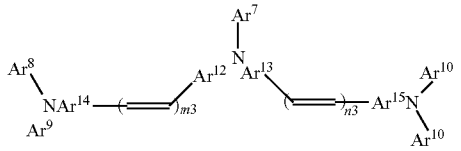

In the formula (3), $Ar^7$ to $Ar^{11}$ each independently represent an aryl group which may have a substituent, and $Ar^{12}$ to $Ar^{15}$ each independently represent an arylene group which may have a substituent. m3 and n3 each independently represent an integer of 1 to 3.

In the above formula (3), $Ar^7$ to $Ar^{11}$ each independently represent an aryl group which may have a substituent, and examples of the aryl group include a phenyl group, a naphthyl group, a biphenyl group, an anthryl group, a phenanthryl group, or the like. Among the examples of the aryl group, a phenyl group and a naphthyl group are preferred in consideration of the properties of the electrophotographic photoreceptor, and a phenyl group and a naphthyl group are more preferred, and a phenyl group is still more preferred, from the viewpoint of the charge transport ability.

Examples of the substituent which may be contained in $Ar^7$ to $Ar^{11}$ include an alkyl group, an aryl group, an alkoxy group, a halogen atom, or the like. Specific examples of the alkyl group include a linear alkyl group such as a methyl group, an ethyl group, a n-propyl group, and a n-butyl group, a branched alkyl group such as an isopropyl group and an ethylhexyl group, and a cyclic alkyl group such as a cyclohexyl group. Examples of the aryl group include a phenyl group and a naphthyl group which may have a substituent. Examples of the alkoxy group include a linear alkoxy group such as a methoxy group, an ethoxy group, a n-propoxy group and a n-butoxy group, a branched alkyl group such as an isopropoxy group and an ethyl hexyloxy group, a cyclic alkoxy group such as a cyclohexyloxy group, and an alkoxy group having a fluorine atom such as a trifluoromethoxy group, a pentafluoroethoxy group, and a 1,1,1-trifluoroethoxy group. Examples of the halogen atom include a fluorine atom, a chlorine atom, and a bromine atom.

Among these, an alkyl group having 1 to 20 carbon atoms, and an alkoxy group having 1 to 20 carbon atoms are preferred, from the versatility of the production raw materials; an alkyl group having 1 to 12 carbon atoms, and an alkoxy group having 1 to 12 carbon atoms are more preferred, from the viewpoint of handling during production; and an alkyl group having 1 to 6 carbon atoms and an alkoxy group having 1 to 6 carbon atoms are still more preferred, from the viewpoint of light attenuation properties of an electrophotographic photoreceptor.

In a case where $Ar^7$ to $Ar^{11}$ represent phenyl groups, the phenyl group preferably has a substituent, and the number of the substituents may be 1 to 5, from the viewpoint of the charge transport ability. Alternatively, the number of the substituents is preferably 1 to 3 from the versatility of production raw materials, and is more preferably 1 to 2 from the viewpoint of properties of the electrophotographic photoreceptor. In a case where $Ar^7$ to $Ar^{11}$ represent naphthyl group groups, it is preferable that the number of the substituents is 2 or less or the substituent is not contained, and it is more preferable that the number of substituents is 1 or the substituent is not contained, from the versatility of production raw materials.

In the above formula (3), $Ar^{12}$ to $Ar^{15}$ each independently represent an arylene group which may have a substituent. Specific examples of the arylene group include a phenylene group, a biphenylene group, a naphthylene group, an anthrylene group, and a phenanthrylene group. Among these, a phenylene group and a naphthylene group are preferred, and a phenylene group is more preferred, considering the properties of the electrophotographic photoreceptor.

Examples of the substituent which may be contained in $Ar^{12}$ to $Ar^{15}$ include an alkyl group, an aryl group, an alkoxy group, a halogen atom, or the like. Specific examples of the alkyl group include a linear alkyl group such as a methyl group, an ethyl group, a n-propyl group, and a n-butyl group, a branched alkyl group such as an isopropyl group and an ethylhexyl group, and a cyclic alkyl group such as a cyclohexyl group. Examples of the aryl group include a phenyl group and a naphthyl group which may have a substituent. Examples of the alkoxy group include a linear alkoxy group such as a methoxy group, an ethoxy group, a n-propoxy group and a n-butoxy group, a branched alkyl group such as an isopropoxy group and an ethyl hexyloxy group, a cyclic alkoxy group such as a cyclohexyloxy group, and an alkoxy group having a fluorine atom such as a trifluoromethoxy group, a pentafluoroethoxy group, and a 1,1,1-trifluoroethoxy group. Examples of the halogen atom include a fluorine atom, a chlorine atom, and a bromine atom.

Among these substituents, an alkyl group having 1 to 6 carbon atoms, and an alkoxy group having 1 to 6 carbon atoms are preferred, from the versatility of the production raw materials; an alkyl group having 1 to 4 carbon atoms, and an alkoxy group having 1 to 4 carbon atoms are more preferred, from the viewpoint of handling during production; and a methyl group, an ethyl group, a methoxy group, an ethoxy group are still more preferred, from the viewpoint of light attenuation properties of an electrophotographic photoreceptor.

If $Ar^{12}$ to $Ar^{15}$ have a substituent, the molecular structure may be twisted, which may prevent the expansion of π conjugation in the molecule and the electron transport ability may be decreased. Therefore, $Ar^{12}$ to $Ar^{15}$ preferably have no substituent. From the viewpoint of electrophotographic photoreceptor properties, a 1,3-phenylene group, a 1,4-phenylene group, a 1,4-naphthylene group, a 2,6-naphthylene group, and a 2,8-naphthylene group are more preferred, and a 1,4-phenylene group is still more preferred.

m3 and n3 each independently represent an integer of 1 to 3. If m3 and n3 increase, the solubility in the coating solvent tends to decrease. Therefore, m3 and n3 are preferably 2 or less, and are more preferably 1, from the viewpoint of charge transport ability of a charge transport substance.

The case where m3 and n3 are 1 represents ethenyl group, and has a geometric isomer. Alternatively, a trans-isomer structure is preferred, from the viewpoint of electrophotographic photoreceptor property. The case where m3 and n3 are 2 represents butadienyl groups, and also has a geometric isomer. Alternatively, a mixture of two or more geometrical isomers is preferred, from the viewpoint of coating liquid storage stability.

The electrophotographic photoreceptor according to the present invention may contain the compound represented by the formula (3) as a single component in the photosensitive layer, or may contain a mixture of the compounds represented by the formula (3). Further, the electrophotographic photoreceptor may contain a mixture of the compound represented by the formula (3) and other positive hole transport substances (for example, a compound represented by any one of formulas (1), (2), (4) and (5)).

The following exemplified compounds can be mentioned as a representative example of the compound represented by the above formula (3). Here, the compounds represented by the formula (3) in the present invention are not limited to these compounds.

(3)-1

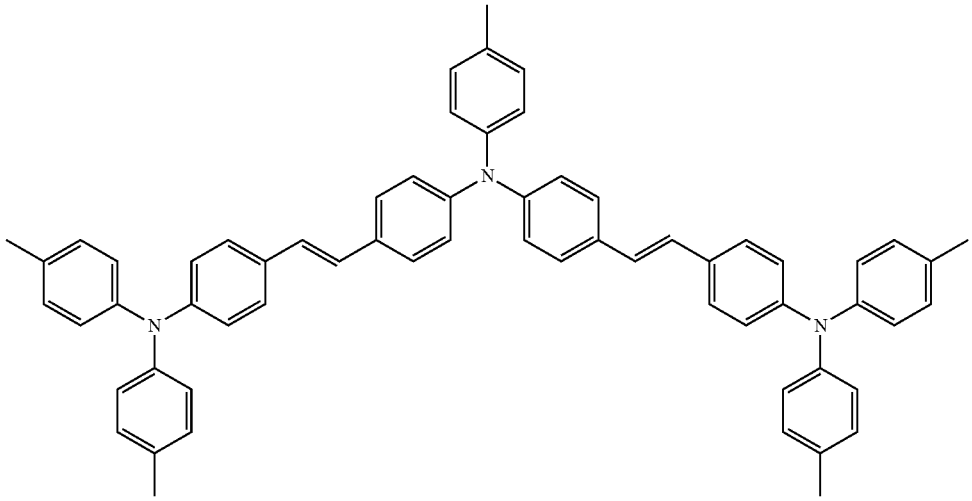

-continued
(3)-2
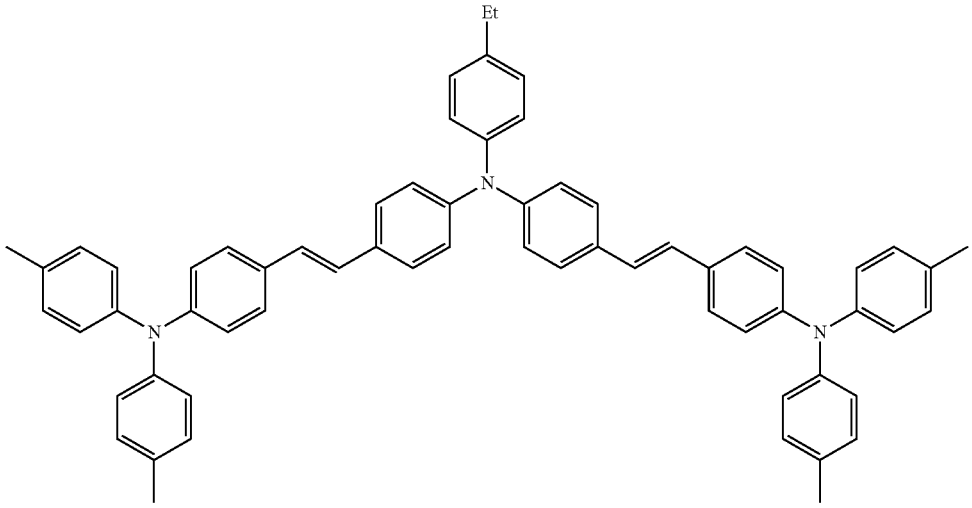
(3)-3
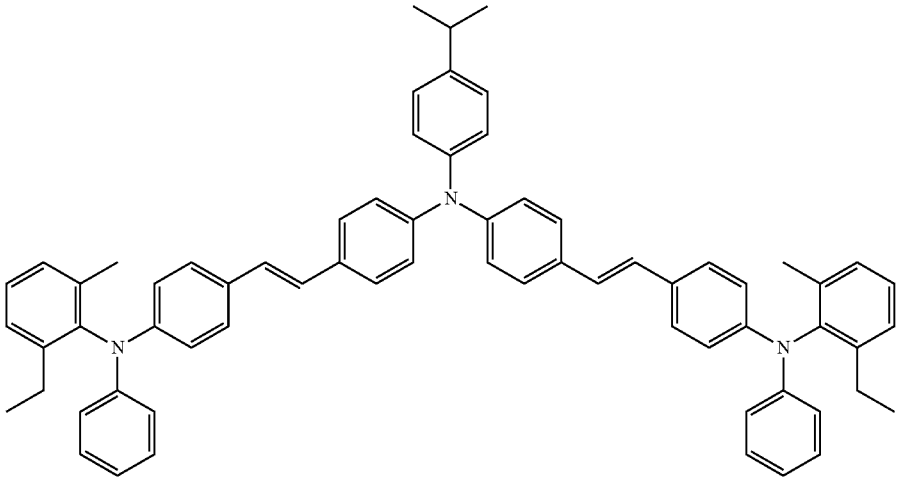
(3)-4
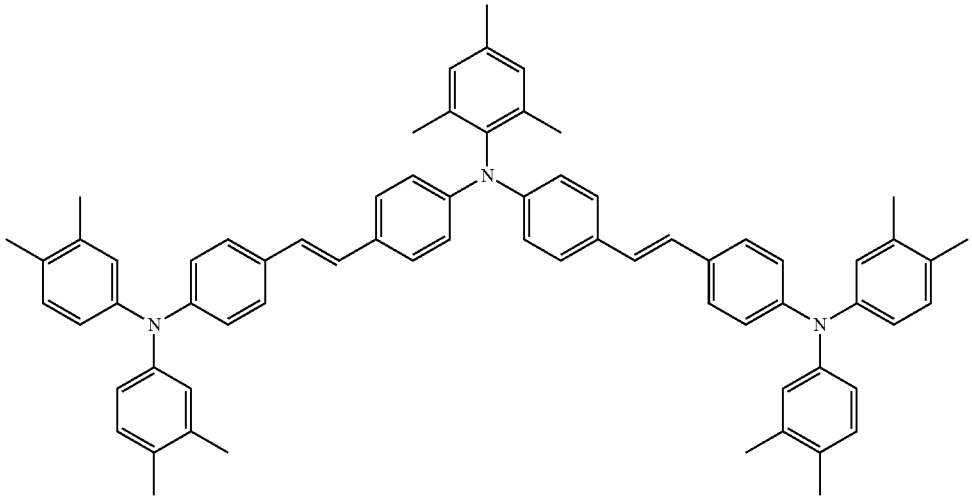

-continued
(3)-5
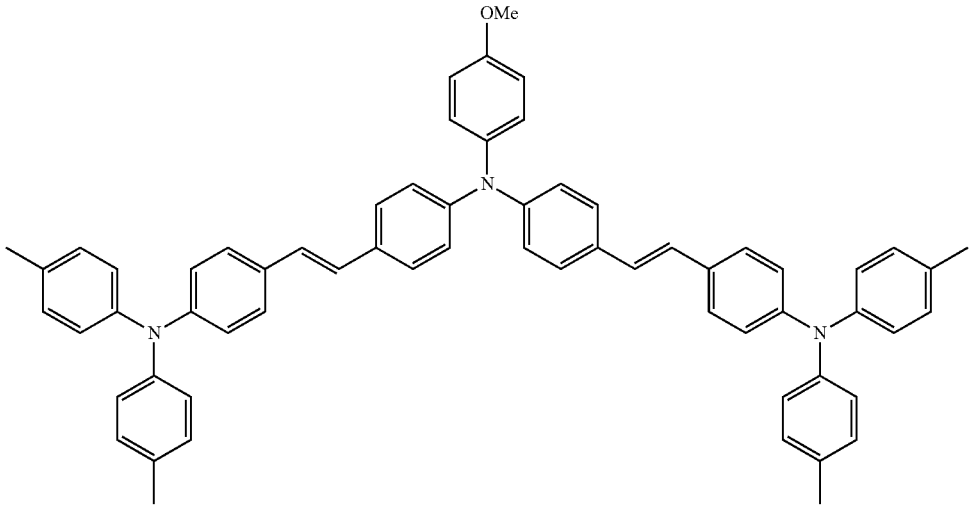
(3)-6
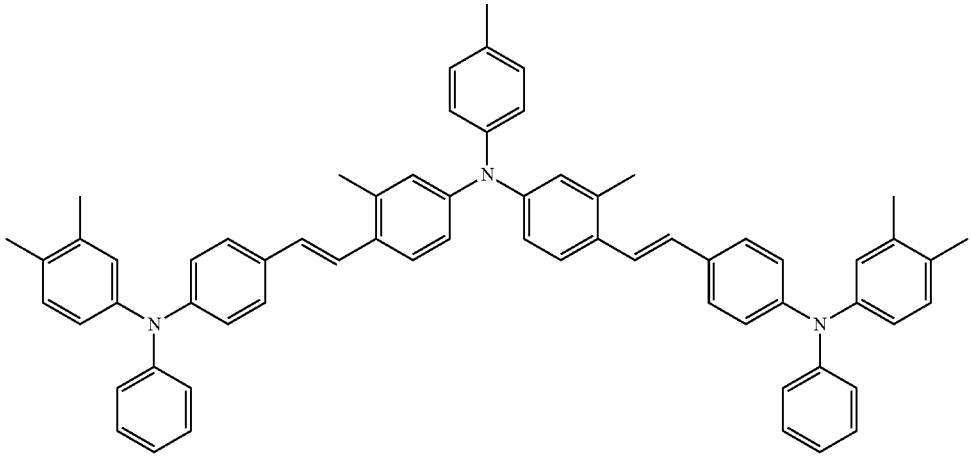
(3)-7
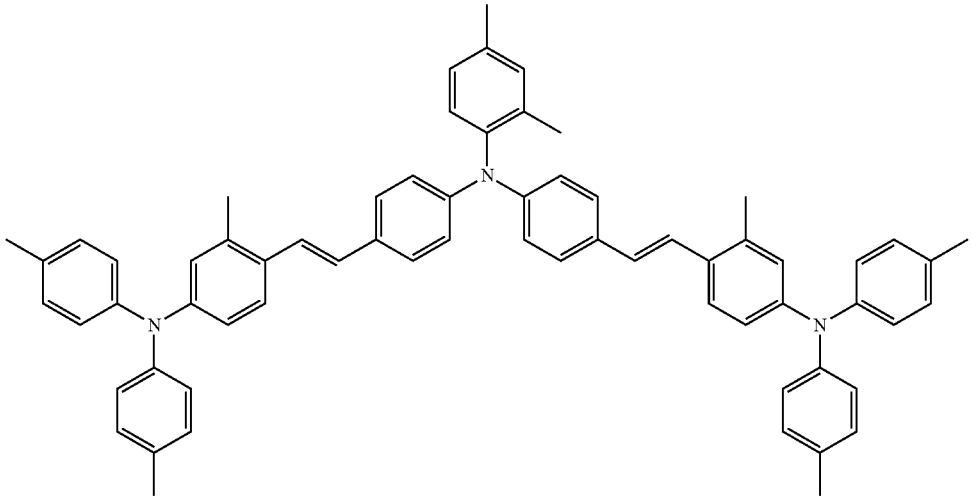

-continued
(3)-8
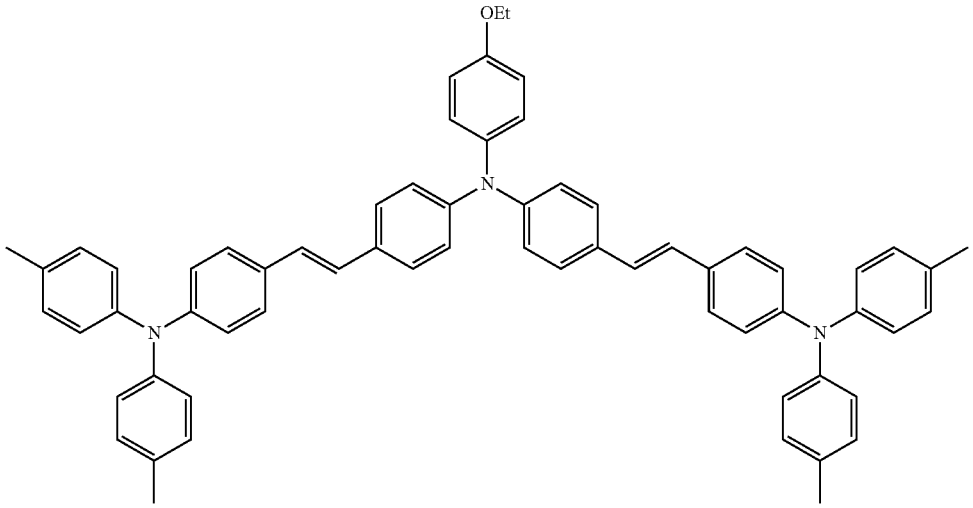
(3)-9
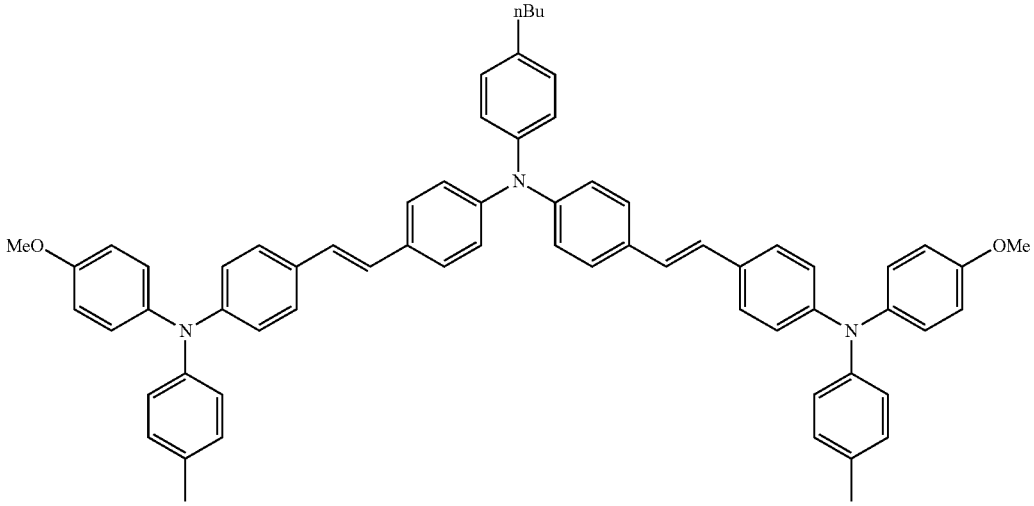
(3)-10
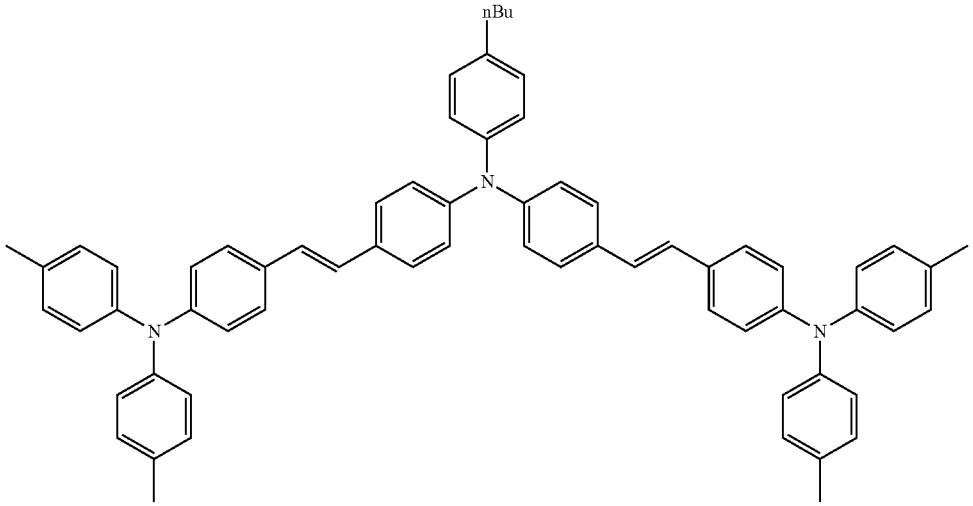

-continued
(3)-11
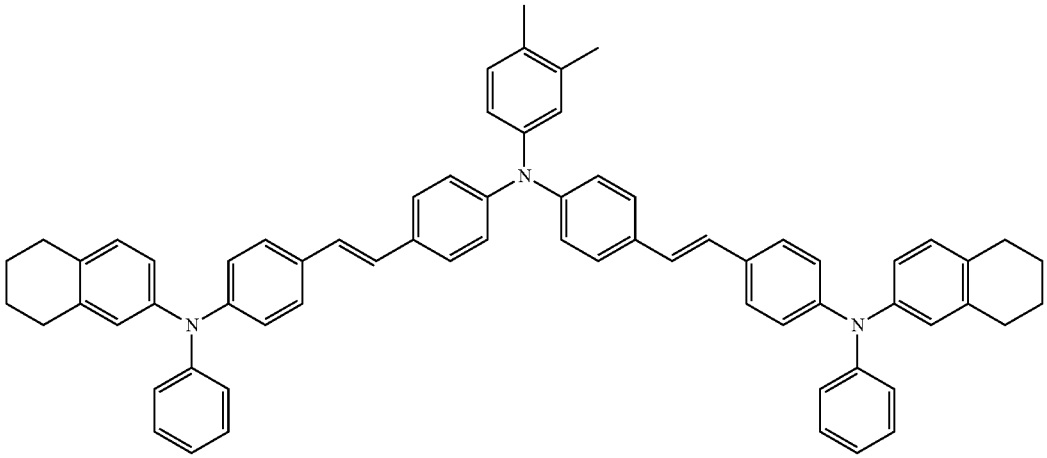
(3)-12
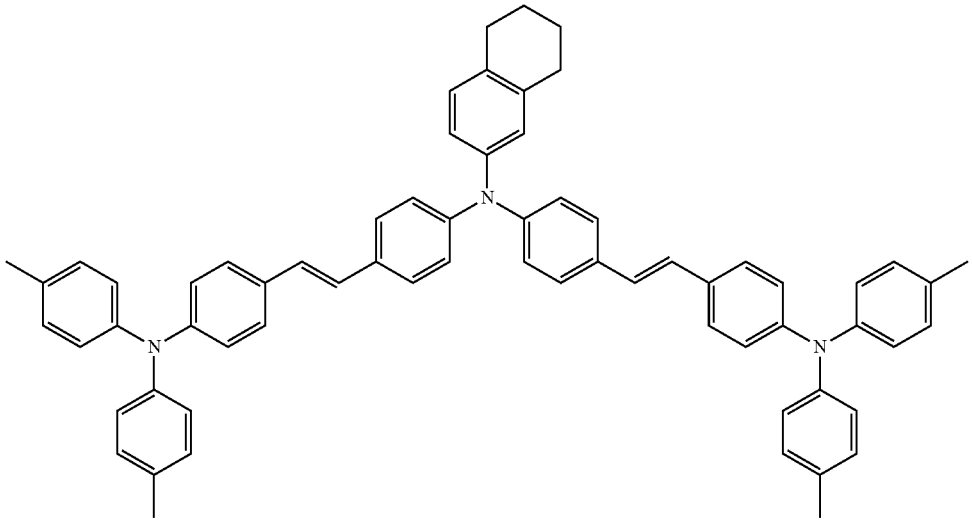
(3)-13
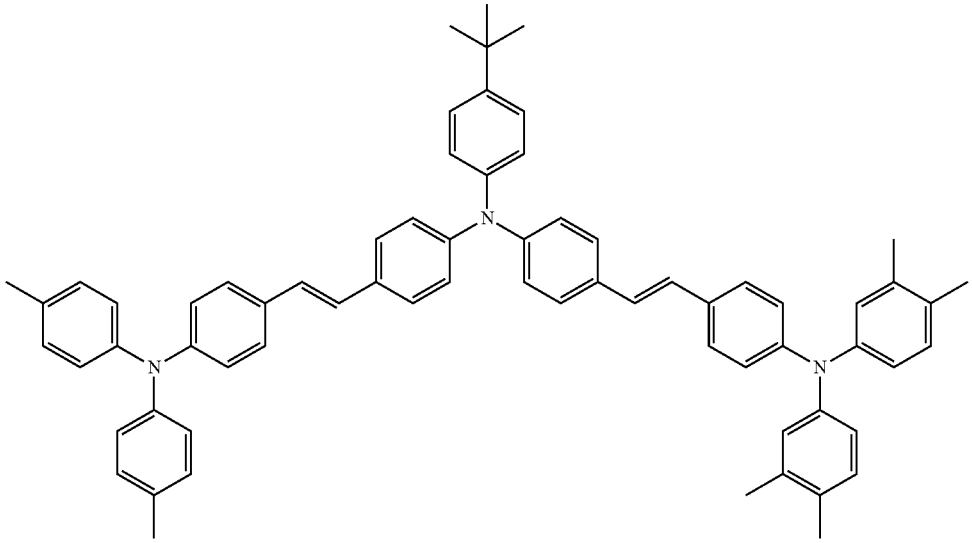

-continued
(3)-14
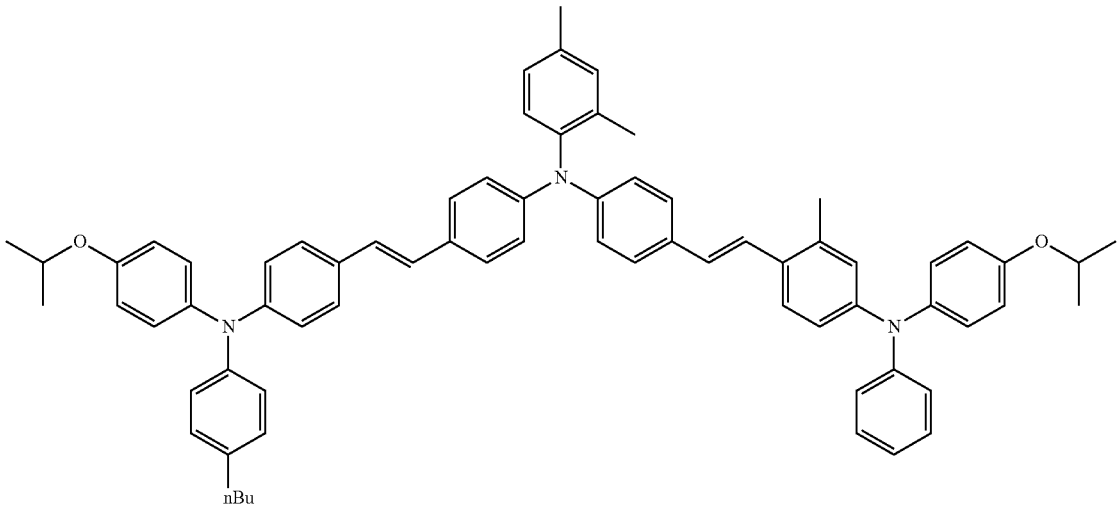
(3)-15
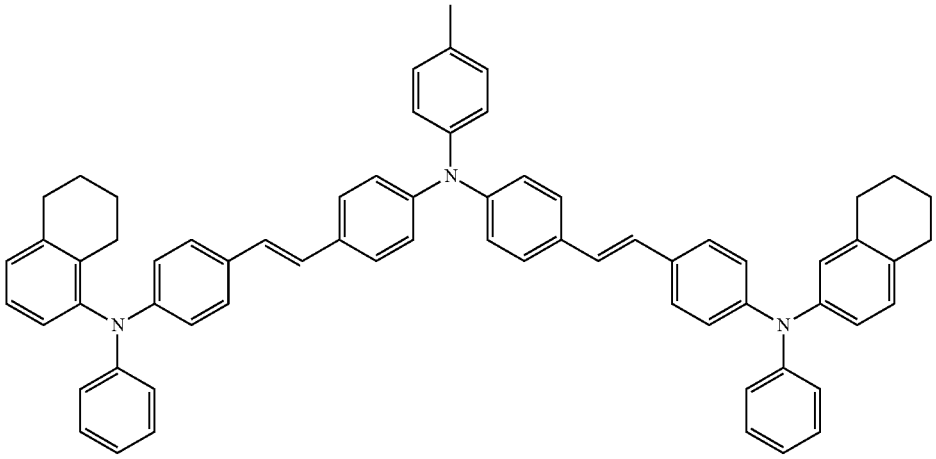
(3)-16
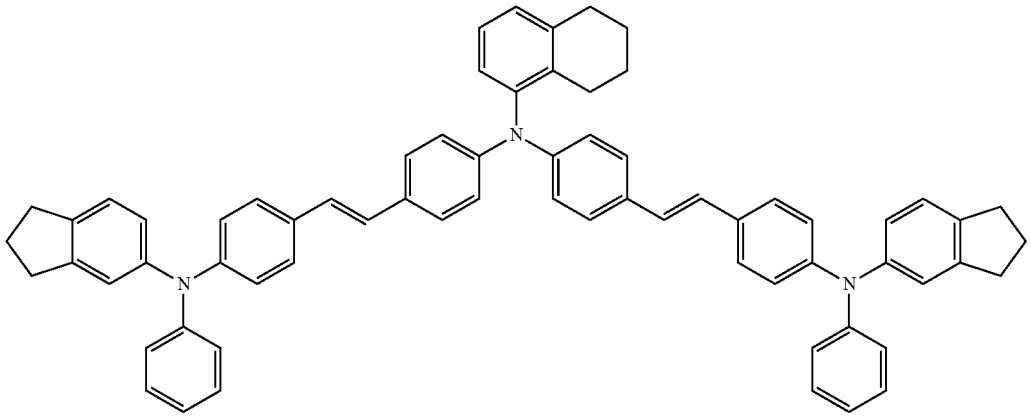

In the above exemplified compounds, (3)-1, (3)-2, (3)-5, (3)-8, (3)-9, and (3)-10 are preferred, and (3)-1 and (3)-8 are particularly preferred.

Next, the compound represented by the following formula (4) will be described.

FORMULA (4)

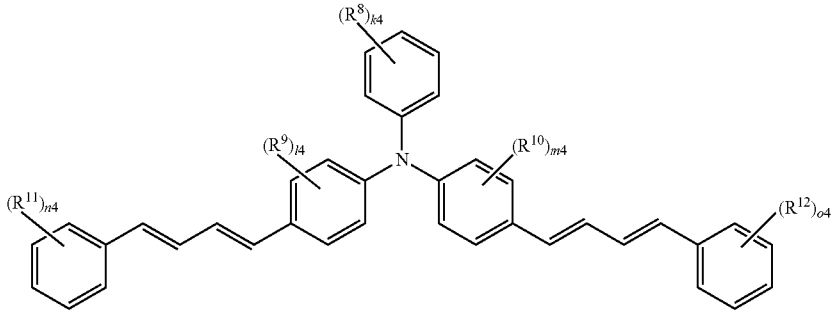

In the formula (4), $R^8$ to $R^{12}$ each independently represent a hydrogen atom, an alkyl group, an aryl group, and an alkoxy group. k4, n4, and o4 each independently represent an integer of 1 to 5, and 14 and m4 each independently represent an integer of 1 to 4.

In the above formula (4), $R^8$ represents any one of a hydrogen atom, an alkyl group, an aryl group, and an alkoxy group. Specific examples of the alkyl group include a linear alkyl group such as a methyl group, an ethyl group, a n-propyl group, and a n-butyl group, a branched alkyl group such as an isopropyl group and an ethylhexyl group, and a cyclic alkyl group such as a cyclohexyl group. Examples of the aryl group include a phenyl group and a naphthyl group which may have a substituent. Examples of the alkoxy group include a linear alkoxy group such as a methoxy group, an ethoxy group, a n-propoxy group and a n-butoxy group, a branched alkoxy group such as an isopropoxy group and an ethylhexyloxy group, and a cyclohexyloxy group.

Among these, a hydrogen atom, an alkyl group having 1 to 8 carbon atoms, and an alkoxy group having 1 to 8 carbon atoms are preferred, from the viewpoint of versatility of the production raw materials; a hydrogen atom, an alkyl group having 1 to 6 carbon atoms, and an alkoxy group having 1 to 6 carbon atoms are more preferred, from the viewpoint of handling during production; an alkyl group having 1 to 4 carbon atoms and an alkoxy group having 1 to 4 carbon atoms are still more preferred, from the viewpoint of light attenuation properties of an electrophotographic photoreceptor; an alkyl group having 1 to 4 carbon atoms is particularly preferred, from the viewpoint of resistance to ozone of the electrophotographic photoreceptor; and a linear or branched alkyl group having 3 to 4 carbon atoms is most preferred, from the viewpoint of solubility.

In a case where $R^8$ represents an alkyl group, a position at which the substituent bonds to the benzene ring may be generally any position of an ortho position, a meta position, and a para position relative to bonding of a nitrogen atom. Alternatively, the ortho position and/or the para position are preferred, from the viewpoint of ease of production.

In the above formula (4), $R^9$ and $R^{10}$ each independently represent a hydrogen atom, an alkyl group, an aryl group, and an alkoxy group. Specific examples of the alkyl group include a linear alkyl group such as a methyl group, an ethyl group, a n-propyl group, and a n-butyl group, a branched alkyl group such as an isopropyl group and an ethylhexyl group, and a cyclic alkyl group such as a cyclohexyl group. Examples of the aryl group include a phenyl group and a naphthyl group which may have a substituent. Examples of the alkoxy group include a linear alkoxy group such as a methoxy group, an ethoxy group, a n-propoxy group and a n-butoxy group, a branched alkoxy group such as an isopropoxy group and an ethylhexyloxy group, and a cyclohexyloxy group.

Among these, a hydrogen atom, an alkyl group having 1 to 8 carbon atoms, and an alkoxy group having 1 to 8 carbon atoms are preferred, from the versatility of the production raw materials; a hydrogen atom, an alkyl group having 1 to 6 carbon atoms, and an alkoxy group having 1 to 6 carbon atoms are more preferred, from the viewpoint of handling during production; a hydrogen atom and an alkyl group having 1 to 2 carbon atoms are still more preferred, from the viewpoint of light attenuation properties of an electrophotographic photoreceptor; and a hydrogen atom is particularly preferred, from the view point of charge transport ability of a charge transport substance.

In the above formula (4), $R^{11}$ and $R^{12}$ each independently represent a hydrogen atom, an alkyl group, an aryl group, and an alkoxy group. Specific examples of the alkyl group include a linear alkyl group such as a methyl group, an ethyl group, a n-propyl group, and a n-butyl group, a branched alkyl group such as an isopropyl group and an ethylhexyl group, and a cyclic alkyl group such as a cyclohexyl group. Examples of the aryl group include a phenyl group and a naphthyl group which may have a substituent. Examples of the alkoxy group include a linear alkoxy group such as a methoxy group, an ethoxy group, a n-propoxy group and a n-butoxy group, a branched alkoxy group such as an isopropoxy group and an ethylhexyloxy group, and a cyclohexyloxy group.

Among these, a hydrogen atom, a methyl group, an ethyl group, a methoxy group, and an ethoxy group are preferred, from the viewpoint of the versatility of the production raw material and the charge transport ability of a charge transport substance. The bonding position of each substituent to the benzene ring may be generally any position of an ortho position, a meta position, and a para position, relative to the styryl group. Alternatively, any one of the ortho position and the para position is preferred, from the viewpoint of ease of production.

The following exemplified compounds can be mentioned as a representative example of the compound represented by the above formula (4). Here, the compounds represented by the formula (4) in the present invention are not limited to these compounds.

In addition, the charge transport substance may contain one kind of compound represented by the formula (4) as a single component, or may contain a mixture of a plurality of compounds represented by the formula (4), or may contain a mixture of compounds represented by the formula (4) and other positive hole transport substances (for example, compounds represented by any one of the formulas (1) to (3), and (5)).

(4)-1

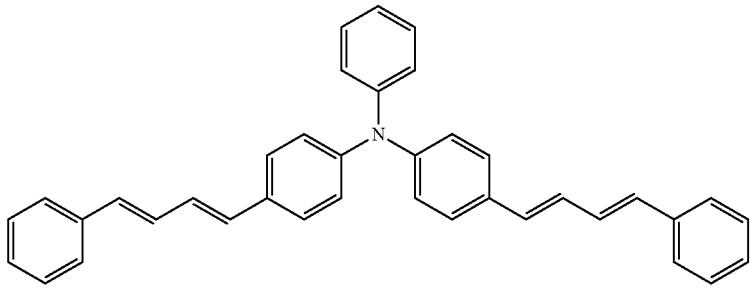

(4)-2

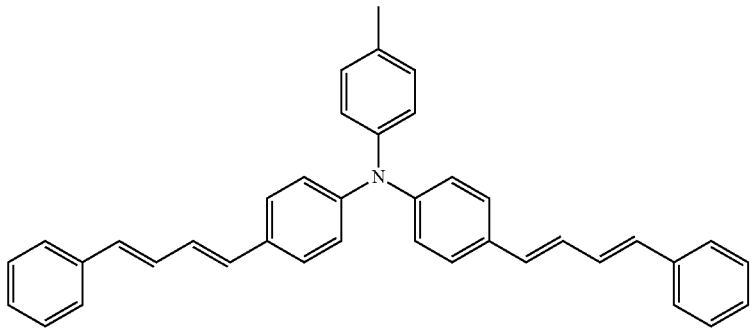

(4)-3

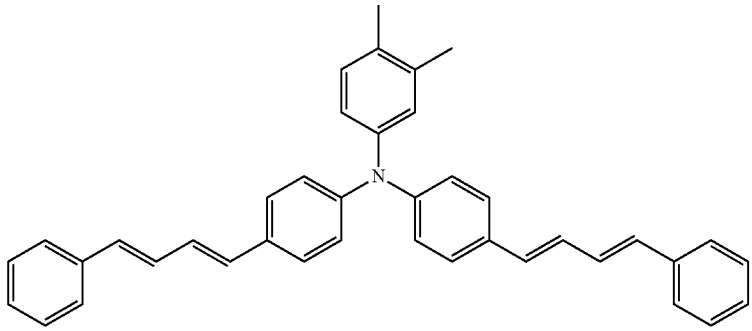

(4)-4

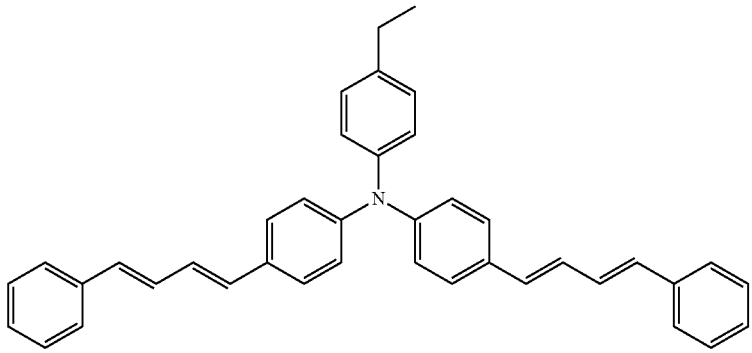

-continued
(4)-5
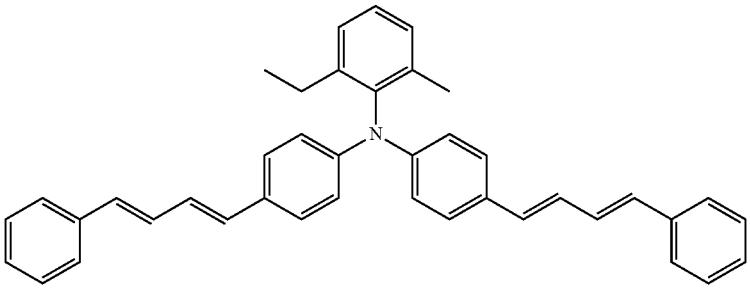
(4)-6
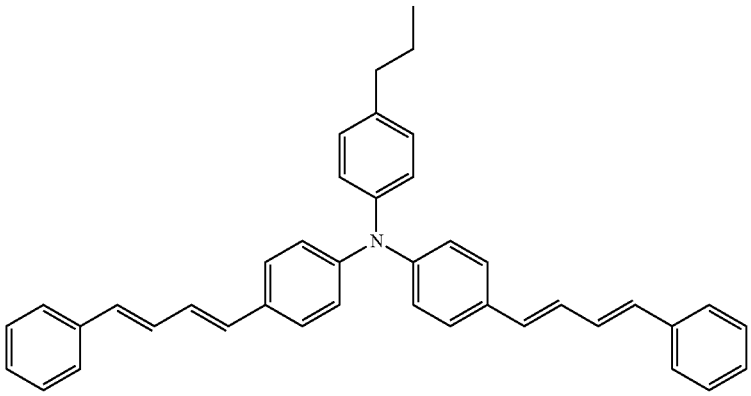
(4)-7
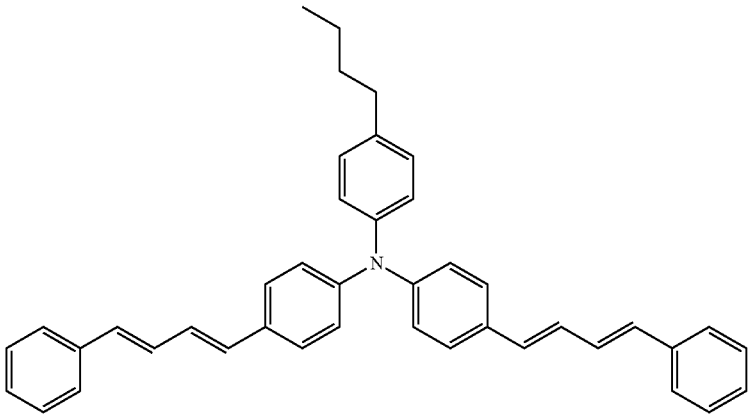
(4)-8
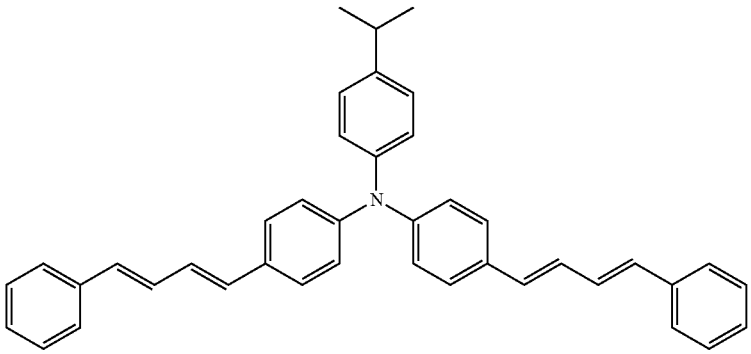

-continued
(4)-9
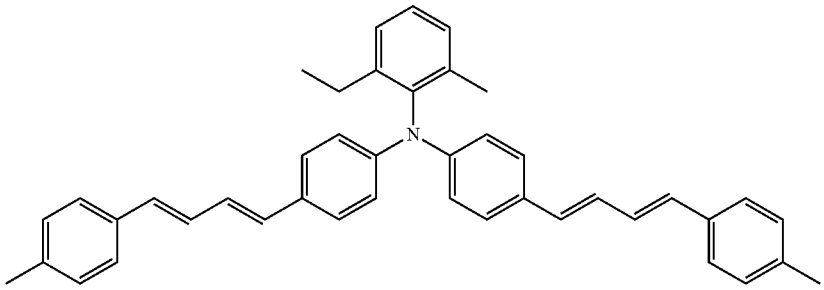
(4)-10
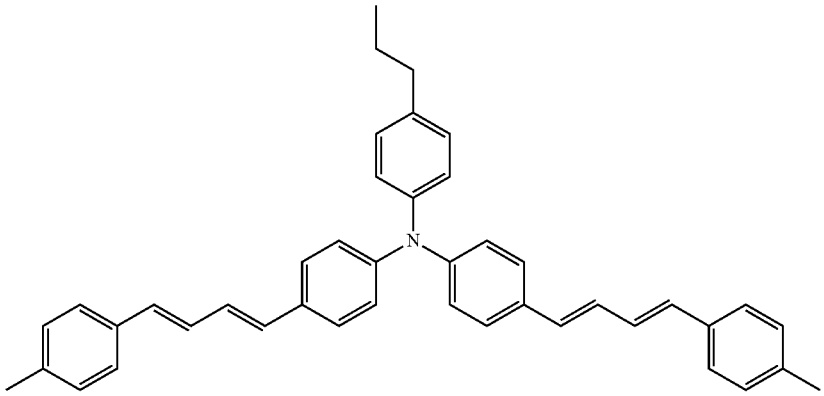
(4)-11
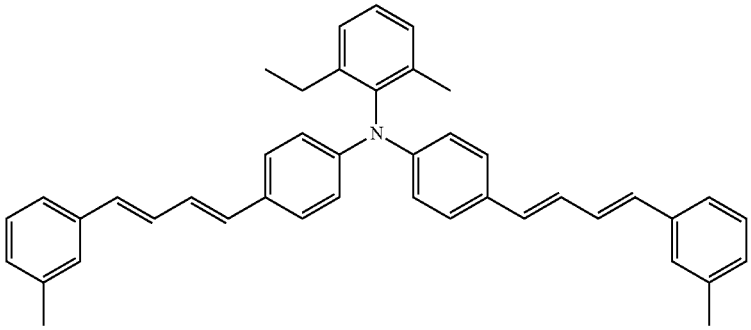
(4)-12
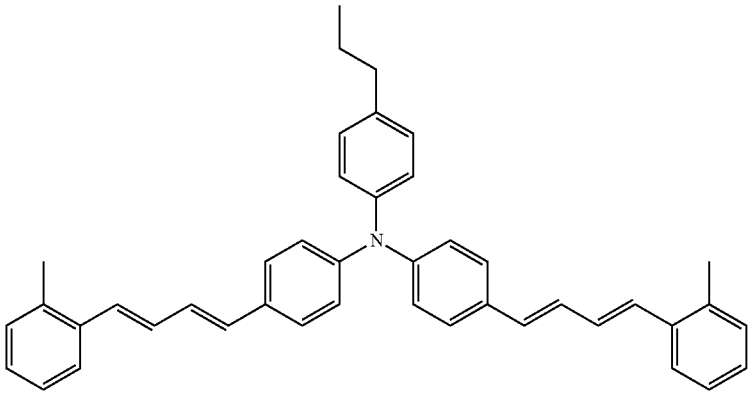

-continued (4)-13

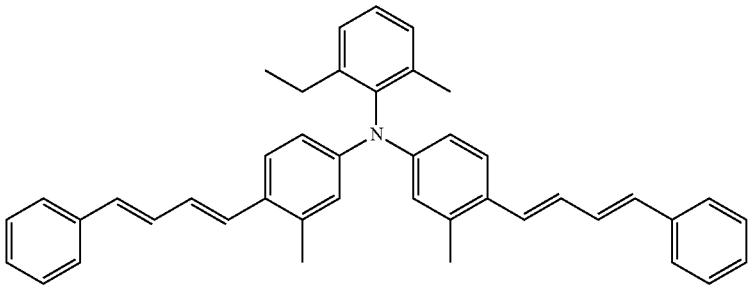

(4)-14

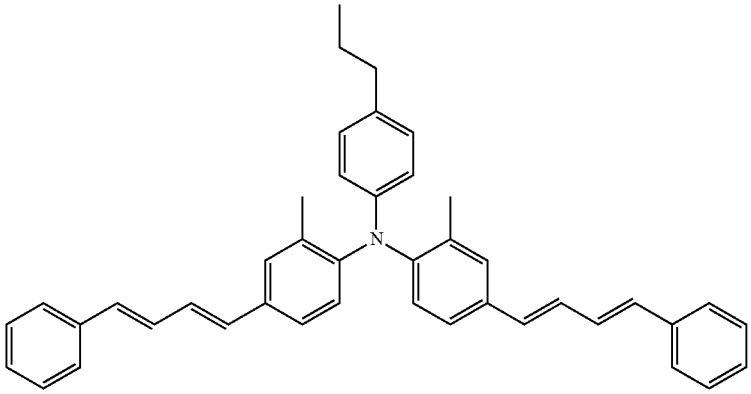

In the above exemplified compounds, (4)-5, (4)-7, (4)-8 and (4)-9 are preferred, and (4)-5 and (4)-7 are particularly preferred.

Next, the compound represented by the following formula (5) will be described.

FORMULA (5)

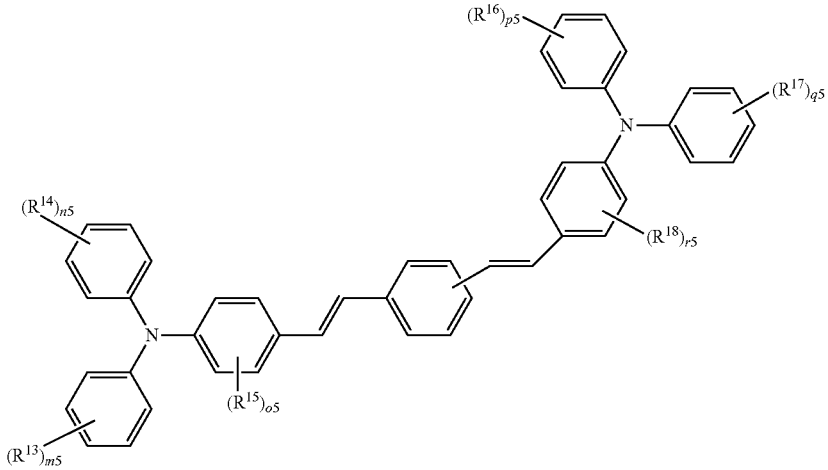

In the formula (5), $R^{13}$ to $R^{18}$ each independently represent an alkyl group and an alkoxy group, m5, n5, p5 and q5 each independently represent an integer of 0 to 5, and o5 and r5 each independently represent an integer of 0 to 4. In a case where m5, n5, o5, p5, q5 and r5 are integers of 2 or greater respectively, each of a plurality of $R^{13}$ to $R^{18}$ is bonded to the adjacent one of the plurality of $R^{13}$ to $R^{18}$ to form a ring structure.

In the above formula (5), $R^{13}$ to $R^{18}$ each independently represent an alkyl group and an alkoxy group. Specific examples of the alkyl group include a linear alkyl group such as a methyl group, an ethyl group, a n-propyl group, and a n-butyl group, a branched alkyl group such as an isopropyl group and an ethylhexyl group, and a cyclic alkyl group such as a cyclohexyl group. Examples of the alkoxy group include a linear alkoxy group such as a methoxy group, an ethoxy group, a n-propoxy group, and a n-butoxy group, a branched alkoxy group such as an isopropoxy group and an ethyl hexyloxy group, a cyclic alkoxy group such as a cyclohexyloxy group, and an alkoxy group having a fluorine atom, such as a trifluoromethoxy group, a pentafluoroethoxy group, and a 1,1,1-trifluoroethoxy group.

Among these, an alkyl group having 1 to 20 carbon atoms and an alkoxy group having 1 to 20 carbon atoms are preferred, from the versatility of the production raw materials; an alkyl group having 1 to 12 carbon atoms and an alkoxy group having 1 to 12 carbon atoms are more preferred, from the viewpoint of handling during production; and an alkyl group having 1 to 6 carbon atoms and an alkoxy group having 1 to 6 carbon atoms are more preferred, an alkyl group having 1 to 3 carbon atoms and an alkoxy group having 1 to 3 carbon atoms are still more preferred, and a methyl group, an ethyl group and a methoxy group are most preferred, from the viewpoint of light attenuation properties of an electrophotographic photoreceptor.

m5, n5, p5 and q5 may each independently represent an integer of 0 to 5. Alternatively, m5, n5, p5 and q5 are preferably 0 to 3, from the versatility of the production raw materials, and more preferably 0 to 2, from the viewpoint of electrophotographic photoreceptor properties.

o5 and r5 may each independently represent an integer of 0 to 4. Alternatively, o5 and r5 are preferably 0 to 2, more preferably 0 to 1, and still more preferably 0, from the reason similar to that of the above m5, n5, p5 and q5.

In a case where m5, n5, p5 and q5 are 1 or greater, positions at which $R^{13}$, $R^{14}$, $R^{16}$, $R^{17}$ are respectively substituted on benzene rings may be any of ortho, meta and para positions, relative to the nitrogen atom. Alternatively, the ortho position or the para position is preferred, from the viewpoint of electrophotographic photoreceptor properties. In a case where m5, n5, o5, p5, q5, and r5 are two or greater, one of a plurality of substituents on the same benzene ring is bonded to the adjacent one of the substituents to form a ring structure.

Positions at which two vinyl groups are substituted on a benzene ring having no nitrogen atom as a substituent may be any of the ortho position, the meta position, and the para position. Alternatively, the positions are preferably para positions, from the viewpoint of electrophotographic photoreceptor properties.

The following exemplified compounds can be mentioned as a representative example of the compound represented by the above formula (5). Here, the compounds represented by the formula (5) in the present invention are not limited to these compounds. The charge transport substance may contain one kind of compound represented by the formula (5) as a single component, or may contain a mixture of a plurality of compounds represented by the formula (5), or may contain a mixture of compound(s) represented by the formula (5) and other positive hole transport substances (for example, compounds represented by any one of the formulas (1) to (4)).

(5)-1

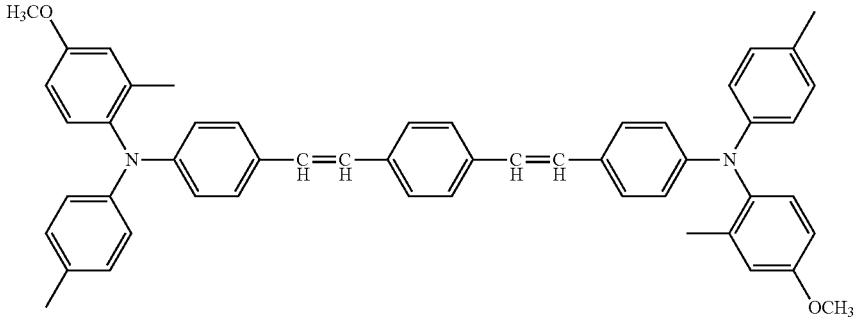

(5)-2

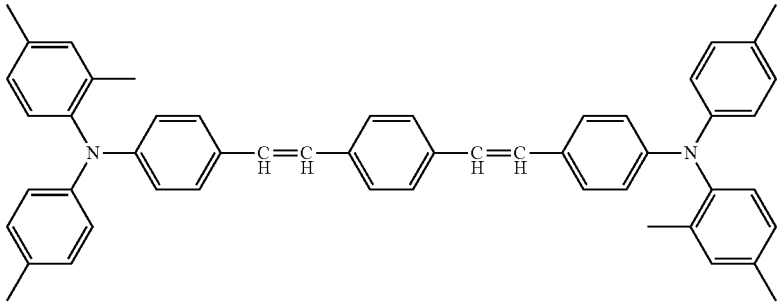

(5)-3

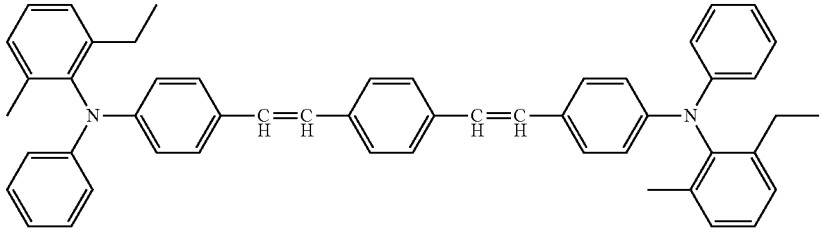

-continued (5)-4

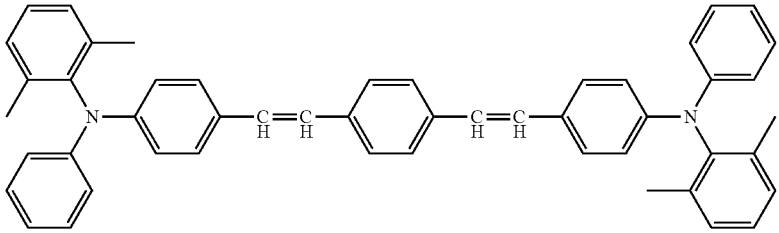

(5)-5

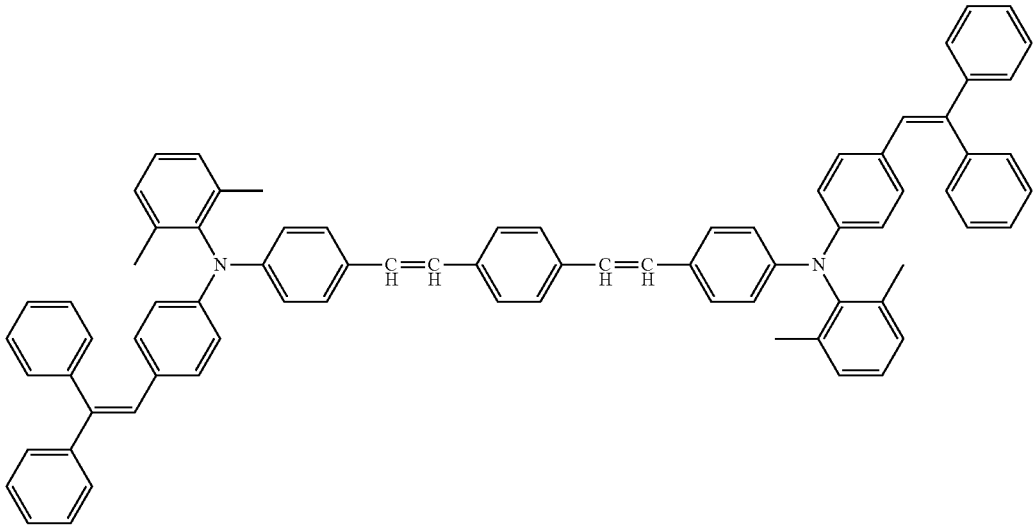

In the above exemplified compounds, (5)-1, (5)-2, and (5)-3 are preferred, and (5)-2 is particularly preferred.

The electrophotographic photoreceptor according to the present invention may contain a compound represented by any one of the formulas (1) to (5) as a single component, or may contain a mixture of compounds represented by any one of the formulas (1) to (5), as a positive hole transport substance.

In the photosensitive layer in the electrophotographic photoreceptor of the present invention, any known positive hole transport substance in addition to the above positive hole transport substance can be used in combination with the above positive hole transport substance. For example, examples of the known positive hole transport substance include a heterocyclic compound such as a carbazole derivative, an indole derivative, an imidazole derivative, an oxazole derivative, a pyrazole derivative, a thiadiazole derivative, and an electron donating substance such as an aniline derivative, a hydrazone derivative, an aromatic amine derivative, a stilbene derivative, a butadiene derivative, an enamine derivative, and a combination of a plurality of kinds of these compounds or a polymer having a group formed of these compounds in a main chain or a side chain.

Among these, preferred are a carbazole derivative, an aromatic amine derivative, a stilbene derivative, a butadiene derivative, an enamine derivative, a hydrazone derivative, and a combination of a plurality of kinds of these compounds.

The total content of the compounds represented by any one of the formulas (1) to (5) is preferably 50% by weight or more relative to the positive hole transport substance, and more preferably 70% by weight or more, from the viewpoint of residual potential. An upper limit is not particularly limited, and may be 100% by weight.

Further, a known electron transport substance can be used as the electron transport substance used in combination with the positive hole transport substance as the charge transport substance. The electron transport substance is not particularly limited as long as the electron transport substance is a known material. Examples thereof include an electron withdrawing substance including an aromatic nitro compound such as 2,4,7-trinitrofluorenone, a cyano compound such as tetracyanoquinodimethane, a quinone compound such as diphenoquinone, a known cyclic ketone compound, and a perylene pigment (perylene derivatives). Compounds represented by the following formulas (I) to (XII) can be exemplified as the electron transport substance. In the formula, t-Bu represents a t-butyl group.

(I)

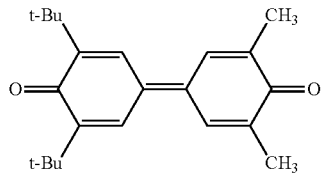

(II)

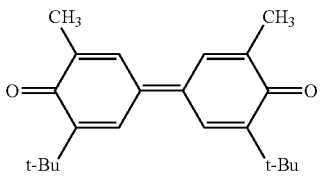

-continued (III)

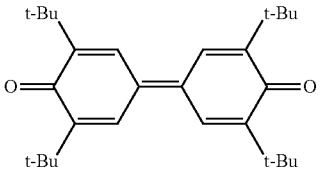

(IV)

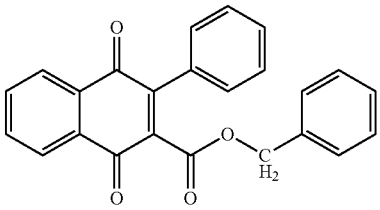

(V)

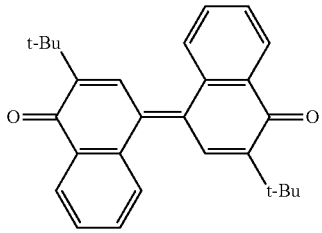

(VI)

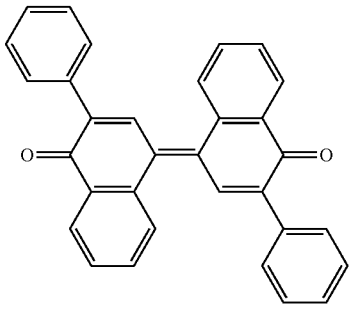

(VII)

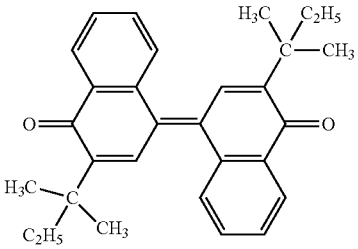

(VIII)

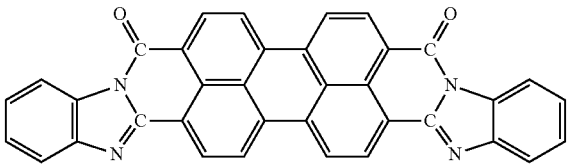

(IX)

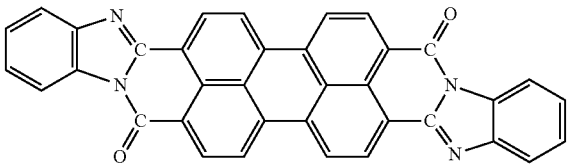

-continued (X)

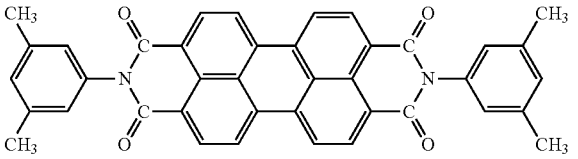

(XI)

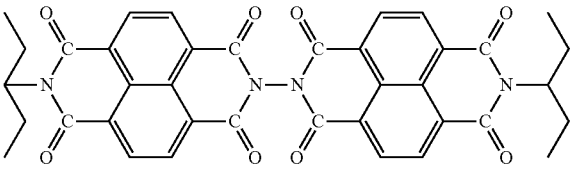

(XII)

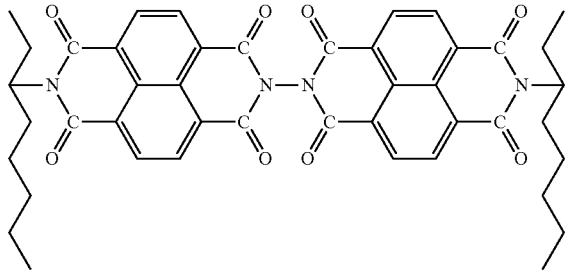

A ratio of the total content of the compound represented by any one of the formulas (1) to (5), which is a positive hole transport substance, to the content of the electron transport substance is preferably 40 parts by weight or less, and more preferably 15 parts by weight or less relative to one part by weight of positive hole transport substance, from the viewpoint of chargeability. Meanwhile, the total content is preferably 0.5 part by weight or more, and more preferably 2 parts by weight or more, from the viewpoint of residual potential.

(Binder Resin)

Next, a binder resin used for the above photosensitive layer will be described. Examples of the binder resin used for the above photosensitive layer include a vinyl polymer such as polymethyl methacrylate, polystyrene, and polyvinyl chloride or a copolymer thereof; a butadiene resin; a styrene resin; a polyvinyl acetate resin; a vinyl chloride resin, and an acrylic ester resin; a methacrylate ester resin; a vinyl alcohol resin; a polymer and a copolymer of vinyl compounds such as ethyl vinyl ether; a polyvinyl butyral resin; a polyvinyl formal resin; a partially modified polyvinyl acetal resin; a polyarylate resin; a polyamide resin; a polyether resin; a cellulose ester resin; a silicone alkyd resin; a poly-N-vinylcarbazole resin; a polycarbonate resin; a polyester resin; a polyester carbonate resin; a polysulfone resin; a polyimide resin; a phenoxy resin; an epoxy resin; a silicone resin; and partially cross-linked cured products of these resins. The above resin may be modified with a silicon reagent or the like. One selected from these may be used alone, or two or more selected from these may be used in any desired ratio and in any desired combination.

In particular, the binder resin preferably contains one or more kinds of polymers obtained by interfacial polymerization. The interfacial polymerization refers to a polymerization method utilizing a polycondensation reaction which proceeds at an interface of two or more solvents (mostly organic solvent-water) which are not mixed with each other.

For example, dicarboxylic acid chloride is dissolved in an organic solvent, a glycol component is dissolved in alkaline water or the like, the two solutions are mixed at room temperature, the mixture is divided into two layers, and polycondensation reaction proceeds at the interface to produce a polymer. Examples of other two components include phosgene and a glycol aqueous solution. As described in a case where polycarbonate oligomers are condensed by interfacial polymerization, two components are not divided into two layers, and the interface may be used as a polymerization site.

Two layers consisting of an organic layer and an aqueous layer are preferably used as reaction solvents in the above interfacial polymerization. Methylene chloride is preferably used as the organic layer, and an alkaline aqueous solution is preferably used as the aqueous layer. In addition, it is preferable to use a catalyst during the above reaction, and the amount of a condensation catalyst used in the reaction is generally 0.005 mol % or more, and preferably 0.03 mol % or more relative to diol, for example, in a case where glycol reacts. In addition, the amount of the condensation catalyst is generally 0.1 mol % or less, and preferably 0.08 mol % or less. When the above range is exceeded, it may take much effort to extract and remove the catalyst in a washing step after polycondensation.

Reaction temperature in the above interfacial polymerization is generally 80° C. or lower, preferably 60° C. or lower, and more preferably 50° C. or lower. The lower limit of the reaction temperature is generally 10° C. When the reaction temperature is too high, side reactions may not be controlled. In contrast, when the reaction temperature is low, the reaction control may be preferred, but the refrigeration load and the cost may be increased accordingly. The reaction time depends on the reaction temperature, the kind of the target composition or the like. Alternatively, the reaction time is generally 0.5 minute or more, and preferably 1 minute or more, and is generally 30 hours or less, and preferably 15 hours or less.

Specifically, the concentration of the reaction component in the organic layer is generally 10% by weight or more, and preferably 15% by weight or more, as long as the composition obtained is in a soluble range. In addition, the concentration of the reaction component is generally 40% by weight or less, and preferably 35% by weight or less. The ratio of the organic layer to the aqueous layer is preferably volume ratio of 0.2 to 1.0. It is preferable that the amount of the solvent is adjusted such that the concentration of the generated resin obtained by the polycondensation in the organic layer is 5% by weight to 30% by weight. Thereafter, an new aqueous layer containing water and alkali metal hydroxide is added, and the initial polycondensation is completed according to the interfacial polycondensation method. At this time, it is preferable to contain a condensation catalyst in order to adjust the polycondensation conditions. It is preferable that the ratio of the aqueous layer to the organic layer during the above polycondensation is 0.2 to 1 of the aqueous layer when the organic layer is 1, as a volume ratio.

As the binder resin obtained by the above interfacial polymerization, a polycarbonate resin and a polyester resin are preferred, and a polycarbonate resin or a polyarylate resin is particularly preferred. In particular, the aromatic diol is preferably a polymer containing an aromatic diol as a raw material, and compounds represented by the following formula (6) can be mentioned as preferred aromatic diol compounds.

FORMULA (6)

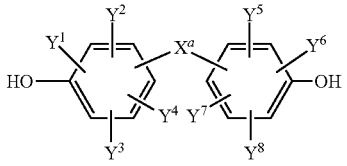

In the above formula (6), $X^a$ is a linking group represented by any one of the following groups, or a single bond.

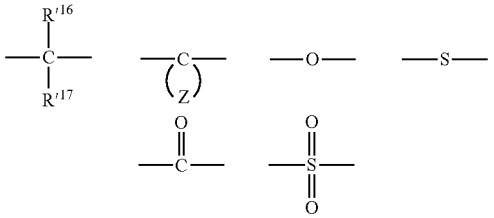

In the above linking group, $R'^{16}$ and $R'^{17}$ each independently represent a hydrogen atom, an alkyl group having 1 to 20 carbon atoms, an aryl group which may be substituted, and a halogenated alkyl group. Z represents a substituted or an unsubstituted carbon ring having 4 to 20 carbon atoms.

In the formula (6), $Y^1$ to $Y^8$ each independently represent a hydrogen atom, a halogen atom, an alkyl group having 1 to 20 carbon atoms, an aryl group which may be substituted, and a halogenated alkyl group.

Further, a polycarbonate resin and a polyarylate resin which contain a bisphenol component or biphenol component having the following structural formula are preferred, from the viewpoint of the sensitivity and residual potential of the electrophotographic photoreceptor, and among them, the polycarbonate resin is more preferred, from the viewpoint of mobility.

This example is performed to clarify the purpose, and is not limited to the exemplified structure as long as the example does not deviate from the purpose of the present invention.

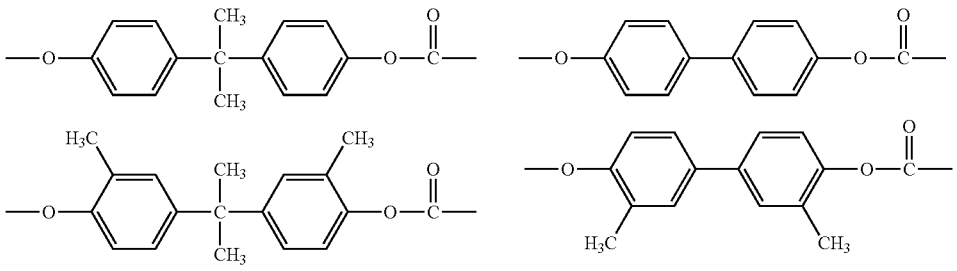

-continued
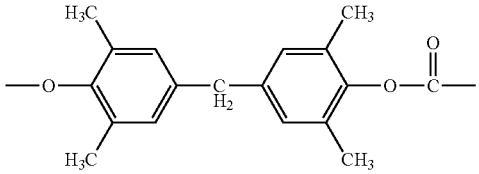
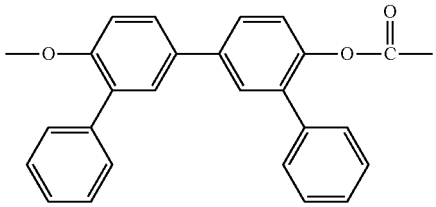
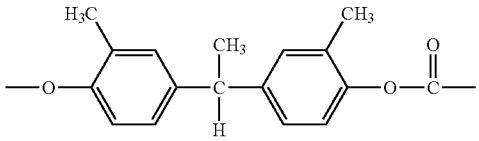
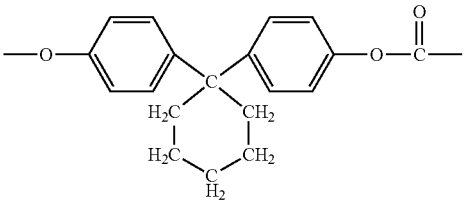
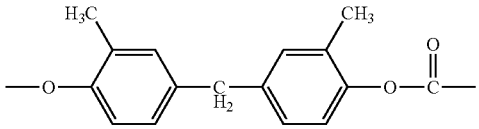
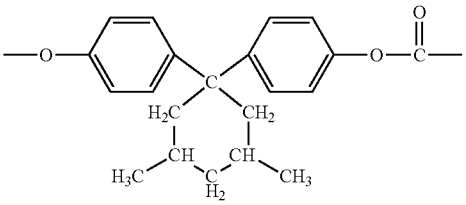
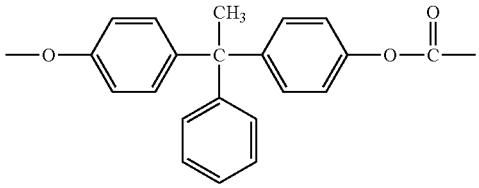
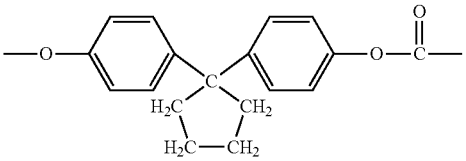
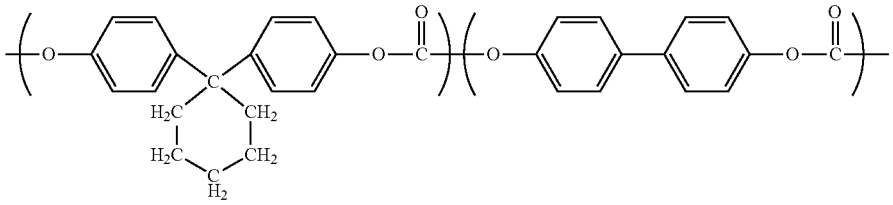
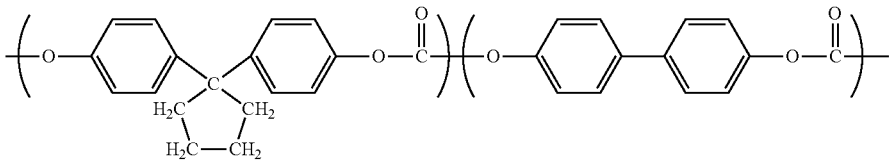
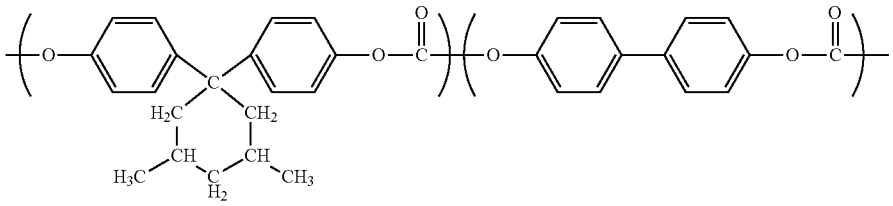
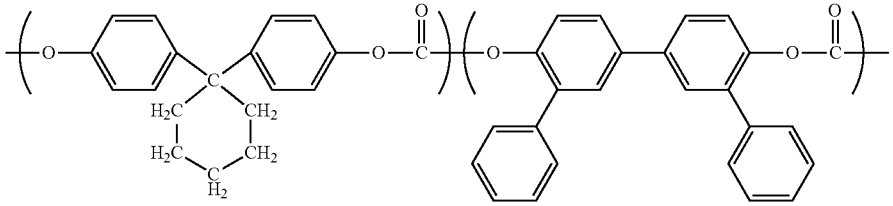
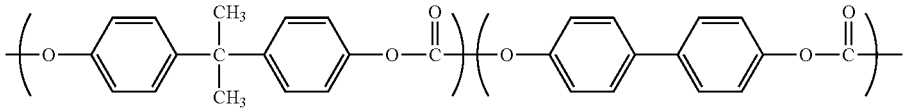

-continued

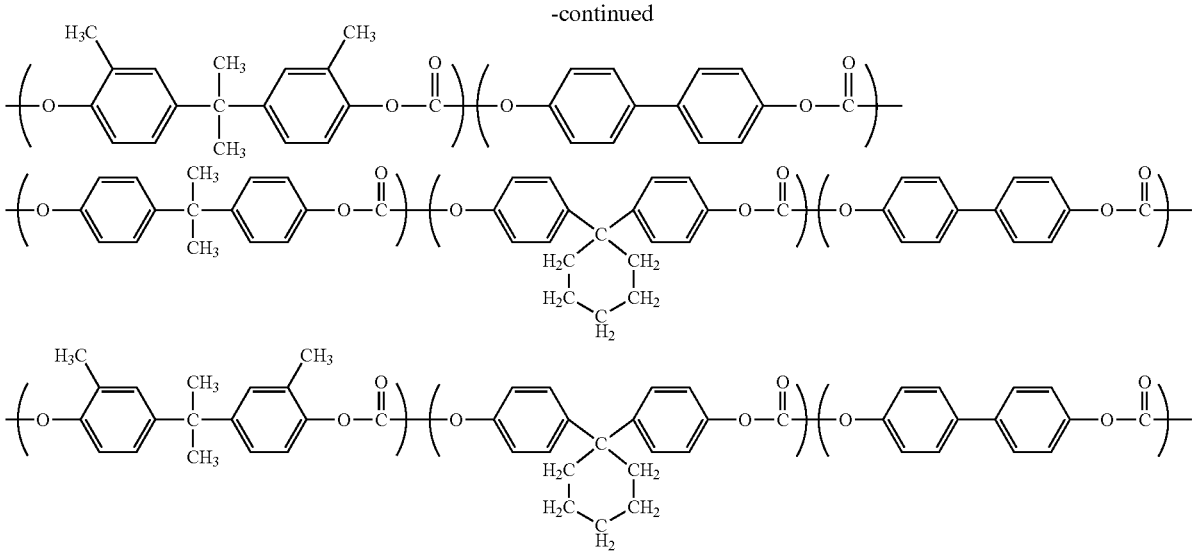

In particular, in order to maximize the effects of the present invention, polycarbonate resins which contain a bisphenol derivative having the following structure are preferred.

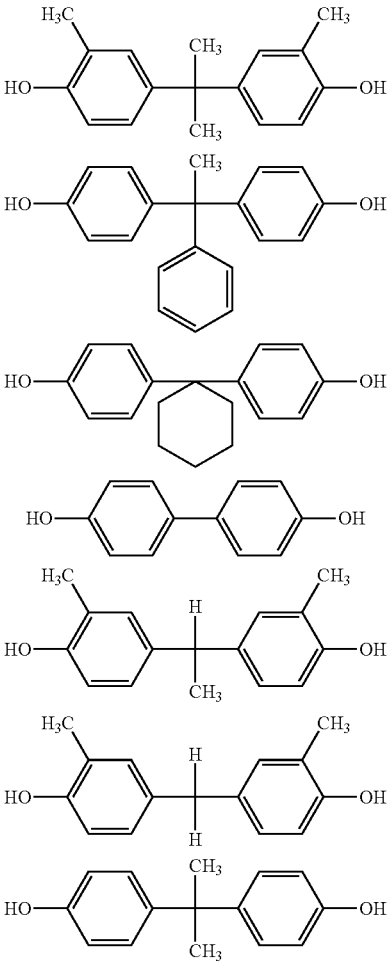

-continued

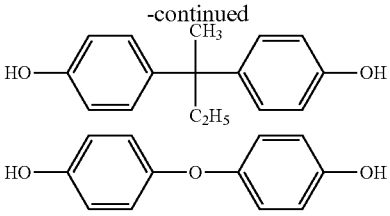

In order to improve mechanical properties, it is preferable to use a polyester resin, particularly a polyarylate resin. In this case, it is preferable to use a compound having the following structure as a bisphenol component.

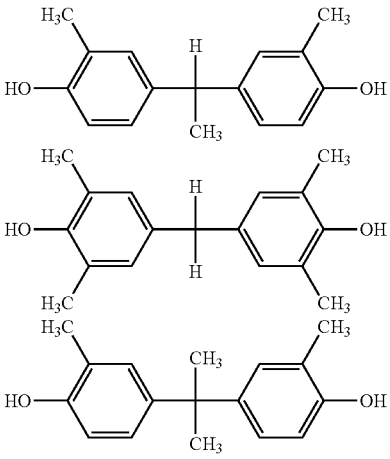

It is preferable to use a compound having the following structure as an acid component.

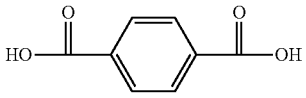

-continued

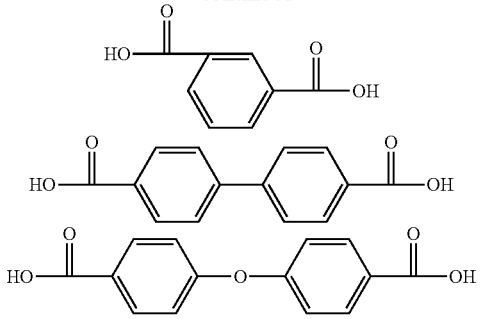

When terephthalic acid and isophthalic acid are used, the molar ratio of terephthalic acid is preferably high, and it is preferable to use a compound having the following structure.

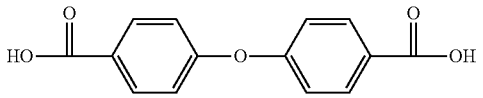

Here, the ratio of a total content of the positive hole transport substance represented by any one of the formulas (1) to (5) to the binder resin is preferably 20 parts by weight or more, more preferably 30 parts by weight or more, from the viewpoint of reduction of residual potential, and still more preferably 40 parts by weight or more, from the viewpoint of stability in repeated use and charge mobility, relative to 100 parts by weight of the binder resin. Meanwhile, the total content is preferably 200 parts by weight or less, more preferably 120 parts by weight or less, from the viewpoint of compatibility between the positive hole transport substance and the binder resin, still more preferably 110 parts by weight or less from the viewpoint of durability during repeated valence image formation, and particularly preferably 100 parts by weight or less, from the viewpoint of scratch resistance of the photosensitive layer. When the amount of the positive hole transport substance is too small, the electrical properties tend to be deteriorated, and when the amount thereof is too large, the coating film becomes brittle and the abrasion resistance tends to be deteriorated.

The electron transport substance and charge generation substance described above, that is, the phthalocyanine compound and/or other charge generation substances, are dispersed in the positive hole transport medium having the blending ratio as described above. The particle diameter of the charge generation substance is preferably sufficiently small, and is generally 1 μm or less and more preferably 0.5 μLM or less. Further, when the amount of the charge generation substance dispersed in the photosensitive layer is too small, sufficient sensitivity may not be obtained, and when the amount is too large, the chargeability and the sensitivity may be reduced. Therefore, the amount of the charge generation substance in the photosensitive layer is preferably 0.1% by weight, and more preferably 0.5% by weight or more, and is preferably 50% by weight or less, and more preferably 20% by weight or less. The amount of the charge generation substance is the total amount of the above-described phthalocyanine compound and/or other charge generation substances.

The using amount of the electron transport substance is not particularly limited. Alternatively, relative to 100 parts by weight of the binder resin in the photosensitive layer, the using amount is preferably 1 part by weight or more, and particularly preferably 2 parts by weight or more from the viewpoint of residual potential, and is preferably 60 parts by weight or less, and particularly preferably 45 parts by weight or less since the printing durability may be reduced.

(Other Substances)

In order to improve film forming properties, flexibility, coating properties, contamination resistance, gas resistance, light resistance, the photosensitive layer may contain additives such as known antioxidants, plasticizers, ultraviolet absorbers, electron withdrawing compounds, leveling agents, and visible light blocking agents, in addition to the above materials. The photosensitive layer may contain, if necessary, various additives such as leveling agents for improving the coating properties, antioxidants, sensitizers, dyes, pigments, and surfactants. Examples of the dyes and the pigments include various pigment compounds and azo compounds, and examples of the surfactants include silicone oil and fluorine-based oil. One selected from these may be appropriately used alone, or two or more selected from these may be used in any desired ratio and in any desired combination.

In order to reduce the frictional resistance or wear of the surface of the electrophotographic photoreceptor, the surface layer of the photosensitive layer may contain a fluororesin, a silicone resin or the like, and may contain particles formed of these resins or particles of inorganic compounds such as aluminum oxide.

Here, it is preferable that the following antioxidant and electron withdrawing compounds are particularly contained in the photosensitive layer in the present invention.

<Antioxidant>

An antioxidant is one kind of stabilizer used to prevent oxidation of the electrophotographic photoreceptor according to the present invention.

The antioxidant may be one having a function as a radical scavenger, and specific examples thereof include phenol derivatives, amine compounds, phosphonic acid esters, sulfur compounds, vitamins, vitamin derivatives, or the like.

Among the specific examples thereof, phenol derivatives, amine compounds, and vitamins are preferred. Hindered phenols or trialkylamine derivatives having a bulky substituent near the hydroxy group are more preferred.

In addition, an aryl compound derivative having a t-butyl group at an o-position relative to the hydroxy group, and an aryl compound derivative having two t-butyl groups at o-positions relative to the hydroxy group are particularly preferred.

When the molecular weight of the antioxidant is too large, the antioxidant ability may be lowered, and a compound having a molecular weight of 1500 or less and particularly 1000 or less is preferred. As the lower limit, the molecular weight of the antioxidant is generally 100 or more, preferably 150 or more, and more preferably 200 or more.

Hereinafter, an antioxidant which can be used in the present invention will be shown. As the antioxidant which can be used in the present invention, all materials known as antioxidants for plastics, rubber, petroleum, and oils and fats, ultraviolet light absorbers, and light stabilizers can be used. Among them, materials selected from the following compound groups <1> to <8> can be preferably used. In the present invention, one selected from the antioxidants may be appropriately used alone, or two or more selected from the antioxidants may be used in any desired ratio and in any desired combination.

<1> Phenols described in JP-A-S57-122444, phenol derivatives described in JP-A-S60-188956, and hindered phenols described in JP-A-S63-18356.

<2> Paraphenylene diamines described in JP-A-S57-122444, paraphenylene diamine derivatives described in JP-A-S60-188956, and paraphenylene diamines described in JP-A-S63-18356.

<3> Hydroquinones described in JP-A-S57-122444, hydroquinone derivatives described in JP-A-S60-188956, and hydroquinones described in JP-A-S63-18356.

<4> Sulfur compounds described in JP-A-S57-188956, and organic sulfur compounds described in JP-A-S63-18356.

<5> Organophosphorus compounds described in JP-A-S57-122444, and organophosphorus compounds described in JP-A-S63-18356.

<6> Hydroxyanisoles described in JP-A-S57-122444

<7> Piperidine derivatives and oxopiperazine derivatives having a specific skeleton structure described in JP-A-S63-18355.

<8> Carotenes, amines, tocopherols, Ni (II) complexes, sulfides, or the like described in JP-A-S60-188956.

In particular, the hindered phenols shown below are preferred. Hindered phenols refer to phenols having a bulky substituent near a hydroxy group.

Specific examples thereof include dibutylhydroxytoluene, 2,2'-methylenebis (6-t-butyl-4-methylphenol), 4,4'-butylidenebis (6-t-butyl-3-methylphenol), 4,4'-thiobis (6-t-butyl-3-methylphenol), 2,2'-butylidenebis (6-t-butyl-4-methylphenol), α-tocophenol, β-tocophenol, 2,2,4-trimethyl-6-hydroxy-7-t-butylchroman, pentaerythritol tetrakis [3-(3,5-di-t-butyl-4-hydroxyphenyl) propionate], 2,2'-thiodiethylene bis[3-(3,5-di-t-butyl-4-hydroxyphenyl) propionate], 1,6-Hexanediol bis [3-(3,5-di-t-butyl-4-hydroxyphenyl) propionate], butyl hydroxyanisole, dibutyl hydroxyanisole, octadecyl-3,5-di-tert-butyl-4-hydroxyhydrocinnamate, 1,3,5-trimethyl-2,4,6-tris-(3,5-di-tert-butyl-4-hydroxybenzyl)-benzene, or the like.

Among the above mentioned hindered phenols, octadecyl-3,5-di-tert-butyl-4-hydroxyhydrocinnamate or 1,3,5-trimethyl-2,4,6-tris-(3,5-di-tert-butyl-4-hydroxybenzyl)-benzene is more preferred particularly.

These compounds are known as antioxidants for rubbers, plastics, and oils and fats, and some are commercially available.

The using amount of the above antioxidants is not particularly limited. Alternatively, the using amount is generally 0.1 part by weight or more, and preferably 1 part by weight or more, per 100 parts by weight of binder resin in the photosensitive layer. In order to obtain good electrical properties, the using amount is generally 25 parts by weight or less. However, the using amount is preferably 15 parts by weight or less and more preferably 10 parts by weight or less, since not only the electrical properties but also the printing durability may be reduced when the amount of the antioxidant is too large.

<Electron Withdrawing Compound>

The electrophotographic photoreceptor according to the present invention may include an electron withdrawing compound, and the electron withdrawing compound is particularly preferably contained in the photosensitive layer.

Specific examples of the electron withdrawing compound include sulfonic acid ester compounds, carboxylic acid ester compounds, organic cyano compounds, nitro compounds, aromatic halogen derivatives, or the like, in which sulfonic acid ester compounds and organic cyano compounds are preferred, and sulfonic acid ester compounds is particularly preferred. Only one selected from the above electron withdrawing compounds may be used alone, and two or more selected from the electron withdrawing compounds may be used in any desired ratio or in any desired combination.

It is understood that the electron withdrawing ability of the electron withdrawing compound can be predicted by the value of LUMO (hereinafter, referred to as LUMOcal as appropriate). In the present invention, the values of LUMO of the above electron withdrawing compounds are not particularly limited to values of LUMOcal according to structural optimization using semi-empirical molecular orbital calculation in which PM3 parameters are used (hereinafter, the expression may be described simply as a semi-empirical molecular orbital calculation). Alternatively, the compound whose value of LUMO is −0.5 eV to −5.0 eV is preferred. The absolute value of LUMOcal is more preferably 1.0 eV or greater, still more preferably 1.1 eV or greater, and particularly preferably 1.2 eV or greater. The absolute value of LUMOcal is more preferably 4.5 eV or less, still more preferably 4.0 eV or less, and particularly preferably 3.5 eV or less. When the absolute value of LUMOcal is in the above range, the balance between the electron withdrawing effect and charging is appropriate.

The following compounds are mentioned as a compound whose absolute value of LUMOcal is in the above range.

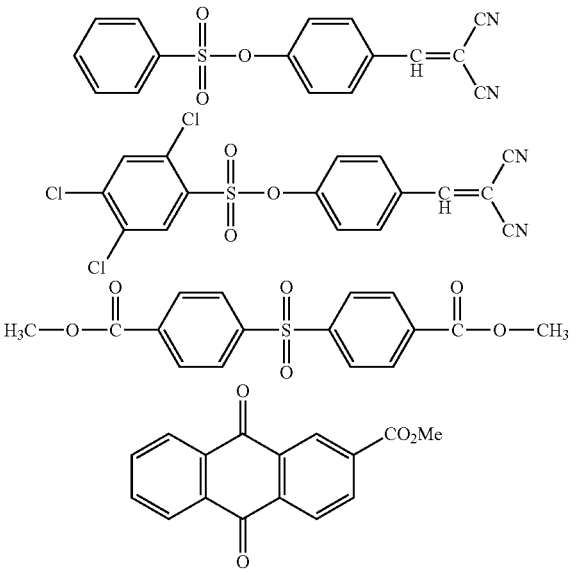

The amount of the electron withdrawing compounds used in the electrophotographic photoreceptor in the present invention is not particularly limited. Alternatively, when the above electron withdrawing compound is used in the photosensitive layer, the total amount of the electron withdrawing compounds per 100 parts by weight of the binder resin contained in the photosensitive layer is preferably 0.01 part by weight or more, and more preferably 0.1 part by weight or more. In addition, in order to obtain good electrical properties, the total amount of the electron withdrawing compounds is preferably 50 parts by weight or less. The amount of the electron withdrawing compounds is more preferably 40 parts by weight or less, and still more preferably 30 parts by weight or less, since not only the electrical properties but also the printing durability may be reduced when the amount of the electron withdrawing compounds is too large.

(Method of Forming Photosensitive Layer)

Next, a method of forming the photosensitive layer will be described. The method of forming the photosensitive layer is not particularly limited. Alternatively, for example, the photosensitive layer can be formed by dispersing the charge generation substance into a coating liquid, which is obtained by dissolving (or dispersing) a charge transport substance, a binder resin, and other substances into a solvent (or dispersion medium), and applying the coating liquid to a conductive support (on these intermediate layers in the case of providing an intermediate layer such as an undercoat layer described below).

Hereinafter, the solvent or dispersion medium used for forming the photosensitive layer, and the coating method will be described.

<Solvent or Dispersion Medium>

Examples of a solvent or dispersion medium used for forming a photosensitive layer include alcohols such as methanol, ethanol, propanol, and 2-methoxyethanol; ethers such as tetrahydrofuran, 1,4-dioxane, and dimethoxyethane; esters such as methyl formate and ethyl acetate; ketones such as acetone, methyl ethyl ketone and cyclohexanone; aromatic hydrocarbons such as benzene, toluene and xylene; chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichlorethylene; nitrogen-containing compounds such as n-butylamine, isopropanolamine, diethylamine, triethanolamine, ethylene diamine, and triethylenediamine; and aprotic polar solvents such as acetonitrile, N-methyl pyrrolidone, N,N-dimethylformamide, and dimethyl sulfoxide. One selected from these may be used alone, or two or more selected from these may be used in any desired ratio and in any desired combination.

<Coating Method>

Examples of a coating method of the coating liquid for forming a photosensitive layer include a spray coating method, a spiral coating method, a ring coating method, a dip coating method, or the like.

Examples of the spray coating method include air spray, airless spray, electrostatic air spray, electrostatic airless spray, rotary atomization electrostatic spray, hot spray, hot airless spray, or the like. Considering the degree of atomization and adhesion efficiency to obtain uniform film thickness, the rotary atomization electrostatic spray in which a transport method disclosed in WO 1-805198, that is, a method in which a cylindrical workpiece is rotated and continuously transported without spacing in the axial direction, is preferred. As a result, it is possible to obtain a photosensitive layer, which has comprehensively high adhesion efficiency and is excellent in uniformity of film thickness.

Examples of the spiral coating method include a method disclosed in JP-A-S52-119651 in which a pouring or curtain coating machine is used, a method disclosed in JP-A-H1-231966 in which the paint is allowed to fly in streaks continuously from a small opening, and a method disclosed in JP-A-H3-193161 in which a multi-nozzle body is used.

In the dip coating method, the total solid concentration of the coating solution or dispersion liquid is preferably 5% by weight or more, and more preferably 10% by weight or more. In addition, the total solid concentration is preferably 50% by weight or less, and more preferably 35% by weight or less.

The viscosity of the coating solution or dispersion liquid is preferably 50 mPa s or higher, and more preferably 100 mPa s or higher. The viscosity thereof is preferably 700 mPa s or lower, and more preferably 500 mPa s or lower. Accordingly, a photosensitive layer excellent in uniformity of film thickness can be obtained.

The coating film is formed by the above coating method, and then the coating film is dried. Alternatively, it is preferable that the temperature and the time of the drying are adjusted so as to perform the necessary and sufficient drying.

When the drying temperature is too high, air bubbles may be mixed into the photosensitive layer, and when the drying temperature is too low, drying may take time, and the amount of residual solvent may increase, which affects the electrical properties. Therefore, the drying temperature is generally 100° C. or higher, preferably 110° C. or higher, and more preferably 120° C. or higher. In addition, the drying temperature is generally 250° C. or lower, preferably 170° C. or lower, and more preferably 140° C. or lower. The temperature may be changed stepwise.

A hot air dryer, a steam dryer, an infrared dryer, a far infrared dryer, or the like can be used for a drying method.

A protective layer described below is provided on the photosensitive layer in the present invention, so that only air drying at room temperature may be performed after application of the photosensitive layer, and heat drying in the above method may be performed after applying the protective layer.

The thickness of the photosensitive layer is appropriately selected depending on the material to be used. Alternatively, the thickness is preferably 5 μm or more, more preferably 10 μM or more, and particularly preferably 15 μm or more, from the viewpoint of the lifespan. In addition, the thickness is preferably 100 μm or less, more preferably 50 μm or less, and particularly preferably 30 μm or less, from the viewpoint of electrical properties.

<Protective Layer>

Next, a protective layer used for the photoreceptor according to the present invention will be described. The protective layer used in the present invention is formed on the above photosensitive layer.

It is preferable to use an alcohol-soluble thermoplastic resin as a binder resin from the viewpoint that as a material used for the protective layer, it is excellent in mechanical strength, easy to form a film, and does not impair the properties of the photosensitive layer. It is more preferably that a protective layer contains particles of metal oxide.

Hereinafter, suitable materials (binder resin, particles of metal oxide) used for the protective layer will be described.

<Binder Resin>

The binder resin used for the protective layer according to the present invention is thermoplastic, and is soluble in alcohol. In the present invention, the binder resin "soluble in alcohol" refers to a resin satisfying one or more conditions of the following (A) to (C).

(A) A resin which dissolves in an amount of 1% by mass or more in the whole methanol solution at a temperature of 25° C. to 60° C. under normal pressure.

(B) A resin which dissolves in an amount of 1% by mass or more in the whole ethanol solution at any temperature selected from 25° C. to 60° C. under normal pressure.

(C) A resin which dissolves in an amount of 1% by mass or more in the whole 1-propanol solution at any temperature selected from 25° C. to 60° C. under normal pressure.

The binder resin is preferably a resin whose saturated water absorption rate is 5% or lower, and more preferably a resin whose saturated water absorption rate is 3% or lower, from the viewpoint of image defects. As the lower limit, the saturated water absorption rate is generally 0.5% or higher, and preferably 1% or higher, from the viewpoint of electrical properties. The lower the saturated water absorption rate is, the larger the surface resistivity becomes, and the effect of preventing the image flow can be obtained.

Examples of the resin which is thermoplastic and is soluble in alcohol include a polyamide resin, a polyvinyl acetal resin, a urethane resin, a polyvinyl alcohol resin, or the like. A polyamide resin and a polyvinyl acetal resin are preferably contained from the viewpoint of the water absorption rate, and a polyamide resin is more preferably contained from the viewpoint of coating film strength.

Examples of the polyamide resin include alcohol-soluble nylon resins such as chemically modified nylon, e.g., a copolymerized nylon obtained by copolymerizing 6-nylon, 66-nylon, 610-nylon, 11-nylon, and 12-nylon, N-alkoxymethyl modified nylon, and N-alkoxyethyl modified nylon.

Specific products include "CM4000" and "CM8000" (all manufactured by Toray Industries, Inc.), "F-30K", "MF-30" and "EF-30T" (all manufactured by Nagase ChemteX Corporation), or the like.

Specifically, the polyimide resin is preferably obtained by polymerizing components derived from a di- or tricarboxylic acid, a lactam compound, an aminocarboxylic acid, a diamine, or the like.

The number of carbon atoms of the di- or tricarboxylic acid is generally 2 to 32, preferably 2 to 26, and more preferably 2 to 22, from the viewpoint of economic efficiency and ease of acquisition. Examples thereof include saturated aliphatic di- or tricarboxylic acid such as oxalic acid, malonic acid, succinic anhydride, maleic anhydride, glutaric acid, adipic acid, pimelic acid, suberic acid, azelaic acid, sebacic acid, dodecanedioic acid, 1,16-hexadecanedicarboxylic acid, and 1,18-octadecanedicarboxylic acid; aliphatic monounsaturated fatty acid such as phthalic acid, isophthalic acid, terephthalic acid, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, and eicosenoic acid; and diunsaturated fatty acid such as decadiene acid, undecadienoic acid, dodecadienoic acid, tridecadienoic acid, tetradecadienoic acid, pentadecadienoic acid, hexadecadienoic acid, heptadecadienoic acid, octadecadicnoic acid, nonadecadienoic acid, eicosadienoic acid, and docosadienic acid. One or two or more selected from these can be used.

Adipic acid, suberic acid, azelaic acid, sebacic acid, and dodecanedioic acid are preferred, and adipic acid is preferred, from economic efficiency and ease of acquisition.

The lower limit of the total component ratio of di- or tricarboxylic acid is generally 0 mol %, preferably 3 mol %, more preferably 5 mol %, and particularly preferably 10 mol % of the total polyamide components. The upper limit thereof is generally 50 mol %, preferably 45 mol %, more preferably 40 mol %, and particularly preferably 30 mol % of the total polyamide components.

The number of carbon atoms of the lactam compound and the aminocarboxylic acid is generally 2 to 20, preferably 4 to 16, and more preferably 6 to 12, from the viewpoint of economic efficiency and ease of acquisition. Examples thereof include a lactam compound such as α-lactam, β-lactam, γ-lactam, δ-lactam, ε-lactam (caprolactam), ω-lactam (lauryl lactam, dodecane lactam), an amino carboxylic acid such as 6-aminocaproic acid, 7-aminoheptanoic acid, 9-aminononanoic acid, 11-aminoundecanoic acid, and 12-aminododecanoic acid. One or two or more selected from these can be used.

Caprolactam, dodecane lactam, 11-aminoundecanoic acid, and 12-aminododecanoic acid are preferred, from economic efficiency and ease of acquisition.

The lower limit of the total component ratio of the lactam compound and aminocarboxylic acid is generally 0 mol %, preferably 3 mol %, more preferably 5 mol %, and particularly preferably 10 mol % of the total polyamide components. The upper limit thereof is generally 50 mol %, preferably 45 mol %, more preferably 40 mol %, and particularly preferably 30 mol % of the total polyamide components.

The number of carbon atoms of the diamine is generally 2 to 32, preferably 2 to 26, and more preferably 2 to 20, from the viewpoint of economic efficiency and ease of acquisition. Examples thereof include linear methylene diamines such as ethylene diamine, trimethylene di amine, tetramethylene diamine, pentamethylene diamine, hexamethylenediamine, hepta methylene diamine, octamethylene diamine, nona methylene diamine, decamethylene diamine, undecamethylenediamine, dodeca methylene diamine, trideca methylene diamine, tetradecamethylene diamine, pentadecamethylenediamine, hexadecamethylene diamine, hepta deca methylene diamine, octadecamethylenediamine, nonadeca methylene diamine, and eicosa methylene diamine, branched methylene diamines such as 2-/3-methyl-1,5-pentanediamine, 2-methyl-1,8-octanediamine, trimethylhexamethylene diamine, and 5-methyl-1,9-nonanediamine, diamine having a cycloalkane cyclic structure (cyclic diamine) such as cyclopentane, cyclohexane, cycloheptane, cyclooctane, cyclononane, and cyclodecane, unsubstituted or substituted piperazine such as piperazine, 2,5-dimethyl piperazine, 2,5-diethylpiperazine, 2,5-di-n-propyl piperazine, 2,5-diisopropylpiperazine, 2,5-di-n-butyl piperazine, 2,5-di-t-butylpiperazine, and 2,5-piperazinedione. One or two or more selected from these can be used.

From the viewpoint of economic efficiency and ease of acquisition, linear methylene diamines and/or cyclic diamines are preferred, among which cyclic diamines are more preferred, and diamines having a cyclohexane ring are particularly preferred.

The lower limit of the total component ratio of the diamine is generally 0 mol %, preferably 5 mol %, more preferably 10 mol %, and particularly preferably 20 mol % of the total diamine components. The upper limit thereof is generally 90 mol %, preferably 70 mol %, more preferably 60 mol %, and particularly preferably 40 mol % of the total diamine components.

Among these polyamide resins, a polyamide resin which contains a structure represented by the following formula (7) can be particularly preferably used due to good environmental stability thereof.

FORMULA (7)

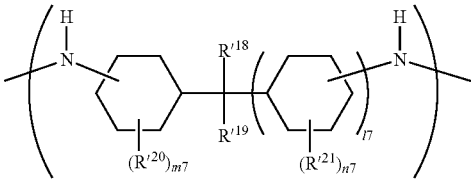

In the formula (7), $R'^{18}$ to $R'^{21}$ each independently represent a hydrogen atom and an organic substituent. 17 represents an integer of 0 to 2. m7 and n7 each independently represent an integer of 0 to 4, and when m7 and n7 are integers of 2 or greater, a plurality of $R'^{20}$ and $R'^{21}$ may be different from each other.

The organic substituent represented by $R'^{18}$ to $R'^{21}$ is preferably a hydrocarbon group which has 20 or less carbon atoms and may contain a hetero atom, more preferably an alkyl group such as a methyl group, an ethyl group, a n-propyl group, and an isopropyl group; an alkoxy group such as a methoxy group, an ethoxy group, a n-propoxy group and an isopropoxy group; an aryl group such as a phenyl group, a naphthyl group, an anthryl group, and a pyrenyl group, and still more preferably an alkyl group or an alkoxy group. Particularly preferred are a methyl group and an ethyl group.

The following structure among the structures represented by the formula (7) is preferred.

(7-1)

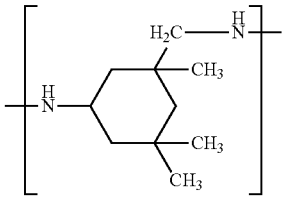

(7-2)

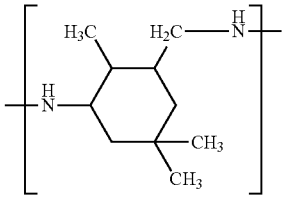

(7-3)

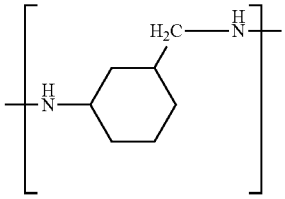

(7-4)

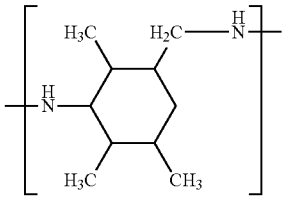

(7-5)

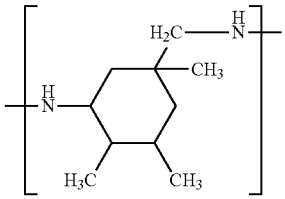

(7-6)

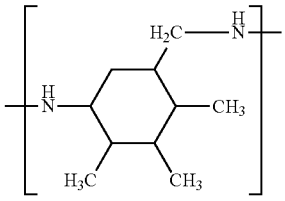

-continued (7-7)

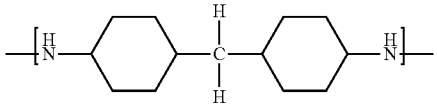

(7-8)

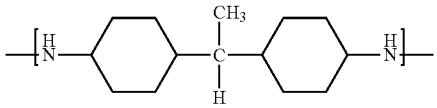

(7-9)

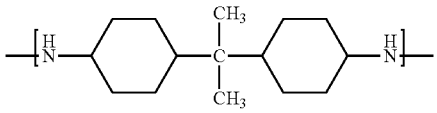

(7-10)

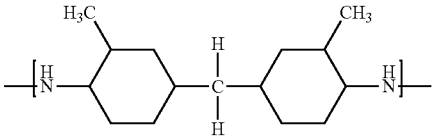

(7-11)

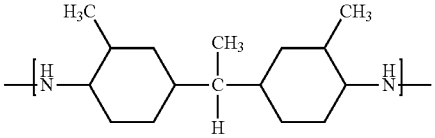

(7-12)

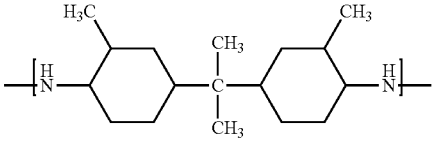

(7-13)

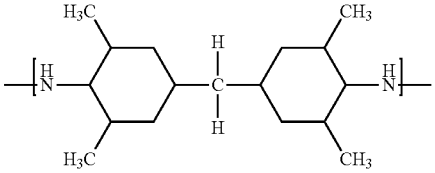

(7-14)

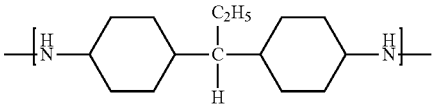

(7-15)

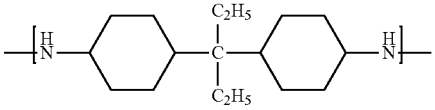

(7-16)

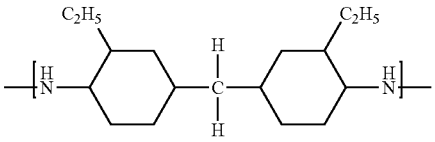

(7-17)

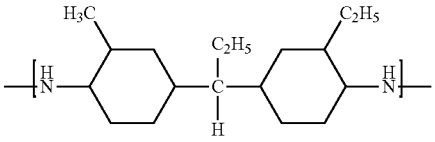

-continued (7-18)

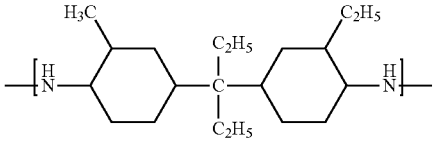

Among the above specific examples, structures represented by formulas (7-1), (7-4), (7-7), (7-8), (7-9), (7-10), (7-11), and (7-12) are more preferably contained, and structures represented by formulas (7-7), (7-8) and (7-10) are still more preferably contained, from the viewpoint of ease of synthesis and solubility of the formed polyamide resin in the solvent.

The polyamide resin containing the structure represented by the formula (7) is preferably a copolymer of above polyamide resin and a compound having other repeating units.

Other repeating units are not particularly limited, and examples thereof include a repeating unit, which is obtained by combining lactams such as γ-butyrolactam, ε-caprolactam, and lauryl lactam; dicarboxylic acids such as 1,4-butanedicarboxylic acid, 1,12-dodecanedicarboxylic acid, 1,20-icosan dicarboxylic acid; diamines such as 1,4-butanediamine, 1,6-hexamethylene diamine, 1,8-octamethylenediamine, 1,12-dodecane diamine; and piperazine, and copolymerizing them into a bipolymer, a terpolymer, and a quaternary polymer, or the like.

Examples of the structure other than the structure represented by the formula (7) in the copolymerized polyamide resin include structures represented by the following formulas (8-1) to (8-4). n8 in formulas (8-1) to (8-3) is not particularly limited. Alternatively, n8 is generally an integer of 1 or greater, preferably an integer of 3 or greater, and more preferably an integer of 5 or greater. On the other hand, n8 is generally an integer of 30 or less, preferably an integer of 22 or less, more preferably an integer of 14 or less, and still more preferably an integer of 9 or less. It is preferable that n8 is in the above range since a low water absorption rate can be maintained, and further a stable coating solution with good dispersibility is obtained in a case where the protective layer contains particles of metal oxide.

(8-1)

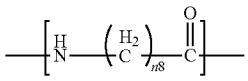

(8-2)

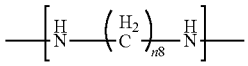

(8-3)

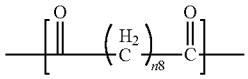

(8-4)

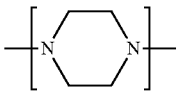

The combination of the repeating units in the copolymerized polyamide resin is not particularly limited. Alternatively, specific examples include combinations of structures shown in the following (PA-1) to (PA-8).

(PA-1)

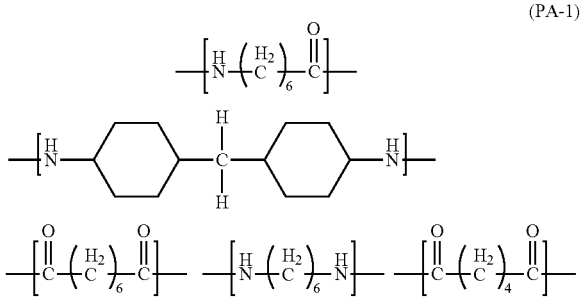

(PA-2)

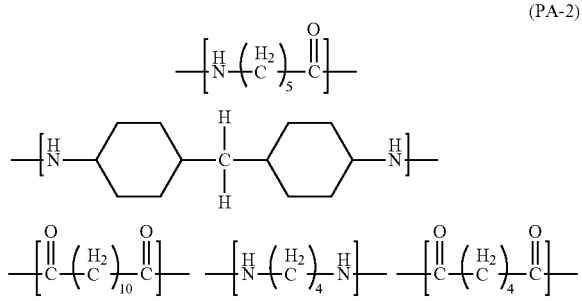

(PA-3)

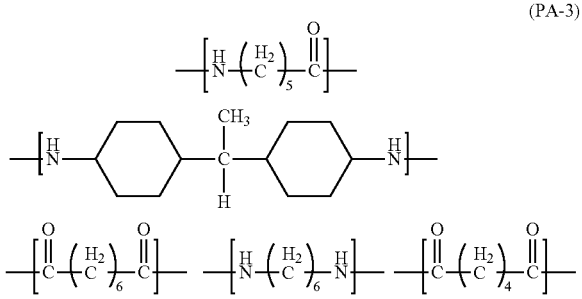

(PA-4)

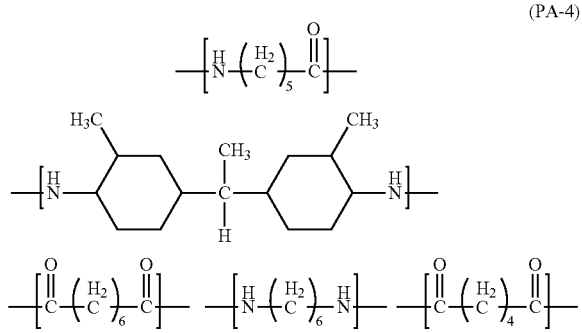

(PA-5)

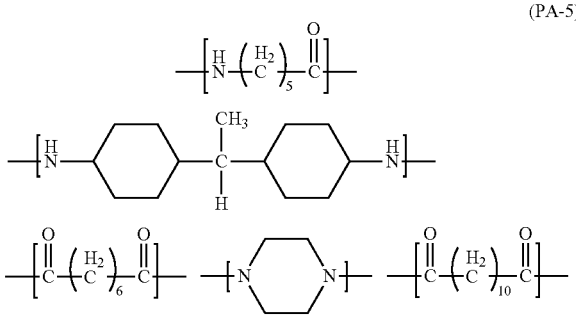

(PA-6)

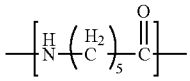

-continued

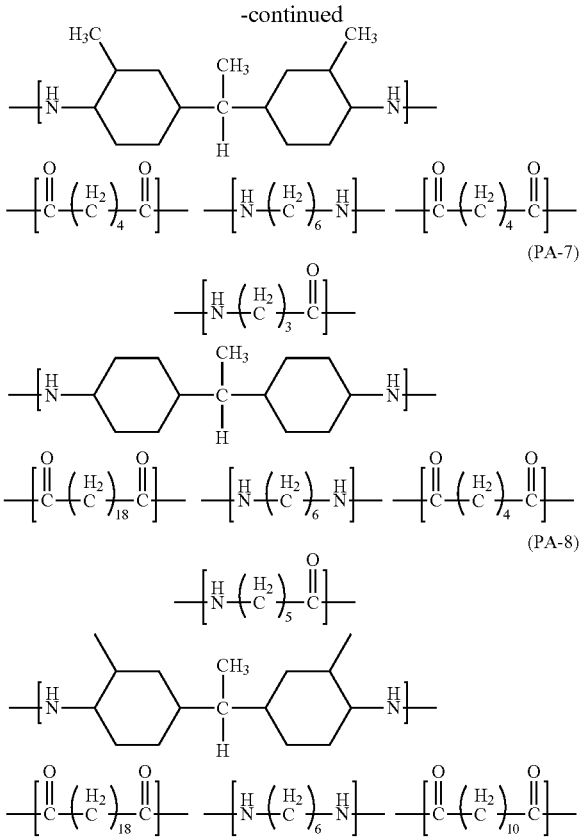

(PA-7)

(PA-8)

The copolymerization ratio is not particularly limited. Alternatively, the diamine component having the structure represented by the formula (7) is preferably 5 mol % or more, more preferably 8 mol % or more, and more preferably 10 mol % or more, and particularly preferably 12 mol % or more in the entire constituent components of the copolymerized polyamide resin. On the other hand, the diamine component is preferably 45 mol % or less, more preferably 40 mol % or less, still more preferably 35 mol % or less, particularly preferably 30 mol % or less, and most preferably 25 mol % or less therein. It is preferable that the diamine component is in the above range since the balance between the environmental dependence of the photoreceptor and the stability of the coating solution is good.

The number average molecular weight of the copolymerized polyamide resin is preferably 10000 or more, and more preferably 15000 or more. On the other hand, the number average molecular weight thereof is preferably 50000 or less, and more preferably 35000 or less. It is preferable that the number average molecular weight of the copolymerized polyamide resin is in the above range since the uniformity of the film can be easily maintained.

The manufacturing method of the copolymerized polyamide resin is not limited, and a normal polycondensation method of the polyamide resin is applied appropriately, for example, a melt polymerization method, a solution polymerization method, and an interfacial polymerization method can be used. In addition, during polymerization, monobasic acids such as acetic acid and benzoic acid, or monoacidic bases such as hexylamine and aniline may be added as molecular weight modifiers.

It is also possible to add thermal stabilizers such as sodium phosphite, sodium hypophosphite, phosphorous acid, hypophosphorous acid and hindered phenols and other polymerization additives.

<Particles of Metal Oxide>

The protective layer according to the present invention may contain particles of metal oxide.

In general, any particles of metal oxide usable for an electrophotographic photoreceptor can be used as the particles of metal oxide. Specific examples of the particles of metal oxide include particles of a metal oxide containing one metallic element, such as titanium oxide, aluminum oxide, silicon oxide, zirconium oxide, zinc oxide, and iron oxide, and particles of a metal oxide containing a plurality of metallic elements, such as calcium titanate, strontium titanate, and barium titanate. Among these, particles of metal oxide whose band gap are 2 to 4 eV is preferred. One kind of those particles of metal oxide may be used alone, or two or more kinds of those particles of metal oxide may be mixed together and used.

Among these particles of metal oxide, titanium oxide, aluminum oxide, silicon oxide, and zinc oxide are preferred, titanium oxide and aluminum oxide are more preferred, and titanium oxide is particularly preferred.

As the crystal form of the titanium oxide particles, any of rutile, anatase, brookite, and amorphous can be used. In addition, a plurality of crystalline states may be included since crystalline states of these crystal forms are different from each other.

The surface of the particles of metal oxide may be subjected to various surface treatments, and is preferably surface-treated with an organometallic compound. Treatment with an inorganic substance such as tin oxide, aluminum oxide, antimony oxide, zirconium oxide, and silicon oxide, or an organic substance such as stearic acid, a polyol, and an organic silicon compound may be performed. In particular, in the case of using titanium oxide particles, the surface is preferably to be surface-treated with an organic silicon compound.

As the organic silicon compound, silicone oil such as dimethylpolysiloxane and methyl hydrogen polysiloxane, organosilanes such as methyldimethoxysilane and diphenyldimethoxysilane, silazanes such as hexamethyldisilazane, silane coupling agents such as vinyltrimethoxysilane, γ-mercaptopropyltrimethoxysilane, and γ-aminopropyltriethoxysilane are generally used. Alternatively, the silane treatment agent represented by the structure of the following formula (8) has good reactivity with the particles of metal oxide, and is the best treatment agent.

FORMULA (8)

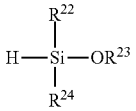

In formula (8), $R^{22}$ and $R^{23}$ each independently represent an alkyl group, and preferably a methyl group and an ethyl group. $R^{24}$ represents an alkyl group or an alkoxy group, and more preferably represents a group selected from the group consisting of a methyl group, an ethyl group, a methoxy group, and an ethoxy group.

The outermost surface of the surface-treated particles of metal oxide is treated with such a treating agent. Alternatively, the outermost surface may be treated with a treating agent such as aluminum oxide, silicon oxide, and zirconium oxide before the treatment. One kind of those particles of metal oxide may be used alone, or two or more kinds of those particles of metal oxide may be mixed together and used.

The particles of metal oxide to be used are preferably those having an average primary particle diameter of 500 nm or less, more preferably those having an average primary particle diameter of 1 nm to 100 nm, and still more preferably those having an average primary particle diameter of 5 nm to 50 nm. The average primary particle diameter may be determined according to arithmetic mean of diameters of particles which are observed directly by a transmission electron microscope (hereinafter, referred to as TEM).

Examples of specific trade names of particles of titanium oxide among particles of metal oxide in the present invention include ultrafine particle titanium oxide without surface treatment "TTO-55 (N)", ultrafine particle titanium oxide coated with $Al_2O_3$"TTO-55 (A)" and "TTO-55 (B)", ultrafine particle oxidized silicon subjected to surface treatment with stearic acid "TTO-55 (C)", ultrafine particle titanium oxide subjected to surface treatment with $Al_2O_3$ and organosiloxane "TTO-55 (S)", high purity titanium oxide "C-EL", titanium oxide prepared by a sulfuric acid method "R-550", "R-580", "R-630", "R-670", "R-680", "R-780", "A-100", "A-220", and "W-10", titanium oxide prepared by a chlorine method "CR-50", "CR-58", "CR-60", "CR-60-2", and "CR-67", conductive titanium oxide "SN-100P", "SN-100D", "ET-300W" (the above titanium oxide are manufactured by Ishihara Sangyo Kaisha, Ltd.), or titanium oxide such as "R-60", "A-110" and "A-150"; "SR-1", "R-GL", "R-5N", "R-5N-2", "R-52N", "RK-1", and "A-SP" which are coated with $Al_2O_3$, "R-GX" and "R-7E" which are coated with $SiO_2$ and $Al_2O_3$, "R-650" coated with ZnO, $SiO_2$ and $Al_2O_3$, and "R-61N" coated with $ZrO_2$ and $Al_2O_3$ (the above are manufactured by Sakai Chemical Industry Co., Ltd.); "TR-700" subjected to surface treatment with $SiO_2$ and $Al_2O_3$, "TR-840" and "TA-500" subjected to surface treatment with ZnO, $SiO_2$, and $Al_2O_3$, titanium oxide without surface treatment such as "TA-100", "TA-200" and "TA-300", and "TA-400" subjected to surface treatment with $Al_2O_3$ (the above are manufactured by Fuji Titanium Industry Co., Ltd.); and "MT-150W" and "MT-500B" without surface treatment, "MT-100SA" and "MT-500SA" subjected to surface treatment with $SiO_2$ and $Al_2O_3$, and "MT-100SAS" and "MT-500SAS" subjected to surface treatment with $SiO_2$, $Al_2O_3$, and organosiloxane (manufactured by Tayca Corporation).

Specific examples of the trade name of the particles of aluminum oxide include "Aluminium oxide C" (manufactured by Nippon Aerosil Co., Ltd.).

Specific examples of the trade name of the particles of silicon oxide include "200CF", "R972" (manufactured by Nippon Aerosil Co., Ltd.), and "KEP-30" (manufactured by Nippon Shokubai Co., Ltd.).

In addition, specific examples of the trade name of the particles of tin oxide include "SN-100P" (manufactured by Ishihara Sangyo Kaisha, Ltd.).

Specific examples of the trade name of zinc oxide particles include "MZ-305S" (manufactured by Tayca Corporation). Alternatively, the particles of metal oxide usable in the present invention are not limited to these.

The using amount of the particles of metal oxide in the protective layer of the electrophotographic photoreceptor according to the present invention is not particularly limited. Alternatively, it is preferable that the particles of metal oxide are used in a range of 0.5 parts by weight to 4 parts by weight relative to 1 part by weight of the binder resin.

(Method of Forming Protective Layer)

Next, a method of forming the protective layer will be described. The method of forming the protective layer is not particularly limited. Alternatively, for example, the protective layer can be formed by applying a coating liquid, which is obtained by dissolving (or dispersing) binder resin, particles of metal oxide, and other substances in a solvent (or dispersion medium), to the photosensitive layer.

Hereinafter, the solvent or dispersion medium used for forming the protective layer, and the coating method will be described.

<Solvent Used for Protective Layer Forming Coating Liquid>

As an organic solvent used for the protective layer forming coating liquid of the present invention, any organic solvent which can dissolve the binder resin for the protective layer according to the present invention and which does not damage the photosensitive layer can be used.

Specific examples thereof include alcohols having five or less carbon atoms, such as methanol, ethanol, isopropyl alcohol, and normal propyl alcohol; halogenated hydrocarbons such as chloroform, 1,2-dichloroethane, dichloromethane, trichlene, carbon tetrachloride and 1,2-dichloropropane; nitrogen-containing organic solvents such as dimethylformamide; and aromatic hydrocarbons such as toluene and xylene; or the like. A mixed solvent, which is selected from these in any desired combination and in any desired ratio, can also be used. In addition, even an organic solvent which does not dissolve the binder resin for the protective layer in the present invention alone can be used as long as the organic solvent is mixed with the above organic solvent to form a mixed solvent, and thereby the binder resin can be dissolved therein. In general, coating unevenness can be reduced by using a mixed solvent.

The ratio of the solid content such as the binder resin and particles of metal oxide to the organic solvent used for the protective layer forming coating liquid according to the present invention differs according to a coating method of the protective layer forming coating liquid, and may be appropriately changed, so as to form a uniform coating film in the coating method to be applied.

<Coating Method>

A coating method of the coating liquid for forming a protective layer is not particularly limited, and examples thereof include a spray coating method, a spiral coating method, a ring coating method, a dip coating method, or the like. There is no limitation on the coating method as long as the method does not damage the photosensitive layer.

The coating film is formed by the above coating method, and then the coating film is dried. Alternatively, it is preferable that there is no limitation on temperature and time as long as necessary and sufficient drying can be obtained. However, in a case where the protective layer is applied only by air drying after coating of the photosensitive layer, sufficient drying is preferably performed by a method similar to that described in <Coating Method> of the photosensitive layer described above.

The thickness of the protective layer is appropriately selected depending on the material to be used. Alternatively, the thickness is preferably 0.1 μm or more, more preferably 0.2 μm or more, and further preferably 0.5 μm or more, from the viewpoint of the lifespan. Further, the thickness is still more preferably 0.8 μm or more since generation of image memory is further prevented when the thickness is 0.8 μm or more. In addition, the thickness is preferably 20 μm or less, more preferably 10 μm or less, and particularly preferably 5 μm or less, from the viewpoint of electrical properties.

<Undercoat Layer>

The electrophotographic photoreceptor according to the present invention may include an undercoat layer between the photosensitive layer and the conductive support.

As the undercoat layer, a resin or a resin in which particles of a metal oxide or the like is dispersed is used. Examples of an organic pigment used for the undercoat layer include a phthalocyanine pigment, an azo pigment, a quinacridone pigment, an indigo pigment, a perylene pigment, a polycyclic quinone pigment, an anthraquinone pigment, a benzimidazole pigment, or the like. Among them, a phthalocyanine pigment and an azo pigment, specifically, a phthalocyanine pigment and an azo pigment when used as the charge generation substance described above can be mentioned.

Examples of the particles of metal oxide used for the undercoat layer include particles of metal oxide containing one metallic element, such as titanium oxide, aluminum oxide, silicon oxide, zirconium oxide, zinc oxide, and iron oxide, and particles of a metal oxide containing a plurality of metallic elements, such as calcium titanate, strontium titanate, barium titanate, or the like. In the undercoat layer, only one kind of the above particles may be used in the undercoat layer, or a plurality of kinds of particles may be mixed and used in any desired ratio and in any desired combination therein.

Among these particles of metal oxide, titanium oxide and aluminum oxide are preferred, and titanium oxide is particularly preferred. The surface of the titanium oxide particles may be treated with an inorganic substance such as tin oxide, aluminum oxide, antimony oxide, zirconium oxide, and silicon oxide, or an organic substance such as stearic acid, polyol, and silicon.

As the crystal form of the titanium oxide particles, any of rutile, anatase, brookite, and amorphous can be used. In addition, a plurality of crystalline states may be contained.

The particle diameter of the particles of metal oxide used for the undercoat layer is not particularly limited. Alternatively, the average primary particle diameter is preferably 10 nm or more, and is preferably 100 nm or less, and more preferably 50 nm or less, from the viewpoint of the properties of the undercoat layer and the stability of the solution for forming the undercoat layer.

Here, the undercoat layer is preferably formed so as to contain a binder resin and particles dispersed therein.

The binder resin to be used in the undercoat layer can be selected from: polyvinyl acetal resins such as a polyvinyl butyral resin, a polyvinyl formal resin, and a partly acetalized polyvinyl butyral resin in which the butyral moieties have been partly modified with formal, acetal, or the like, polyarylate resins, polycarbonate resins, polyester resins, modified ether-type polyester resins, phenoxy resin, polyvinyl chloride resin, polyvinylidene chloride resins, polyvinyl acetate resins, polystyrene resins, acrylic resins, methacrylic resins, polyacrylamide resins, polyamide resins (copolymerized polyimide, modified polyamide), polyvinylpyridine resins, cellulosic resins, polyurethane resins, epoxy resins, silicon resins, polyvinyl alcohol resins, polyvinylpyrrolidone resins, caseins, copolymers based on vinyl chloride and vinyl acetate, such as a vinyl chloride/vinyl acetate copolymer, a hydroxy-modified vinyl chloride/vinyl acetate copolymer, a carboxyl-modified vinyl chloride/vinyl acetate copolymer, and a vinyl chloride/vinyl acetate/maleic anhydride copolymer, or the like, insulating resins such as a styrene/butadiene copolymer, a vinylidene chloride/acrylonitrile copolymer, a styrene-alkyd resin, a silicon-alkyd resin, and a phenol-formaldehyde resin, and organic photoconductive polymers such as a poly-N-vinylcarbazole, a polyvinylanthracene, and a polyvinylperylene, or the like, and can be used. However, the binder resin is not limited to these polymers. In addition, any one of these binder resins may be used alone, or two or more thereof may be mixed and used, or may be used in a cured form with a curing agent.

Among them, preferred are a polyvinyl acetal resin such as partially acetalized polyvinyl butyral resin in which the butyral moieties have been partly modified with formal, acetal, or the like, an alcohol soluble copolymerized polyamide, modified polyamide, or the like, since they show good dispersibility and coatability.

The mixing ratio of the particles of metal oxide to the binder resin can be arbitrarily selected. Alternatively, the mixing ratio is preferably in a range of 10% by weight to 500% by weight, from the viewpoint of the stability and the coatability of the dispersion liquid. The film thickness of the undercoat layer can be selected arbitrarily, and is preferably 0.1 μm to 20 μm, from the electrophotographic photoreceptor properties and the coatability of the dispersion liquid. In addition, the undercoat layer may contain known antioxidants or the like.

<Other Layers>

The electrophotographic photoreceptor according to the present invention may appropriately have other layers as necessary in addition to the conductive support, the photosensitive layer, the protective layer, and the undercoat layer.

EXAMPLE

Hereinafter, examples are shown to describe embodiments according to the present invention more specifically. However, the following examples are given to describe the invention in detail, and the present invention is not limited to the examples described below and can be arbitrarily modified and implemented without departing from the scope of the present invention. In addition, the description of "part" in the following examples and comparative examples indicate "parts by mass" unless otherwise specified.

<Method of Preparing Protective Layer Forming Dispersion Liquid>

Protective Layer Forming Dispersion Liquid 1

The protective layer forming dispersion liquid was manufactured as follows. That is, rutile-type titanium oxide with an average primary particle diameter of 40 nm ("TTO55N" manufactured by Ishihara Sangyo Kaisha, Ltd.) and 3% by weight of methyl dimethoxysilane ("TSL 8117" manufactured by Toshiba Silicone Co., Ltd.) relative to the titanium oxide were added to a high-speed fluid mixing mixer ("SMG 300" manufactured by Kawata Mfg. Co., Ltd.). Surface-treated titanium oxide obtained by being high-speed mixed at a rotation circumferential speed of 34.5 m/sec was dispersed in a mixed solvent in which a weight ratio of methanol to 1-propanol is 7/3 by ball mill, so as to form a dispersion slurry of hydrophobized titanium oxide. The dispersion slurry, a mixed solvent including methanol, 1-propanol, and toluene, and pellets of copolymerized polyamide described in an embodiment of JP-A-H4-31870 were heated, stirred, and mixed, so as to dissolve the pellets of polyamide. The copolymerized polyamide is formed of ε-caprolactam [a compound represented by the following formula A], bis (4-amino-3-methylcyclohexyl) methane [a compound represented by the following formula B], hexamethylene diamine [a compound represented by the following formula C], decamethylene dicarboxylic acid [a compound represented by the following formula D], and octadecamethylenedicarboxylic acid [a compound represented by the following formula E], the composition molar ratios of which are respectively 60%, 15%, 5%, 15%, and 5%. Thereafter, ultrasonic dispersion treatment was performed so as to prepare the protective layer forming dispersion liquid 1, which contains methanol/1-propanol/toluene at a weight ratio of 7/1/2 and hydrophobized titanium oxide/copolyamide at a weight ratio of 3/1, and has a solid content concentration of 18.0%.

A

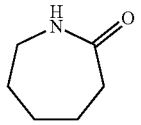

B

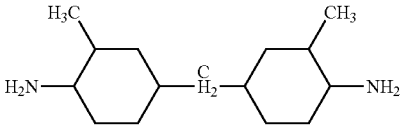

C

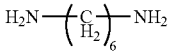

D

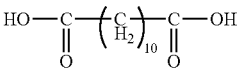

E

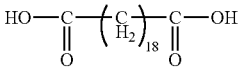

Protective Layer Forming Dispersion Liquid 2

Aluminum oxide particles with an average primary particle diameter of 13 nm (aluminum oxide C manufactured by Nippon Aerosil Co., Ltd.) was dispersed in a mixed solvent including methanol and 1-propanol by ultrasonic sound, so as to form a dispersion slurry of aluminum oxide. The dispersion slurry, a mixed solvent including methanol, 1-propanol, and toluene, and the above pellets of the copolymerized polyamide were heated, stirred, and mixed, so as to dissolve the pellets of polyamide. Thereafter, ultrasonic dispersion treatment was performed so as to prepare the protective layer forming dispersion liquid 2, which contains aluminum oxide/copolymerized polyamide at a weight ratio of 1/1, and has a solid content concentration of 8.0%.

Protective Layer Forming Dispersion Liquid 3 (for Comparative Example)

Aluminum oxide particles with an average primary particle diameter of 13 nm (aluminum oxide C manufactured by Nippon Aerosil Co., Ltd.) was dispersed in a toluene solvent by ultrasonic sound, so as to form a dispersion slurry of aluminum oxide. A polycarbonate resin 1 (viscosity average molecular weight: 31700) having a repeating structure represented by the following formula was heated and dissolved in toluene, and was mixed with the dispersion slurry, so as to form a dispersion liquid. Thereafter, ultrasonic dispersion treatment was performed so as to prepare the protective layer forming dispersion liquid 3, which contains aluminum oxide/polycarbonate resin at a weight ratio of 1/1, and has a solid content concentration of 10.0%.

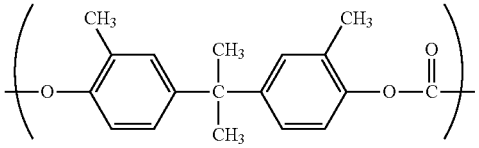

POLYCARBONATE RESIN 1

Protective Layer Forming Dispersion Liquid 4

The protective layer forming dispersion liquid 4 was prepared in a manner similar to that of the protective layer forming dispersion liquid 1, except that the amilan CM 8000 (manufactured by Toray Industries, Inc.), which has a structure represented by the following formula A', a structure represented by the following formula F, a structure represented by the following formula G, and a structure represented by the following formula H, was used as copolymerized polyamide.

A'

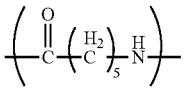

F

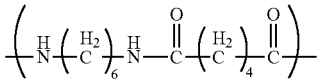

G

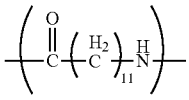

H

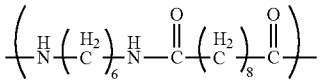

Protective Layer Forming Dispersion Liquid 5

The protective layer forming dispersion liquid 5 was prepared in a manner similar to that of the protective layer forming dispersion liquid 1, except that the daiamide T171 (manufactured by Daicel-Evonik Ltd.), which has a structure represented by the above formula A', a structure represented by the above formula F, and a structure represented by the above formula G, was used as copolymerized polyamide.

<Method of Preparing Photosensitive Layer Forming Coating Liquid>

Pigment Dispersion Liquid 8 parts of oxytitanium phthalocyanine and 112 parts of toluene were dispersed for one hour by a sand grind mill, and the obtained dispersion liquid was diluted with toluene, so as to prepare a pigment dispersion liquid having a solid concentration of 3% by weight. The oxytitanium phthalocyanine shows a strong diffraction peak when a bragg angle (2θ±0.2) is 27.3° in X-ray diffraction using CuKα rays.

Charge Transport Substance Solution 100 parts of polycarbonate resins 2 having a repeating structure represented by the following formula ([viscosity average molecular weight: Mv=40,400]), 60 parts of charge transport substances (1)-3 (positive hole transport substance) represented by a following structural formula, 40 parts of compound A" (electron transport substance) represented by a following structural formula, 1 part of compound B' represented by a following structural formula, 0.03 part of silicone oil (silicone oil KF96 manufactured by Shin-Etsu Chemical Co., Ltd.), and 557 parts of toluene were mixed, so as to prepare a charge transport substance solution.

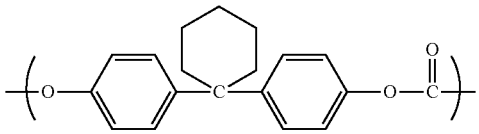

POLYCARBONATE RESIN 2

(1)-3

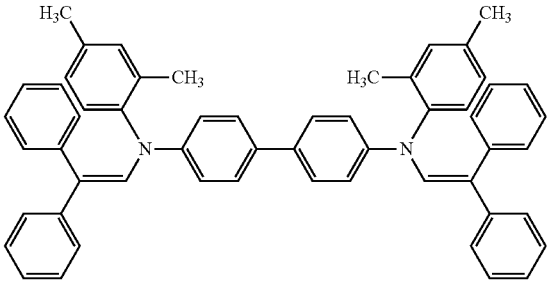

CHARGE TRANSPORT SUBSTANCE

COMPOUND A"

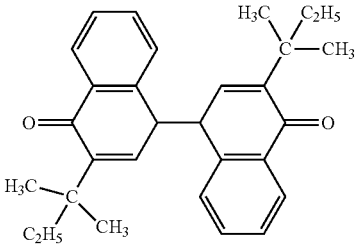

COMPOUND B'

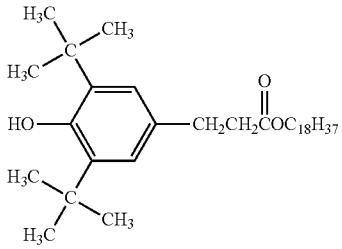

133 parts of the above pigment dispersion liquids were mixed with 758 parts of the charge transport substance solutions for 30 minutes by a TK homomixer manufactured by Tokushu Kika Kogyo Co., Ltd. to prepare a photosensitive layer forming coating liquid.

<Method of Preparing Undercoat Layer Forming Dispersion Liquid>

An undercoat layer forming dispersion liquid A was manufactured as follows. 20 parts of oxytitanium phthalocyanine were mixed with 280 parts of 1,2-dimethoxyethane, and the mixture was ground by a sand grind mill for one hour, so as to perform an atomized dispersion treatment. The oxytitanium phthalocyanine shows a strong diffraction peak when a bragg angle (2θ±0.2) is 27.3° in X-ray diffraction using CuKα rays. Subsequently, 230 parts of 2-dimethoxyethane, a binder liquid, which was obtained by dissolving 10 parts of polyvinyl butyral (trade name "Denka butyral" #6000C, manufactured by Denki Kagaku Kogyo Kabushiki Kaisha) into a mixing liquid containing 255 parts of 1,2-dimethoxyethane, and 85 parts of 4-methoxy-4-methyl-2-pentanone were mixed in the refinement processing solution, so as to prepare the undercoat layer forming dispersion liquid A.

Manufacture of Electrophotographic Photoreceptor

Example 1

An aluminum ironing tube having an outer diameter of 30 mm, a length of 244 mm, and a thickness of 0.75 mm, which was manufactured by ironing an aluminum extrusion tube (aluminum cylinder, aluminum conductive support), was coated with the undercoat layer forming dispersion liquid A by immersion, so as to provide an undercoat layer having a thickness of dried film of 0.2 μm thereon.

Next, the aluminum cylinder on which the undercoat layer was previously provided was coated with the photosensitive layer forming coating solution by immersion, and dried at 100° C. for 20 minutes, so as to provide a photosensitive layer having a film thickness of 25 μm thereon. Further, the photosensitive layer was coated with the above protective layer forming dispersion liquid 1 by immersion thereon, and was dried at 100° C. for 24 minutes, so as to provide a protective layer having a film thickness of 1.5 μm. Therefore, the electrophotographic photoreceptor 1A was prepared.

Comparative Example 1

An electrophotographic photoreceptor 1B was prepared in a manner similar to that of Example 1 except that the protective layer was not provided on the formed photosensitive layer.

Example 2

An electrophotographic photoreceptor 2A was prepared in a manner similar to that of Example 1 except that the positive hole transport substance in the photosensitive layer forming coating solution was changed from the charge transport substance (1)-3 in Example 1 to a charge transport substance (2)-7 having the following structure.

(2)-7

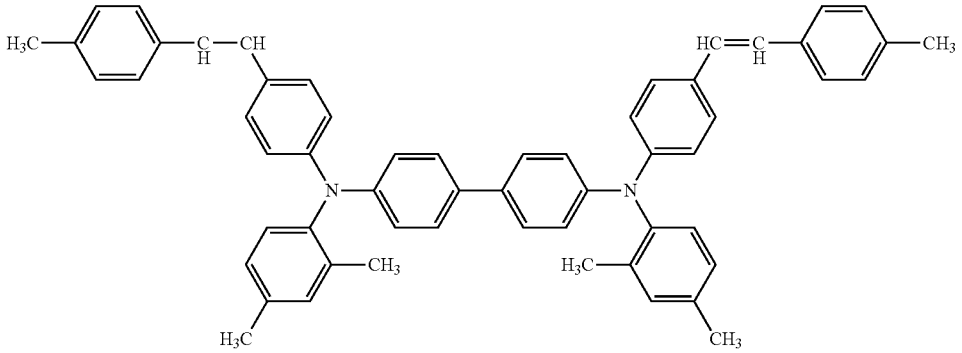

CHARGE TRANSPORT SUBSTANCE

Comparative Example 2

An electrophotographic photoreceptor 2B was prepared in a manner similar to that of Example 2 except that the protective layer was not provided on the formed photosensitive layer.

Example 3

An electrophotographic photoreceptor 3A was prepared in a manner similar to that of Example 1 except that the positive hole transport substance in the photosensitive layer forming coating solution was changed from the charge transport substance (1)-3 in Example 1 to a charge transport substance (3)-8 having the following structure.

Comparative Example 3

An electrophotographic photoreceptor 3B was prepared in a manner similar to that of Example 3 except that the protective layer was not provided on the formed photosensitive layer.

Example 4

An electrophotographic photoreceptor 4A was prepared in a manner similar to that of Example 1 except that the positive hole transport substance in the photosensitive layer forming coating solution was changed from the charge transport substance (1)-3 in Example 1 to a charge transport substance (4)-7 having the following structure.

(3)-8

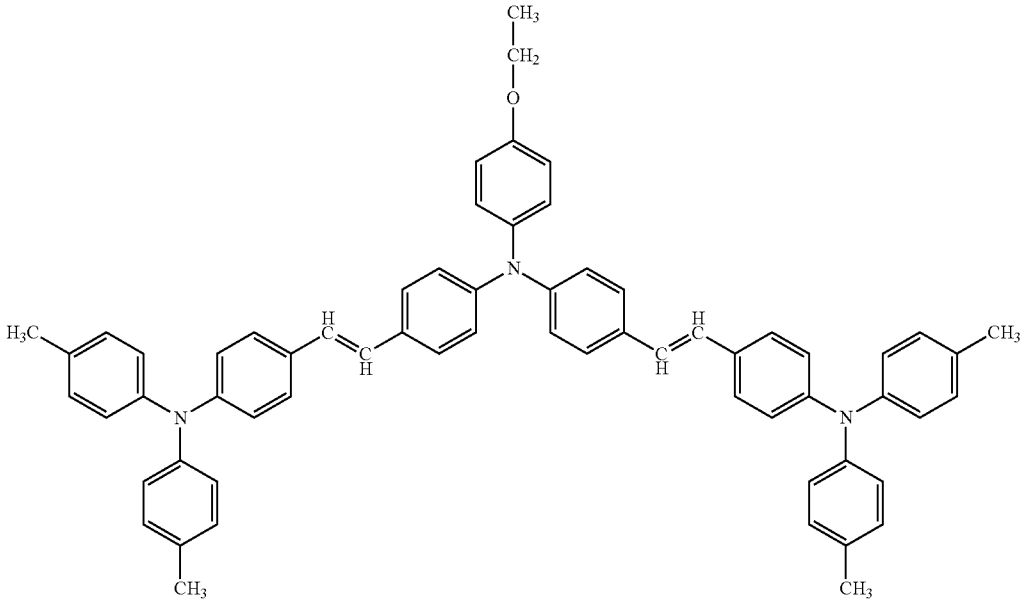

CHARGE TRANSPORT SUBSTANCE (4)-7

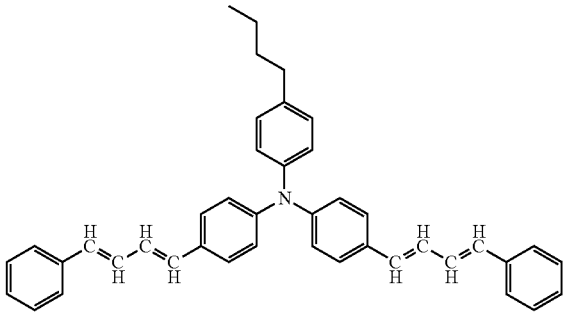

CHARGE TRANSPORT SUBSTANCE

Comparative Example 4

An electrophotographic photoreceptor 4B was prepared in a manner similar to that of Example 4 except that the protective layer was not provided on the formed photosensitive layer.

Example 5

An electrophotographic photoreceptor 5A was prepared in a manner similar to that of Example 1 except that the positive hole transport substance in the photosensitive layer forming coating solution was changed from the charge transport substance (1)-3 in Example 1 to a charge transport substance (5)-2 having the following structure.

(5)-2

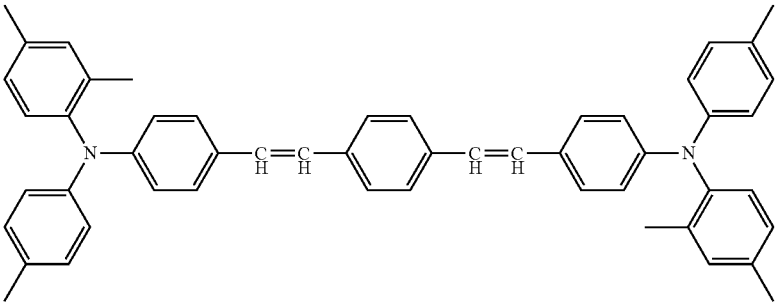

CHARGE TRANSPORT SUBSTANCE

Comparative Example 5

An electrophotographic photoreceptor 5B was prepared in a manner similar to that of Example 5 except that the protective layer was not provided on the formed photosensitive layer.

Example 6

An electrophotographic photoreceptor 2C was prepared in a manner similar to that of Example 2 except that the protective layer forming dispersion liquid 1 in Example 2 was changed to the protective layer forming dispersion liquid 2.

Example 7

An electrophotographic photoreceptor 3C was prepared in a manner similar to that of Example 3 except that the protective layer forming dispersion liquid 1 in Example 3 was changed to the protective layer forming dispersion liquid 2.

Example 8

An electrophotographic photoreceptor 1C was prepared in a manner similar to that of Example 1 except that the protective layer was provided on a photosensitive layer, which was only air-dried at room temperature of 25° C. without being dried by heating at 100° C. after coating of the photosensitive layer in Example 1.

Comparative Example 6

An electrophotographic photoreceptor 2D was prepared in a manner similar to that of Example 2 except that the protective layer forming dispersion liquid 1 in Example 2 was changed to the protective layer forming dispersion liquid 3.

Comparative Example 7

An electrophotographic photoreceptor 6B was prepared in a manner similar to that of comparative example 1 except that the charge transport substance (1)-3 as the positive hole transport substance in Comparative Example 1 was changed to a charge transport substance (6) having the following structure.

(6)

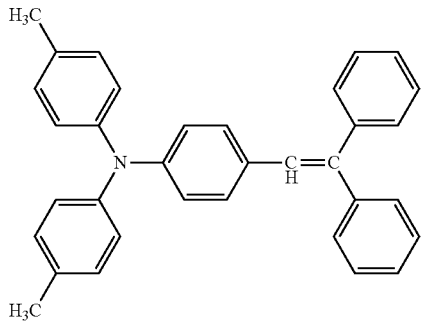

CHARGE TRANSPORT SUBSTANCE

Comparative Example 8

An electrophotographic photoreceptor 6A was prepared in a manner similar to that of Example 8 except that the charge transport substance (l)-3 as the positive hole transport substance in Example 8 was changed to the charge transport substance (6) which is identical to that in Comparative Example 7.

TABLE 1

| Test example | Charge transport substance | Protective layer dispersion liquid | Sensitivity (μJ/cm$^2$) | VL (V) | Charging (%) 1st rotation/10th rotation (10th value) | Photoreceptor appearance |
|---|---|---|---|---|---|---|
| Example 1 | (1)-3 | 1 | 0.117 | 37 | 101 (688 V) | good |
| Comparative example 1 | | absent | 0.118 | 36 | 90 (606 V) | good |
| Example 2 | (2)-7 | 1 | 0.129 | 43 | 100 (678 V) | good |
| Comparative example 2 | | absent | 0.120 | 43 | 87 (587 V) | good |
| Example 3 | (3)-8 | 1 | 0.145 | 35 | 100 (656 V) | good |
| Comparative example 3 | | absent | 0.149 | 33 | 84 (520 V) | good |
| Example 4 | (4)-7 | 1 | 0.147 | 55 | 99 (691 V) | good |
| Comparative example 4 | | absent | 0.150 | 55 | 91 (630 V) | good |
| Example 5 | (5)-2 | 1 | 0.125 | 33 | 100 (689 V) | good |
| Comparative example 5 | | absent | 0.127 | 31 | 90 (644 V) | good |
| Example 6 | (2)-7 | 2 | 0.119 | 38 | 100 (676 V) | good |
| Example 7 | (3)-8 | 2 | 0.144 | 30 | 101 (655 V) | good |
| Example 8 | (1)-3 | 1 | 0.117 | 36 | 101 (685 V) | good |
| Comparative example 6 | (2)-7 | 3 | 0.244 | 103 | 89 (595 V) | dissolution unevenness |
| Comparative example 7 | (6) | absent | 0.166 | 89 | 98 (670 V) | good |
| Comparative example 8 | (6) | 1 | 0.170 | 89 | 101 (607 V) | good |

Example 8'

An aluminum vapor deposition surface of a polyethylene terephthalate sheet (thickness: 75 μm) with aluminum deposited on the surface thereof was coated with the undercoat layer forming dispersion liquid A prepared in Example 1 by a wire bar, and was dried so as to provide an undercoat layer with a film thickness of 0.2 μm after drying.

The undercoat layer of the sheet was coated with the photosensitive layer forming coating liquid used in Example 1 by an applicator so as to form a photosensitive layer with a film thickness of 20 μm in the case of drying at 125° C. for 20 minutes, and here, the sheet was placed at room temperature of 25° C. without being dried by heating. The photosensitive layer was coated with the protective layer forming dispersion liquid 1 used in Example 1 by a wire bar so as to form a protective layer having a film thickness of 1.5 μm after drying. The sheet was dried at 125° C. for 20 minutes to prepare an electrophotographic photosensitive sheet having a protective layer with a thickness of 1.5 μm on a photosensitive layer with a thickness of 20 μm.

The prepared electrophotographic photoreceptor sheet was wound around an aluminum drum having an outer diameter of 30 mm, and the conduction between the aluminum drum and the aluminum vapor-deposited layer of the photoreceptor was obtained, so as to form a measurement sample. The photoreceptor is referred to as 1C'.

Example 9

An electrophotographic photoreceptor 1D was prepared in a manner similar to that of Example 8' except that the protective layer forming dispersion liquid 1 in Example 8' was changed to the protective layer forming dispersion liquid 4.

Example 10

An electrophotographic photoreceptor 1E was prepared in a manner similar to that of Example 8' except that the protective layer forming dispersion liquid 1 in Example 8' was changed to the protective layer forming dispersion liquid 5.

TABLE 2

| Test example | Charge transport substance | Protective layer dispersion liquid | Sensitivity (μJ/cm$^2$) | VL (V) | Charging (%) 1st rotation/10th rotation (10thvalue) | Photoreceptor appearance |
|---|---|---|---|---|---|---|
| Example 8' | (1)-3 | 1 | 0.119 | 40 | 101 (682 V) | good |
| Example 9 | | 4 | 0.131 | 42 | 101 (673 V) | good |
| Example 10 | | 5 | 0.141 | 41 | 101 (670 V) | good |

Example 11

<Method of Preparing Sheet Photosensitive Layer Forming Coating Liquid>

Pigment Dispersion Liquid for Sheet Coating 1.2 parts of oxytitanium phthalocyanine which shows a strong diffraction peak when a bragg angle (2θ±0.2) is 28.1° in X-ray diffraction using CuKα rays and 30 parts of toluene were dispersed for one hour by a sand grind mill, and the obtained dispersion liquid was diluted with toluene, so as to prepare a pigment dispersion liquid for sheet coating having a solid concentration of 3% by weight.

Charge Transport Substance Solution for Sheet Coating 1.0 part of polycarbonate resins 2 ([viscosity average molecular weight: Mv=40,400]) having a repeating structure represented by the following formula, 0.6 part of charge transport substance (2)-7 (positive hole transport substance) represented by the above structural formula, 1.0 part of compound A" (electron transport substance) represented by the above structural formula, 0.011 part of compound B' represented by the above structural formula, 0.03 part of 1% toluene solution of silicone oil (silicone oil KF96 manufactured by Shin-Etsu Chemical Co., Ltd.), and 5.54 parts of toluene were mixed, so as to prepare a charge transport substance solution for sheet coating.

1.33 parts of sheet coating pigment dispersion liquid mentioned above and 8.18 parts of sheet coating charge transport substance solutions were mixed and stirred, so as to prepare a sheet photosensitive layer forming coating liquid.

An electrophotographic photoreceptor 2E was prepared in a sheet-coating manner similar to that of Example 8' except that the photosensitive layer forming coating liquid in Example 8' was changed to the sheet photosensitive layer forming coating liquid prepared as above.

Example 12

An electrophotographic photoreceptor 2F was prepared in a manner similar to that of Example 11 except that the blending amount of the compound A" in the charge transport substance solution for sheet coating was changed from 1.0 part in Example 11 to 1.5 parts.

Example 13

An electrophotographic photoreceptor 2G was prepared in a manner similar to that of Example 11 except that the blending amount of the compound A" in the charge transport substance solution for sheet coating was changed from 1.0 part in Example 11 to 0.15 part.

Example 14

An electrophotographic photoreceptor 2H was prepared in a manner similar to that of Example 11 except that 1.0 part of compound A" in the charge transport substance solution for sheet coating in Example 11 was changed to 0.02 part of compound C' represented by the following structural formula.

COMPOUND C'

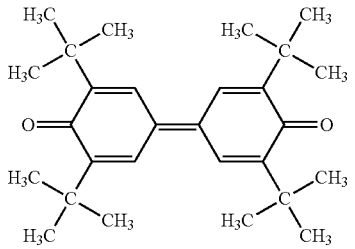

Example 15

An electrophotographic photoreceptor 21 was prepared in a manner similar to that of Example 14 except that the blending amount of the compound C' in the charge transport substance solution for sheet coating was changed from 0.02 part in Example 14 to 0.012 part.

TABLE 3

| Test example | Charge transport substance | Protective layer dispersion liquid | CTM/ETM | Sensitivity (μJ/cm$^2$) | VL (V) | Charging (%) 1st rotation/10th rotation (10th rotation value) | Photoreceptor appearance |
|---|---|---|---|---|---|---|---|
| Example 11 | (2)-7 | 1 | 0.6 | 0.253 | 68 | 100 (720 V) | good |
| Example 12 | | | 0.4 | 0.301 | 83 | 101 (699 V) | in-film precipitation |
| Example 13 | | | 4 | 0.227 | 92 | 100 (710 V) | good |
| Example 14 | | | 30 | 0.258 | 103 | 99 (720 V) | good |
| Example 15 | | | 50 | 0.300 | 111 | 102 (709 V) | good |

The test methods are described below, and the results thereof are shown in Tables 1 to 3.

"CTM/ETM" in Table 3 represents a weight ratio of "the total content of the compound represented by any one of the formulas (1) to (5) which is a positive hole transport substance/content of the electron transport substance".

<Electrical Property Test>

The electrophotographic photoreceptors 1A to 1E, 2A to 2I, 3A to 3C, 4A, 4B, 5A, 5B, 6A and 6B obtained in the above examples and comparative examples were mounted on an electrophotographic property evaluation apparatus manufactured according to measurement standards of Japan Imaging Society as general incorporated association (as described in Foundation and Application of Electrophotographic Technique (Continued), CORONA PUBLISHING CO., LTD., published on Nov. 15, 1996, Pages 404 to 405), and were subjected to electrical property tests. The electrophotographic photoreceptor was rotated at a constant speed of 60 rpm, charged by using a scorotron charging unit, and exposed with monochromatic light of 660 nm as charge eliminating light at 9.0 $\mu J/cm^2$. The grid voltage was adjusted such that the initial surface potential of the photoreceptor was +700 V. The light of a halogen lamp was converted into monochromatic light of 780 nm by an interference filter, and the electrophotographic photoreceptor was exposed with the monochromatic light of 780 nm at 2.0 $\mu J/cm^2$, so as to measure the surface potential (hereinafter, may be referred to as VL) after exposure. Further, the electrophotographic photoreceptor was charged such that the initial surface potential of the photoreceptor was +700 V, and was exposed with monochromatic light of 780 nm obtained by converting light of a halogen lamp by an interference filter. The irradiation energy (half-exposure energy) when the surface potential was +350 V was measured as the half-exposure amount $E_{1/2}$ (unit: $\mu J/cm^2$, may be referred to as sensitivity).

In each measurement, the time from exposure to potential measurement was 100 milliseconds. The measurement was performed in an environment in which temperature was 25° C. and relative humidity was 50%.

When the value of VL is low, it indicates that the electrophotographic photoreceptor was a good photoreceptor having low residual potential, and when the value of the sensitivity is low, it indicates that the electrophotographic photoreceptor is a good photoreceptor excellent in the photosensitivity.

<Charging Property Test>

A photoreceptor was mounted on an apparatus similar to that of the electrical property test, the grid voltage of a scorotron charging device was set to be 730 V, monochromatic light of 660 nm was set to be 9.0 $\mu J/cm^2$ as charge eliminating light, and the measurement process was started when the speed of the photoreceptor was 60 rpm. At this time, the ratio of the surface potential at the first rotation to the surface potential at the tenth rotation was expressed by a percentage (first rotation surface potential/tenth rotation surface potential*100(%)). The results are shown as "charging (%)" in the table, and the tenth rotation surface potential is shown in parentheses as "10th rotation value". The fact that the value of the charging (%) is close to 100% indicates that sufficient charge has been obtained from the first process.

<Measurement Result>

It has been confirmed that the electrophotographic photoreceptor according to the present invention is excellent in sensitivity and has a lower residual potential. Further, the protective layer was provided, and whereby the charging similar to the tenth rotation can be obtained from the first rotation, and it can be said that sufficient charging was obtained from the initial stage of the process. In addition, it can be seen that when the voltage value of the charger grid is made constant and output, the absolute value of the charge amount reached is also high.

FIG. 1 are graphs showing number of processes (number of rotations) and charge amount of photoreceptor surface (surface potential) of electrophotographic photoreceptor 2A (photoreceptor 2A) in Example 2 and electrophotographic photoreceptor 2B (photoreceptor 2B) in Comparative Example 2. Also from this result, it can be seen that the protective layer is provided, and whereby sufficient charge can be obtained from the beginning of the process and the absolute value of the charge amount reached is also high.

<Image Test>

Electrophotographic photoreceptors obtained in the above Examples 1 to 8 were mounted on drum cartridges of monochrome printers having A4 size (210×297 mm) (HL5240 (printing speed: monochrome 24 rpm resolution: 1200 dpi exposure source: laser charging method: scorotron) manufactured by Brother Industries, Ltd.) and the monochrome printers were set similar to the above printer.

As input for printing, a pattern, in which bold characters are printed on a white background at the top of the A4 area and a half-tone part was printed from the printing part to the lower part of the bold characters, was sent from a computer to a printer, and the resulting output image was visually evaluated.

In any of the photoreceptors, even after printing 10000 sheets, the reduction in density at halftone did not occur, and a good image free of character thickening and image blurring was obtained.

Although the present invention has been described in detail with reference to a specific example, it is obvious to those skilled in the art that various changes and modifications may be made without departing from the spirit and the scope of the invention. The present application is based on a Japanese Patent Application (JP-A-2017-038367) filed on Mar. 1, 2017, contents of which are incorporated herein by reference.

The invention claimed is:

1. A positive charging electrophotographic photoreceptor, comprising: a conductive support; a photosensitive layer; and a protective layer in this order, the photosensitive layer containing a charge generation substance, a positive hole transport substance, and an electron transport substance in the same layer, wherein the positive hole transport substance includes at least one of the compounds represented by any one of the following formulas (1) to (5), and a binder resin of the protective layer is a thermoplastic resin selected from the group consisting of a polyamide resin which is soluble in alcohol or a polyvinyl acetal resin which is soluble in alcohol, (1)

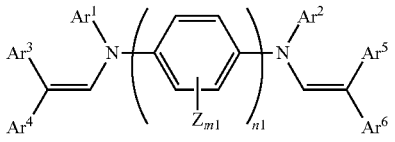

in the formula (1), $Ar^1$ to $Ar^6$ each independently represent an aryl group which may have a substituent; n1 represents an integer of 2 or greater; Z represents a monovalent organic residue; and m1 represents an integer of 0 to 4, here, at least one of $Ar^1$ and $Ar^2$ represents an aryl group having a substituent, (2)

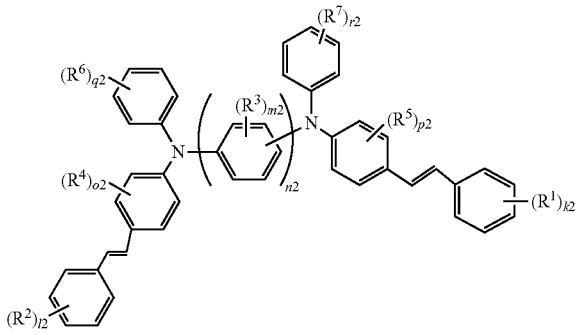

in the formula (2), $R^1$ to $R^7$ each independently represent a hydrogen atom, an alkyl group, an aryl group; and an alkoxy group; n2 represents an integer of 1 to 5; k2, l2, q2, and r2 each independently represent an integer of 1 to 5; and m2, o2 and p2 each independently represent an integer of 1 to 4, (3)

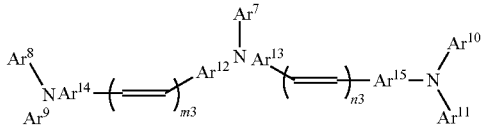

in the formula (3), $Ar^7$ to $Ar^{11}$ each independently represent an aryl group which may have a substituent; and $Ar^{12}$ to $Ar^{15}$ each independently represent an arylene group which may have a substituent; m3 and n3 each independently represent an integer of 1 to 3, (4)

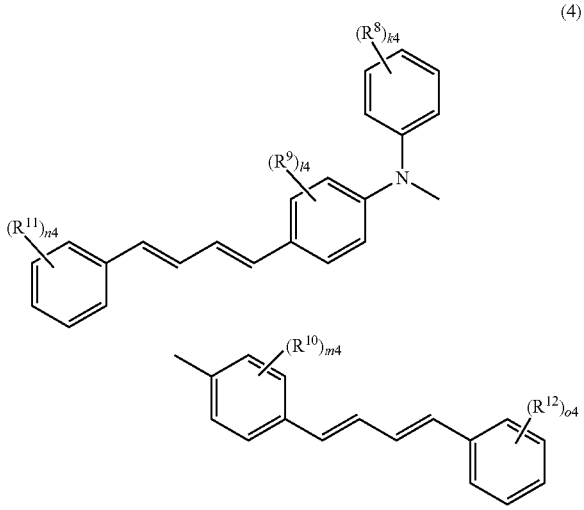

in the formula (4), $R^8$ to $R^{12}$ each independently represent a hydrogen atom, an alkyl group, an aryl group, and an alkoxy group; k4, n4, and o4 each independently represent an integer of 1 to 5; and 14 and m4 each independently represent an integer of 1 to 4, (5)

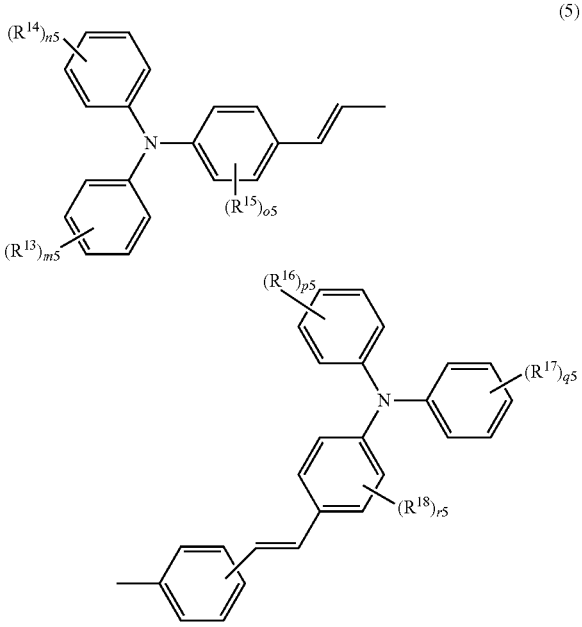

in the formula (5), $R^{13}$ to $R^{18}$ each independently represent an alkyl group and an alkoxy group; m5, n5, p5 and q5 each independently represent an integer of 0 to 5; and o5 and r5 each independently represent an integer of 0 to 4; in a case where m5, n5, o5, p5, q5 and r5 are integers of 2 or greater respectively, each of a plurality of $R^{13}$ to $R^{18}$ is bonded to the adjacent one of the plurality of $R^{13}$ to $R^{18}$ to form a ring structure, wherein with respect to a ratio of a total content of the compounds represented by any one of the above formulas (1) to (5) to a content of the electron transport substances, the total content is 0.5 part by weight or more and 40 parts by weight or less relative to 1 part by weight of the electron transport substance, and wherein the protective layer consists essentially of the binder resin and particles of metal oxide.

2. The positive charging electrophotographic photoreceptor according to claim 1, wherein the particles of metal oxide are surface-treated with an organometallic compound.

3. The positive charging electrophotographic photoreceptor according to claim 1, wherein the polyamide resin contains a structure represented by the following formula (7),

FORMULA (7)

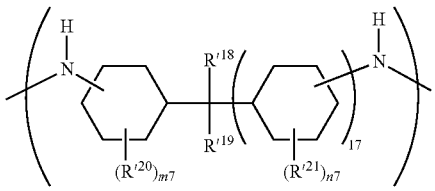

in the formula (7), $R'^{18}$ to $R'^{21}$ each independently represent a hydrogen atom and an organic substituent; 17 represents an integer of 0 to 2; m7 and n7 each independently represent an integer of 0 to 4; and in a case where m7 and n7 are integers of 2 or greater, a plurality of $R'^{20}$ and $R'^{21}$ may be different from each other.

4. An electrophotographic cartridge comprising the positive charging electrophotographic photoreceptor according to claim 1.

5. An image forming apparatus comprising the positive charging electrophotographic photoreceptor according to claim 1.

6. The positive charging electrophotographic photoreceptor according to claim 1, wherein the positive hole transport substance includes at least one of the compounds represented by formula (1), in the above formula (1), $Ar^1$ to $Ar^6$ each independently represent a phenyl group and a naphtyl group which may have an alkyl group having 1 to 4 carbon atoms as a substituent, n1 represents an integer of 2 or 3, and m1 represents 0.

7. The positive charging electrophotographic photoreceptor according to claim 1, wherein the positive hole transport substance includes at least one of the compounds represented by formula (3), in the above formula (3), $Ar^1$ to $Ar^{11}$ each independently represent a phenyl group which may have an alkyl group having 1 to 6 carbon atoms and an alkoxy group having 1 to 6 carbon atoms, as a substituent, $Ar^{12}$ to $Ar^{15}$ each independently represent a phenylene group which may have a substituent, and m3 and n3 represent an integer of 1.

8. The positive charging electrographic photoreceptor according to claim 1, wherein the electron transport substance is at least one of the compounds represented by any one of the following formulas (I) to (XII), wherein in the formulas, t-Bu represents a t-butyl group:

(I)

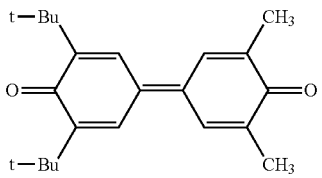

(II)

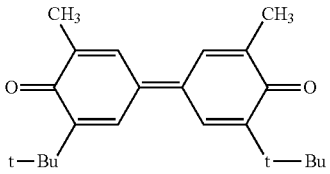

(III)

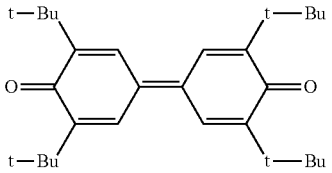

(IV)

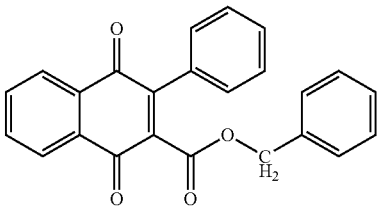

-continued (V)

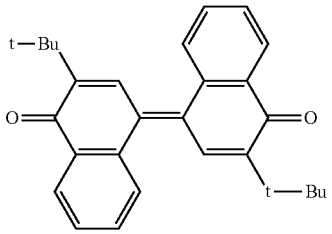

(VI)

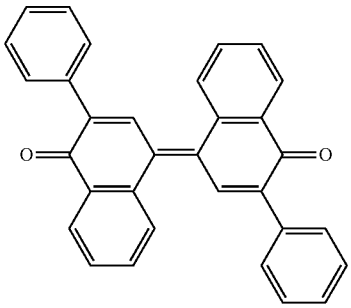

(VII)

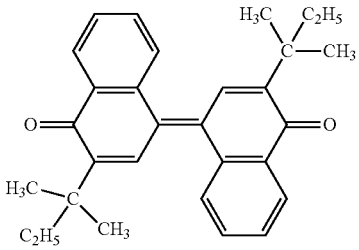

(VIII)

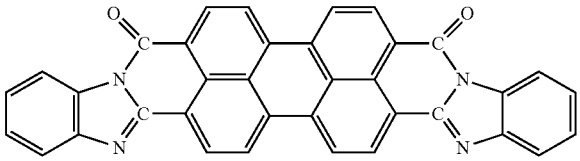

(IX)

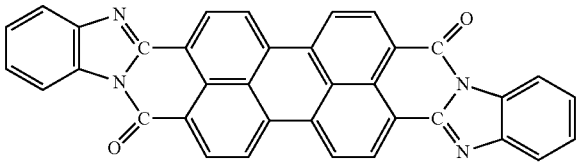

(X)

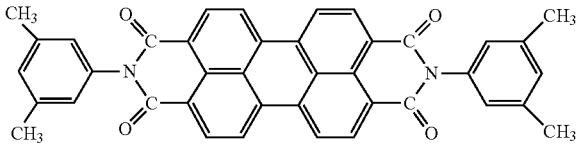

(XI)

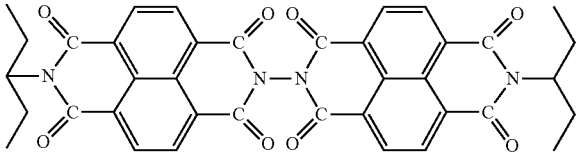

-continued (XII)

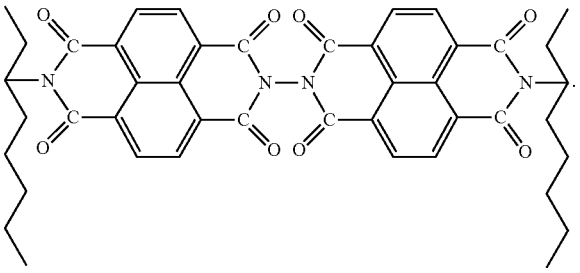

9. The positive charging electrographic photoreceptor according to claim 8, wherein the electron transport substance is at least one of the compounds represented by any one of the above formula (III) and (VII).

10. The positive charging electrographic photoreceptor according to claim 1, wherein the protective layer consists of the binder resin and particles of metal oxide.

* * * * *